US011476618B2

(12) United States Patent
Nakazawa et al.

(10) Patent No.: US 11,476,618 B2
(45) Date of Patent: Oct. 18, 2022

(54) CONNECTOR ASSEMBLY AND CONNECTOR

(71) Applicants: JAPAN AVIATION ELECTRONICS INDUSTRY, LIMITED, Tokyo (JP); PANASONIC CORPORATION, Kadoma (JP)

(72) Inventors: Katsuhiko Nakazawa, Tokyo (JP); Shoichi Toya, Hyogo (JP)

(73) Assignees: JAPAN AVIATION ELECTRONICS INDUSTRY, LIMITED, Tokyo (JP); PANASONIC HOLDINGS CORPORATION, Kadoma (JP)

( * ) Notice: Subject to any disclaimer, the term of this patent is extended or adjusted under 35 U.S.C. 154(b) by 28 days.

(21) Appl. No.: 17/281,546

(22) PCT Filed: Aug. 8, 2019

(86) PCT No.: PCT/JP2019/031378
§ 371 (c)(1),
(2) Date: Mar. 30, 2021

(87) PCT Pub. No.: WO2020/070977
PCT Pub. Date: Apr. 9, 2020

(65) Prior Publication Data

US 2021/0367378 A1 Nov. 25, 2021

(30) Foreign Application Priority Data

Oct. 1, 2018 (JP) ..... JP2018-186752

(51) Int. Cl.
*H01R 13/44* (2006.01)
*H01R 13/631* (2006.01)
(Continued)

(52) U.S. Cl.
CPC ..... *H01R 13/631* (2013.01); *H01R 13/422* (2013.01); *H01R 13/639* (2013.01); *H01R 25/006* (2013.01)

(58) Field of Classification Search
CPC ..... H01R 13/631; H01R 1/639; H01R 13/422
(Continued)

(56) References Cited

U.S. PATENT DOCUMENTS 1,835,688 A * 12/1931 Atwood ..... H01R 13/20 439/642
4,040,698 A * 8/1977 Ortiz ..... H01R 13/20 439/342
(Continued)

FOREIGN PATENT DOCUMENTS

JP S5349609 Y 11/1978
JP S5349610 Y 11/1978
(Continued)

OTHER PUBLICATIONS

International Search Report (ISR) (and English translation thereof) dated Sep. 17, 2019 issued in International Application No. PCT/JP2019/031378.
(Continued)

*Primary Examiner* — Neil Abrams
(74) *Attorney, Agent, or Firm* — Holtz, Holtz & Volek PC

(57) ABSTRACT

A first housing of a first connector is provided with a second guided portion, and a second housing of a second connector is provided with a second guiding portion. The second guided portion and the second guiding portion regulate upward movement of the first connector with respect to the second connector in the up-down direction between a preliminary mated state and a final mated state and in the final mated state. The second housing further has a movable member with a regulating portion. When the movable mem-
(Continued)

ber is positioned at a locked position, the regulating portion regulates rearward movement of the first housing with respect to the second housing.

18 Claims, 42 Drawing Sheets

(51) Int. Cl.
*H01R 13/422* (2006.01)
*H01R 13/639* (2006.01)
*H01R 25/00* (2006.01)

(58) Field of Classification Search
USPC ..... 439/342, 376
See application file for complete search history.

(56) References Cited

U.S. PATENT DOCUMENTS 5,919,055 A * 7/1999 Hattori ..... H01R 13/62938 439/372
6,093,040 A 7/2000 Kodama et al.
6,400,560 B1 * 6/2002 Chian ..... B60R 11/0235 345/169
6,457,988 B1 * 10/2002 Andersen ..... H01R 13/567 439/651
8,299,656 B2 * 10/2012 Allard ..... F16M 13/02 307/154
8,830,660 B2 * 9/2014 Kuehl ..... G05G 7/02 361/679.01
8,876,540 B2 * 11/2014 Lavender ..... H01R 13/447 439/376
9,455,542 B2 * 9/2016 Gaither ..... H01R 31/06
11,362,453 B2 * 6/2022 Nakazawa ..... H01R 13/641
2011/0306229 A1 12/2011 Katsui et al.
2021/0367378 A1 * 11/2021 Nakazawa ..... H01R 13/422
2021/0391665 A1 * 12/2021 Nakazawa ..... H01R 13/629

FOREIGN PATENT DOCUMENTS

JP H06163107 A 6/1994
JP H11297407 A 10/1999
JP 2012003874 A 1/2012
JP 2013026159 A 2/2013
JP 2016157665 A 9/2016

OTHER PUBLICATIONS

Written Opinion dated Sep. 17, 2019 issued in International Application No. PCT/JP2019/031378.

* cited by examiner

CONNECTOR ASSEMBLY AND CONNECTOR

TECHNICAL FIELD

This invention relates to a connector assembly, particularly to a connector assembly provided with a pair of connectors which finish mating of them by two step operation.

BACKGROUND ART

Patent Document 1 discloses a connector assembly which is provided with a pair of connectors which finish mating of them by two step operation. Here, the two step operation means that a first operation and a second operation are continuously carried out, wherein the first operation is an operation which moves a first connector in an attaching-detaching direction with respect to a second connector, and the second operation is an operation which moves the first connector in a sliding direction different from the attaching-detaching direction with respect to the second connector.

Referring to FIG. 49, the connector assembly disclosed in Patent Document 1 is provided with a connector (a first connector) 100 and a socket (a second connector) 110. The connector 100 is provided with a plurality of electrode terminals (first contacts) 101 and a connector body (a first housing) 102. The connector body 102 is provided with a recess portion 103. The electrode terminals 101 are located in the recess portion 103 in part. The socket 110 is provided with a plurality of electrode receiving terminals (second contacts; not shown) and a socket body (a second housing) 112 which holds the electrode receiving terminals. The socket body 112 is provided with a protruding portion 113. The protruding portion 113 is formed with insertion grooves 114 corresponding to the electrode receiving terminals, respectively.

As understood from FIG. 14, connection between the connector 100 and the socket 110 is carried out as follows. It is assumed here that the socket 110 is fixed on a wall. First, the connector 100 is made face the socket 110. Next, the connector 100 is moved toward the socket 110 along the attaching-detaching direction so that the protruding portion 113 is received by a lower space of the recess portion 103. Subsequently, the connector 100 is slid with respect to the socket 110 along the sliding direction perpendicular to the attaching-detaching direction so that the electrode terminals 101 are inserted into the insertion grooves 114 in part. In this manner, the electrode terminals 101 and the electrode receiving terminals (not shown) are connected to each other.

PRIOR ART DOCUMENTS

Patent Document(s)

Patent Document 1: Japanese Examined Utility Model Application Publication No. S53(1978)-49610

SUMMARY OF INVENTION

Technical Problem

If an external force in a direction of moving the connector away from the socket 110 is added to the connector 100 along the attaching-detaching direction in a state that the connector 100 and the socket 110 of the connector assembly which are disclosed in Patent Document 1 are connected to each other, almost all the external force is received by the electrode terminals 101. As a result, the electrode terminals 101 may be deformed or damaged. Moreover, if an external force in a direction of pulling the electrode terminals 101 out from the insertion grooves 114 is added on the connector 100 along the sliding direction in the state that the connector 100 and the socket 110 are connected to each other, the connector 100 would be easily detached from the socket 110. Thus, the connector assembly of Patent Document 1 has a problem of low resistance to an external force.

It is therefore an object of the present invention to provide a connector assembly which has a high resistance to an external force when the first connector and the second connector are in a mated state.

Solution to Problem

One aspect of the present invention provides, as a first connector assembly, a connector assembly comprising a first connector and a second connector, wherein:

the first connector and the second connector are shiftable from a separated state to a preliminary mated state by moving the first connector downward with respect to the second connector in an up-down direction;

the first connector and the second connector are shiftable from the preliminary mated state to the separated state by moving the first connector upward with respect to the second connector in the up-down direction;

the first connector and the second connector are shiftable from the preliminary mated state to a final mated state by moving the first connector forward with respect to the second connector in a front-rear direction perpendicular to the up-down direction;

the first connector and the second connector are shiftable from the final mated state to the preliminary mated state by moving the first connector rearward with respect to the second connector in the front-rear direction;

the first connector comprises at least one first contact and a first housing which holds the first contact;

the second connector comprises at least one second contact, a second housing which holds the second contact, an operation member and a movable member;

the first housing is provided with a first guided portion, a second guided portion and a regulated portion;

the second housing is provided with a first guiding portion and a second guiding portion;

the first guided portion and the first guiding portion regulate movement of the first connector with respect to the second connector in the front-rear direction between the separated state and the preliminary mated state;

the second guided portion and the second guiding portion regulate upward movement of the first connector with respect to the second connector in the up-down direction between the preliminary mated state and the final mated state and in the final mated state;

the operation member is provided with a force transmission portion;

the movable member is provided with a force receiving portion and a regulating portion;

the operation member is attached to the second housing to be movable between a first position and a second position;

the movable member is attached to the second housing to be movable between an unlocked position and a locked position;

movement of the movable member is regulated by the second housing in the front-rear direction;

the force transmission portion transmits a force in a predetermined direction to the force receiving portion according to movement of the operation member so that the movable member works together with the operation member;

when the operation member is positioned at the first position, the movable member is positioned at the unlocked position;

when the operation member is positioned at the second position, the movable member is positioned at the locked position;

when the movable member is positioned at the locked position in the final mated state, the regulating portion is positioned rearward of the regulated portion of the first housing to regulate rearward movement of the first housing with respect to the second housing; and when the movable member is positioned at the unlocked state in the final mated state, the regulating portion is not positioned rearward of the regulated portion of the first housing but allows rearward movement of the first housing with respect to the second housing.

Another aspect of the present invention provides the first connector used in the connector assembly.

Yet another aspect of the present invention provides the second connector used in the connector assembly.

Advantageous Effects of Invention

The second guided portion of the first housing and the second guiding portion of the second housing regulate the upward movement of the first connector with respect to the second connector in the up-down direction during the transition between the preliminary mated state and the final mated state and in the final mated state. Accordingly, even if an external force along the up-down direction which is of moving the first connector away from the second connector is added on the first connector, no load is generated on the first contact and the second contact. Therefore, the first contact and the second contact are prevented from being deformed and damaged by the external force. Moreover, when the movable member is positioned at the locked position, the regulating portion of the movable member is positioned rearward of the regulated portion of the first housing to regulate the rearward movement of the first housing with respect to the second housing. Accordingly, when the movable member is positioned at the locked position, the final mated state of the first connector and the second connector is maintained even if an external force of the sliding direction is added on the first connector. Therefore, the first connector and the second connector are prevented from being shifted to the separated state by an unexpected external force. Thus, the connector assembly of the present invention has high resistance to an external force.

An appreciation of the objectives of the present invention and a more complete understanding of its structure may be had by studying the following description of the preferred embodiment and by referring to the accompanying drawings.

DESCRIPTION OF EMBODIMENTS

Figure 1:
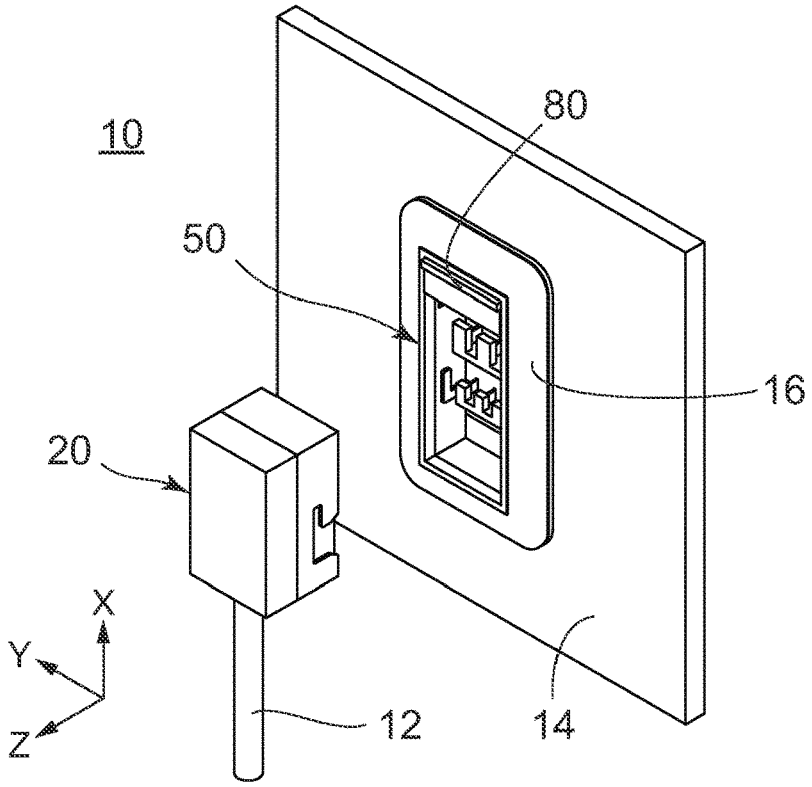
FIG. 1 is a perspective view showing a connector assembly accordingly to an embodiment of the present invention. A first connector and a second connector are in a separated state. An operation member is positioned at a first position.

While the invention is susceptible of various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIG. 1, a connector assembly 10 according to an embodiment of the present invention is provided with a first connector 20 and a second connector 50. In the present embodiment, the first connector 20 is attached to an end of a cable 12. The second connector 50 is attached to a wall 14. Moreover, a front panel 16 is attached to the second connector 50. Here, directions are defined for convenience of the description. An up-down direction is a direction in which the first connector 20 and the second connector 50 are mated with or detached from each other. In the present embodiment, the up-down direction is a Z-direction. A positive Z-direction is directed upward while a negative Z-direction is directed downward. Moreover, a front-rear direction is a direction which is perpendicular to the up-down direction and in which the first connector 20 and the second connector 50 are connected to or disconnected from each other. In the present embodiment, the front-rear direction is an X-direction. A positive X-direction is directed rearward while a negative X-direction is directed forward. A lateral direction is a direction perpendicular to both of the up-down direction and the front-rear direction. In the embodiment, the lateral direction is a Y-direction.

Figure 2:
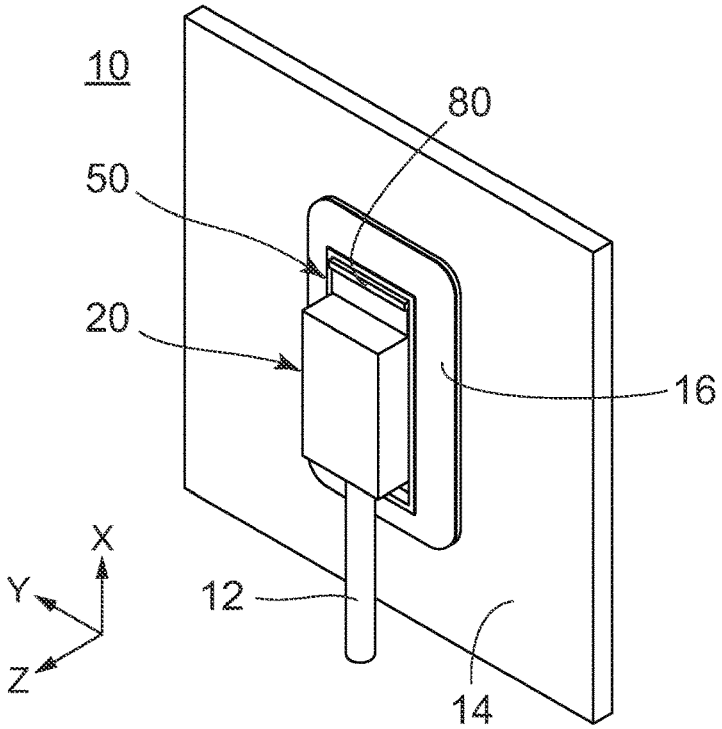
FIG. 2 is another perspective view showing the connector assembly of FIG. 1. The first connector and the second connector are in a preliminary mated state.

As understood from FIGS. 1 and 2, when the first connector 20 and the second connector 50 are in a separation state, the first connector 20 and the second connector 50 can be shifted to a preliminary mated state by moving the first connector 20 downward with respect to the second connector 50 in the up-down direction. To the contrary, when the first connector 20 and the second connector 50 are in the preliminary mated state, the first connector 20 and the second connector 50 can be shifted to the separation state by moving the first connector 20 upward with respect to the second connector 50 in the up-down direction. In the present embodiment, the "separation state" is a state that the first connector 20 and the second connector 50 are apart from each other as shown in FIG. 1. Moreover, the "preliminary mated state" is a state that the first connector 20 is positioned at a predetermined position in relation to the second connector 50 in the front-rear direction and the lateral direction and that the first connector 20 is in abutment with the second connector 50 in the up-down direction. In the preliminary mated state, the first connector 20 and the second connector 50 are not yet electrically connected to each other.

Figure 3:
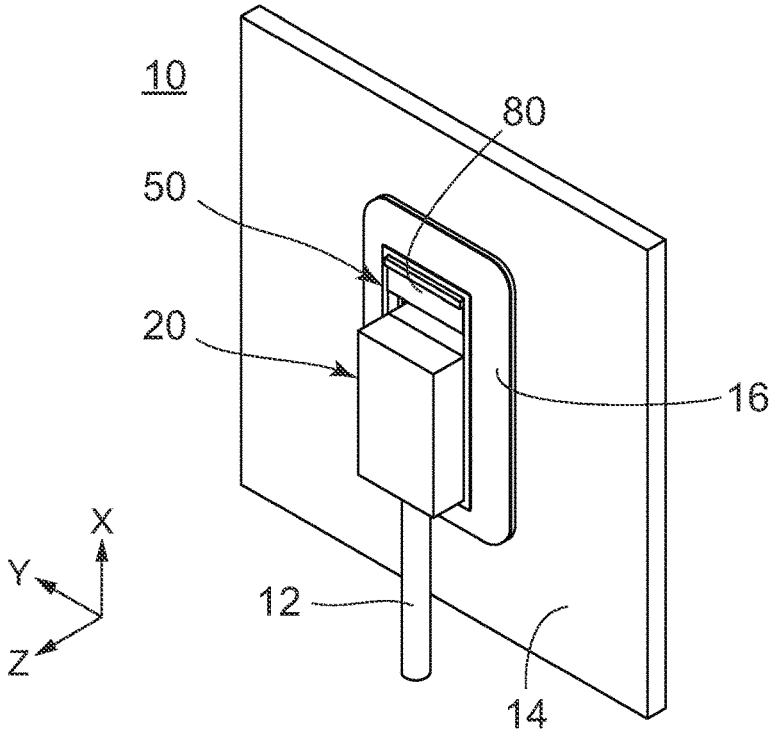
FIG. 3 is a yet another perspective view showing the connector assembly of FIG. 1. The first connector and the second connector are in a final mated state.

As understood from FIGS. 2 and 3, when the first connector 20 and the second connector 50 are in the preliminary mated state, the first connector 20 and the second connector 50 can be shifted to a final mated state by moving the first connector 20 forward with respect to the second connector 50 in the front-rear direction. To the contrary, when the first connector 20 and the second connector 50 are in the final mated state, the first connector 20 and the second connector 50 can be shifted to the preliminary mated state by moving the first connector 20 rearward with respect to the second connector 50 in the front-rear direction. The first connector 20 and the second connector 50 cannot be directly shifted from the final mated state to the separation state nor be directly shifted from the separation state to the final mated state. In the present embodiment, the "final mated state" is a state that the first connector 20 and the second connector 50 are mated with and electrically connected to each other.

Figure 4:
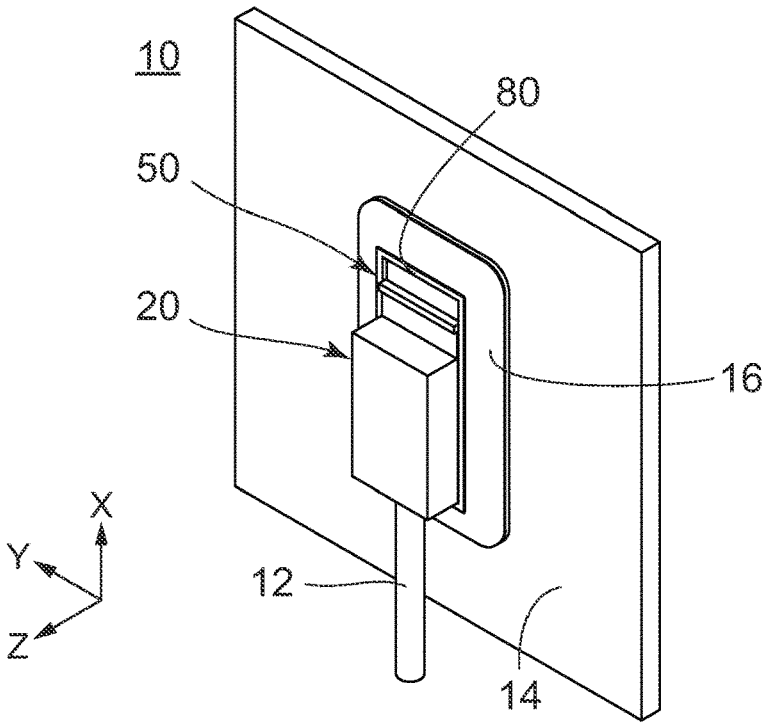
FIG. 4 is still another perspective view showing the connector assembly of FIG. 1. The first connector and the second connector are in the final mated state. The operation member is positioned at a second position

As shown in FIGS. 3 and 4, the second connector 50 is provided with an operation member 80. The operation member 80 is movable between a first position (FIG. 3) and a second position (FIG. 4). As understood from FIGS. 1 to 3, when the operation member 80 is positioned at the first position, the first connector 20 and the second connector 50 are allowed to be moved between the separation state and the preliminary mated state and to be also moved between the preliminary mated state and the final mated state. When the operation member 80 is positioned at the second position as shown in FIG. 4, the first connector 20 and the second connector 50 cannot be shifted from the separation state to the preliminary mated state nor be shifted from the final mated state to the preliminary mated state. At that time, the first connector 20 and the second connector 50 cannot be directly shifted between the separation state and the final mated state.

Figure 5:
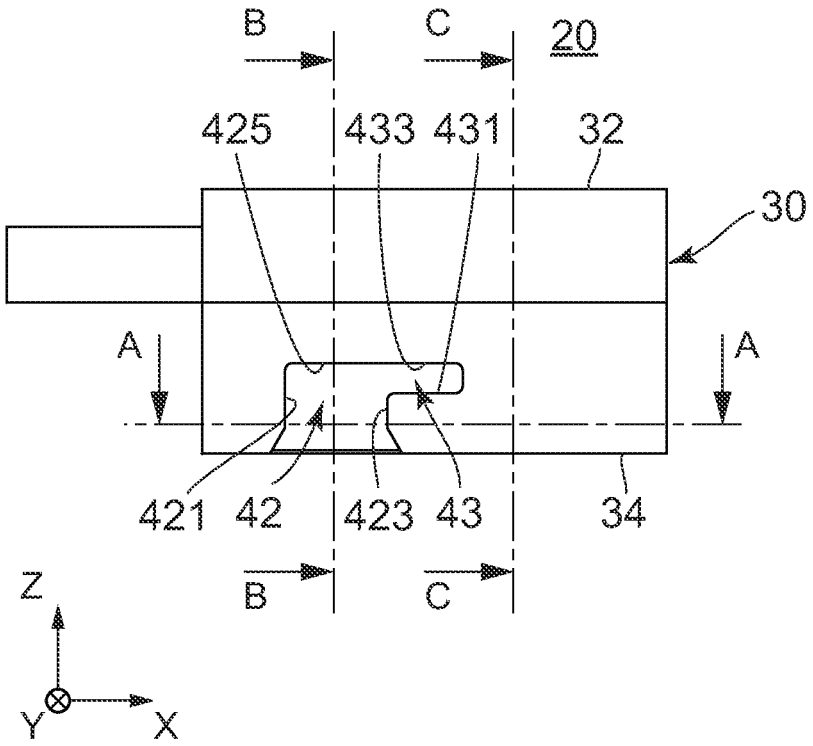
FIG. 5 is a side view showing the first connector included in the connector assembly of FIG. 1.
Figure 6:
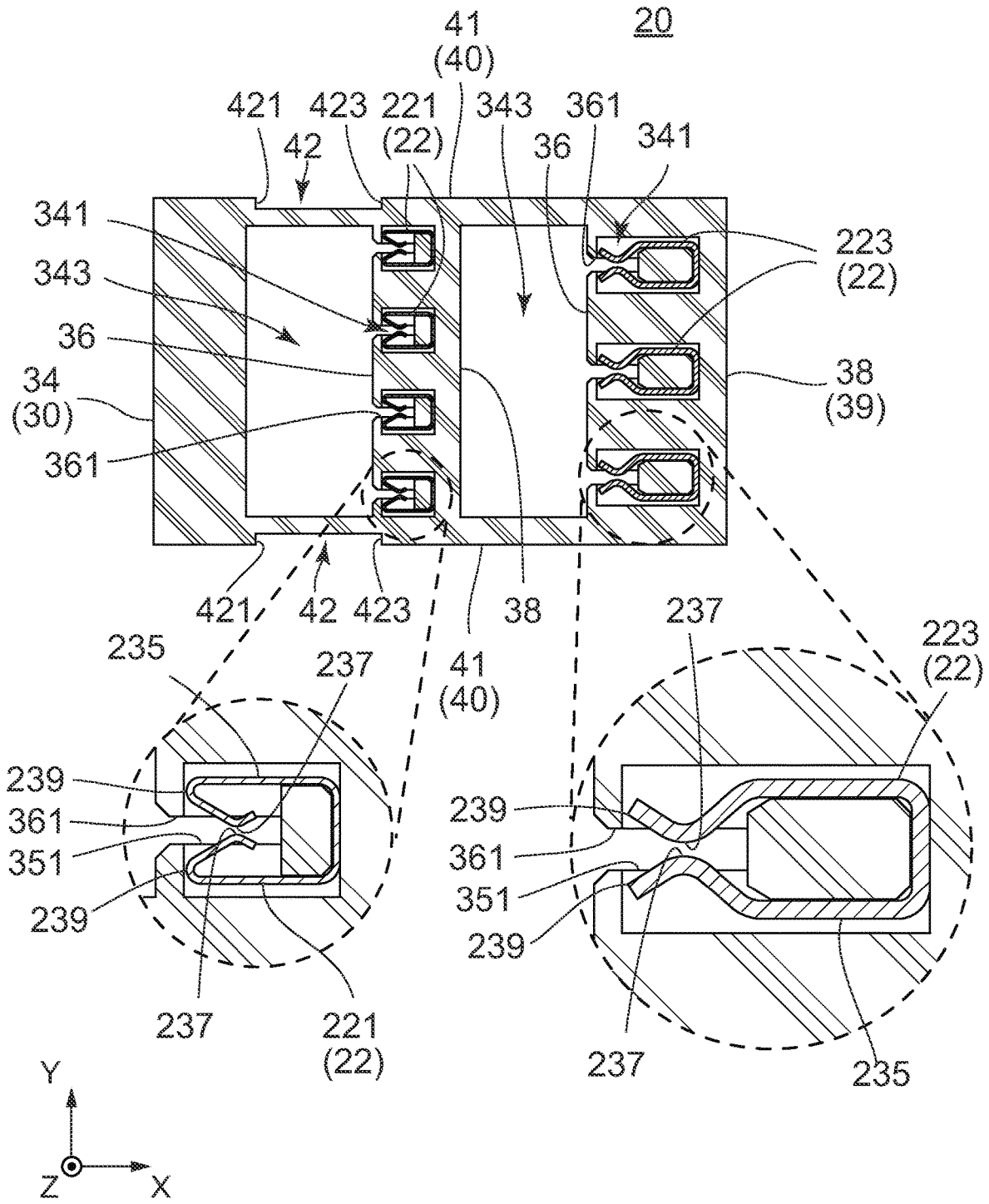
FIG. 6 is a cross-sectional view sowing the first connector of FIG. 5, taken along line A-A. One of first signal contacts and the vicinity thereof and one of first power contacts and the vicinity thereof are illustrated in enlarged fashion, respectively.

Referring to FIGS. 5 and 6, the first connector 20 is provided with a plurality of first contacts 22 and a first housing 30 which holds the first contacts 22. In the present embodiment, the first contacts 22 form two contact rows. The two contact rows are arranged one behind the other. In each of the contact rows, the first contacts 22 are arranged in the lateral direction. However, the present invention is not limited thereto. The first connector 20 should be at least one first contact 22. Moreover, the first contacts 22 may be arranged in one row or in three or more rows.

As understood from FIG. 6, the first contacts 22 include contacts of two kinds different from each other in shape and size. One of them is signal contact (first signal contact 221) and the other is power contact (first power contact 223). In the present embodiment, the number of the first signal contacts 221 is four. The first signal contacts 221 form a front contact row of the two contact rows. Moreover, the number of the first power contacts 223 is three. The first power contacts 223 form a rear contact row of the two contact rows. However, the present invention is not limited thereto. The first contacts 22 may not include two kinds of contacts but may consist of one kind of contacts. Moreover, one contact row may include two kinds of contacts.

Figure 9:
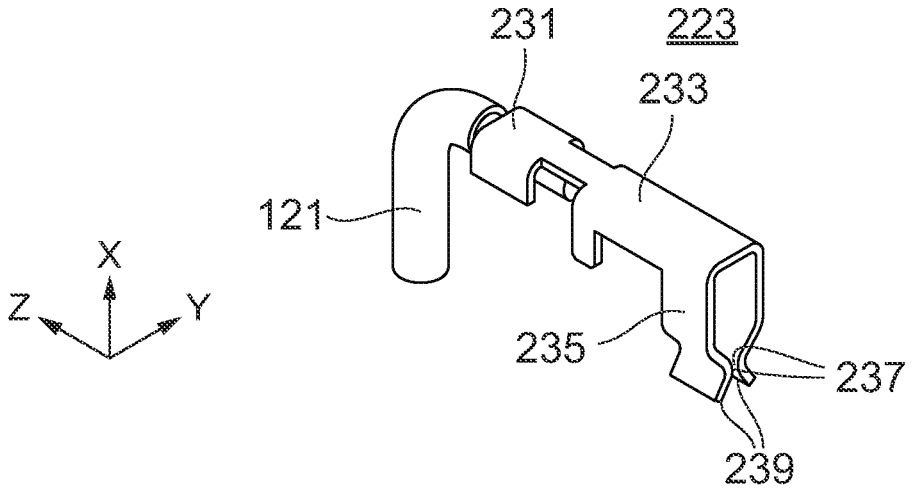
FIG. 9 is a perspective view showing the first power contact included in the first connector of FIG. 5. The power contact is connected to an end of a power line.
Figure 10:
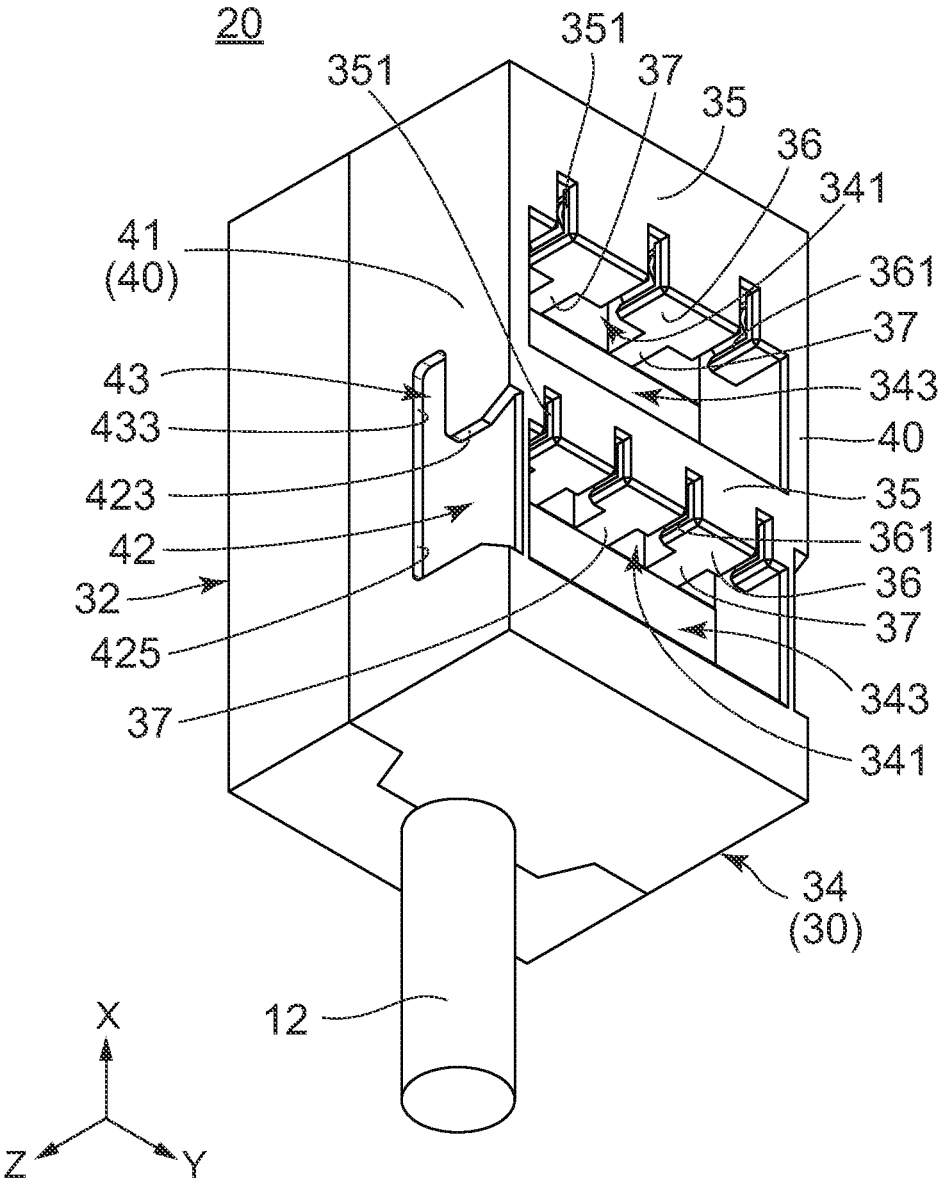
FIG. 10 is a front, perspective view showing the first connector of FIG. 5.
Figure 11:
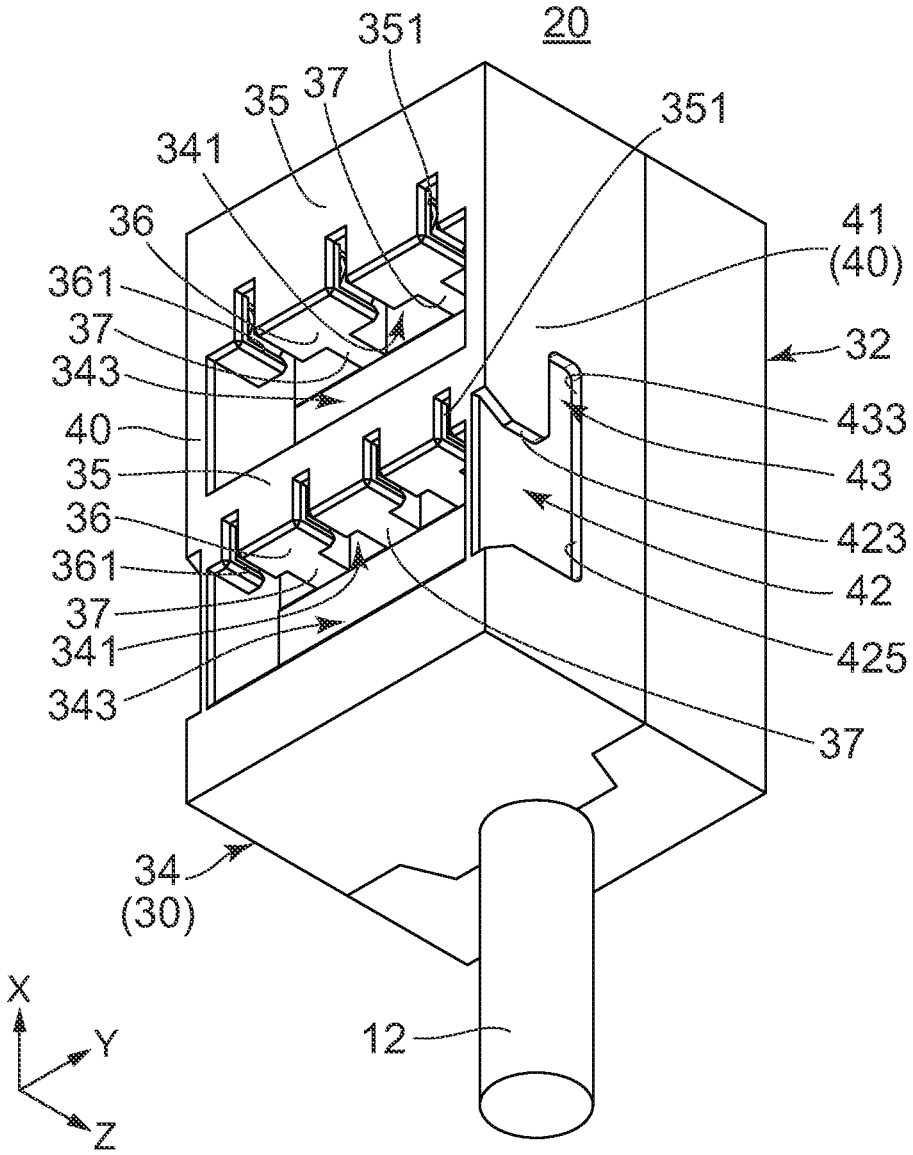
FIG. 11 shows another front, perspective view showing the first connector of FIG. 5.

As shown in FIG. 9, the first power contact 223 has a connection portion 231, a holding portion 233 and a contact portion 235. The connection portion 231 is a part which is connected to a power line 121 included in the cable 12 (see FIG. 1). The holding portion 233 is a part which is held by the first housing 30 (see FIG. 15). As shown in FIG. 6, the contact portion 235 has a pair of first contact points 237 and a pair of front-ends 239. The first contact points 237 are parts which come into contact with second contact points 537 of a second power contact 523 (see FIG. 30) described later. The first contact points 237 are apart from and face each other in the lateral direction. The first contact point 237 does not have a point shape but a line-shape. As understood from a shape of the contact portion 235, the first power contact 223 is a female-type contact in the present embodiment. The first power contact 223 is formed by applying a stamping process and a bending process to a metal sheet. The first signal contact 221 has a structure similar to that of the first power contact 223. In other words, similarly to the first power contact 223, the first signal contact 221 has a connection portion 231, a holding portion 233 and a contact portion 235. As understood from FIG. 6, the first signal contact 221 has a size smaller than that of the first power contact 223. In addition, the contact portion 235 of the first signal contact 221 has a shape different from that of the contact portion 235 of the first power contact 223. Nevertheless, the contact portion 235 of the first signal contact 221 also has a pair of first contact points 237 and a pair of front-ends 239. In the present embodiment, the first signal contact 221 is also a female contact.

Referring to FIGS. 10 to 13, the first housing 30 has an upper housing 32 and a lower housing 34. As understood from FIGS. 14 and 15, the upper housing 32 is provided with a cable accommodation portion 321. In the cable accommodation portion 321, an end portion of the cable 12 including end portions of the power lines 121 and end portions of the signal lines 123 is accommodated. Moreover, the lower housing 34 is provided with two first accommodation portions 341 and two first receiving portions 343. The first accommodation portions 341 correspond to the contact rows of the first contacts 22, respectively. The first receiving portions 343 correspond to the first accommodation portions 341, respectively. Each of the first receiving portions 343 is located forward of the first accommodation portion 341 corresponding thereto in the front-rear direction. As understood from FIGS. 6, 10 and 11, the first accommodation portion 341 and the first receiving portion 343 which correspond to each other communicate with each other. As understood from FIGS. 6 and 15, the contact portions 235 of the first contacts 22 are accommodated in part in the first accommodation portions 341. In detail, the first contacts 22 are attached to the lower housing 34 so that the first contact points 237 are located in the first accommodation portions 341.

Figure 12:
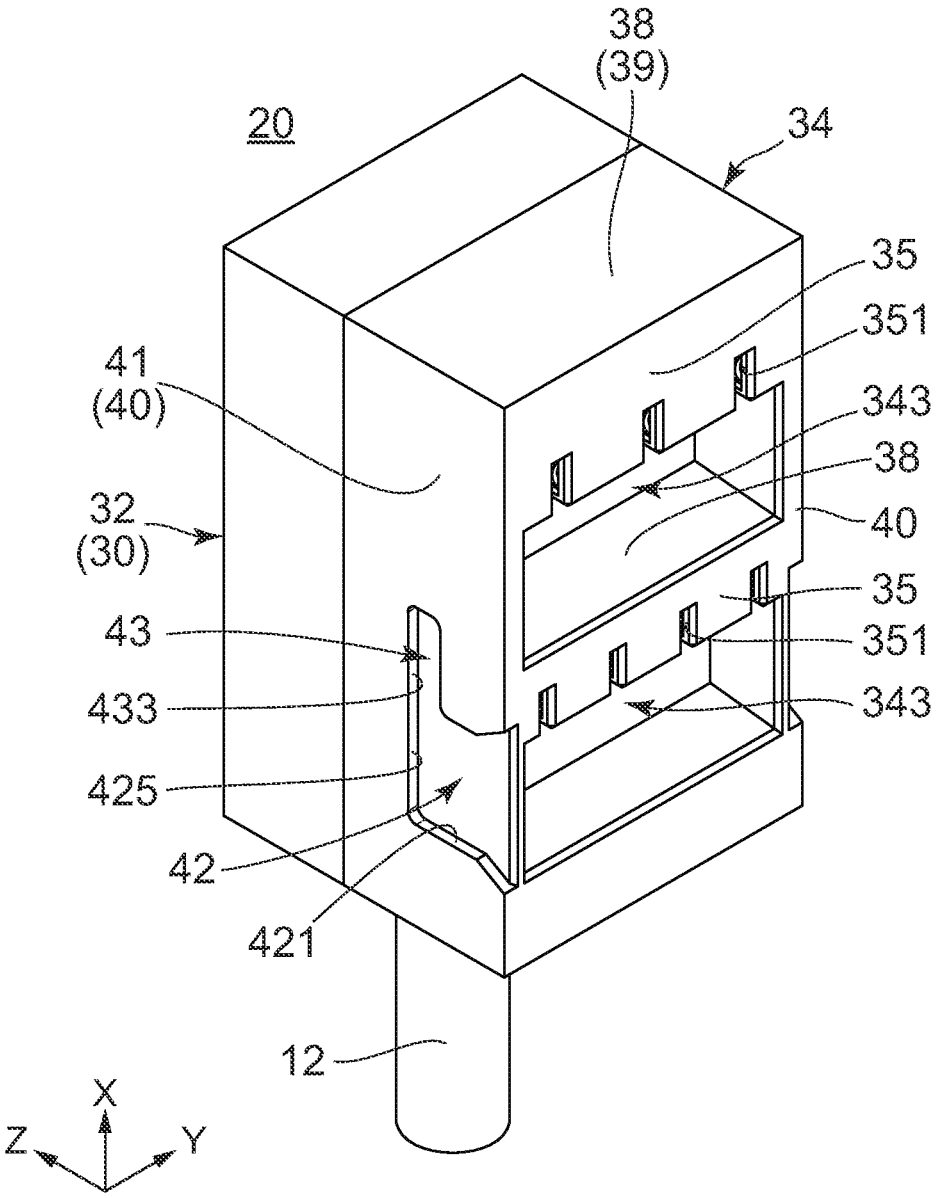
FIG. 12 is a rear, perspective view showing the first connector of FIG. 5.
Figure 13:
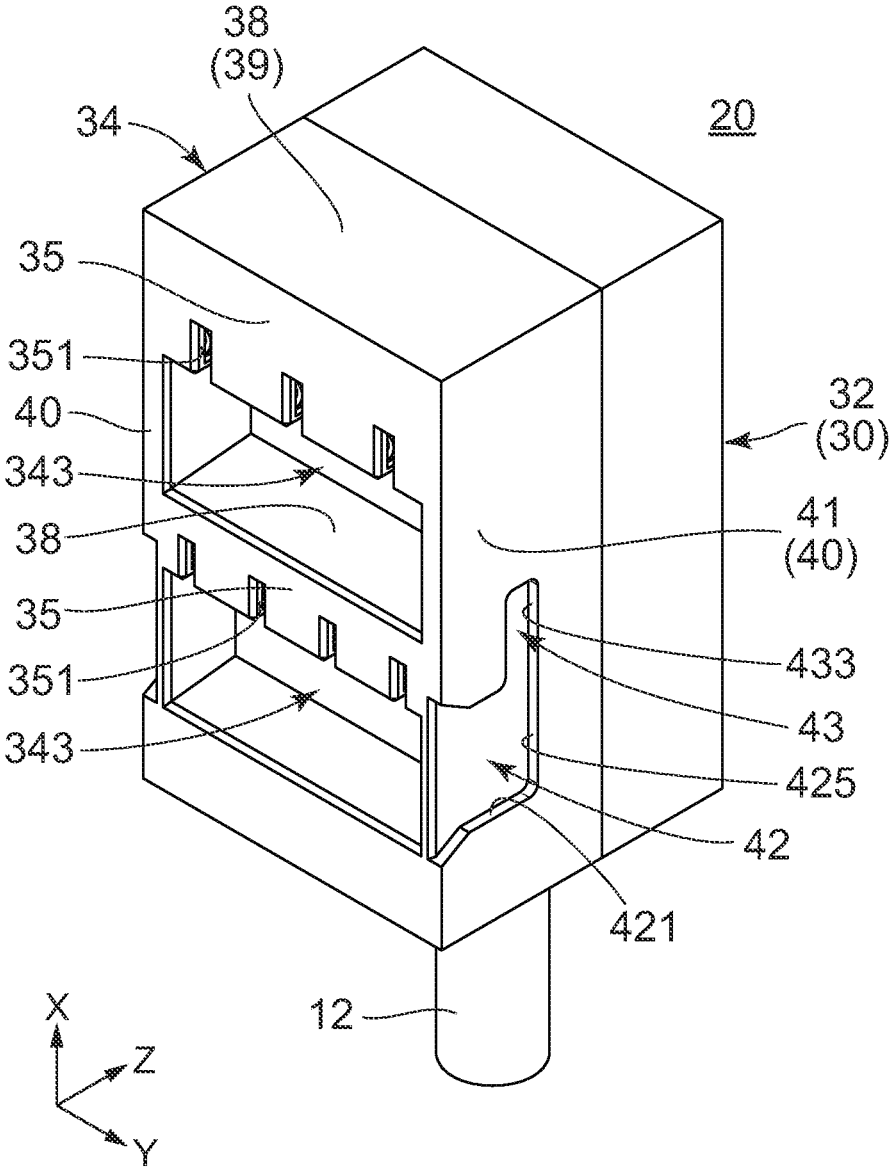
FIG. 13 is another rear, perspective view showing the first connector of FIG. 5.
Figure 14:
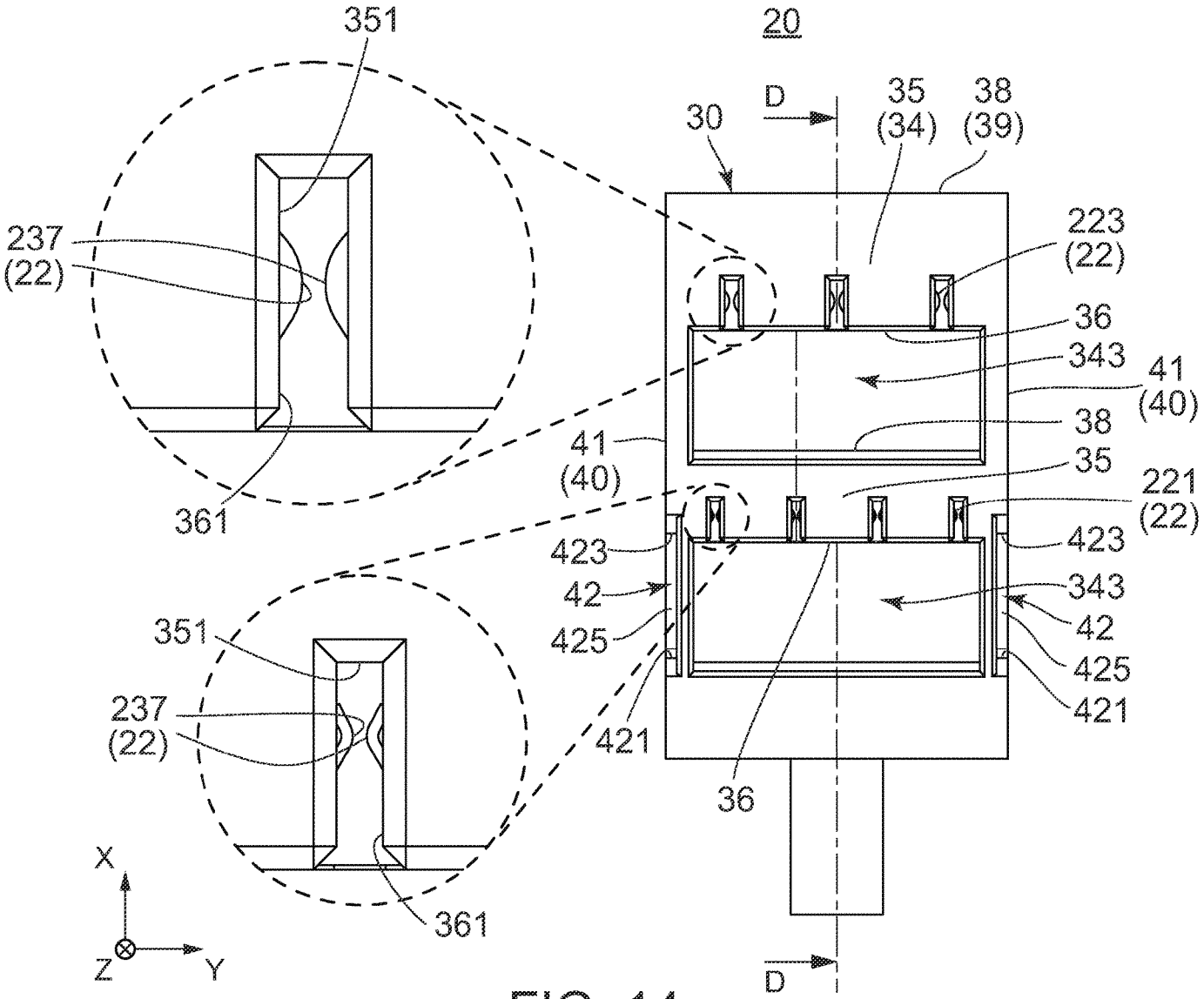
FIG. 14 is a bottom view showing the first connector of FIG. 5. A pair of contact points of the first signal contact and the vicinity thereof and a pair of contact points of the first power contact are illustrated in enlarged fashion, respectively.

As shown in FIGS. 10 to 14, the lower housing 34 has two first end walls 35. The first end walls 35 correspond to the first accommodation portions 341, respectively. Each of the first end walls 35 is located downward of the first accommodation portion 341 corresponding thereto in the up-down direction. The first end walls 35 do not exist below the first receiving portions 343. Each of the first receiving portions 343 is located, in the front-rear direction, forward both of the first accommodation portion 341 corresponding thereto and the first end wall 35 located below the first accommodation portion 341. As shown in FIG. 14, when viewed from beneath along the up-down direction, each of the first contacts 22 is hidden by either one of the first end walls 35 in part. However, the present invention is not limited thereto. The first end walls 35 should hide the first contacts 22 at least in part, and the whole of each of the first contacts 22 may be hidden.

Figure 15:
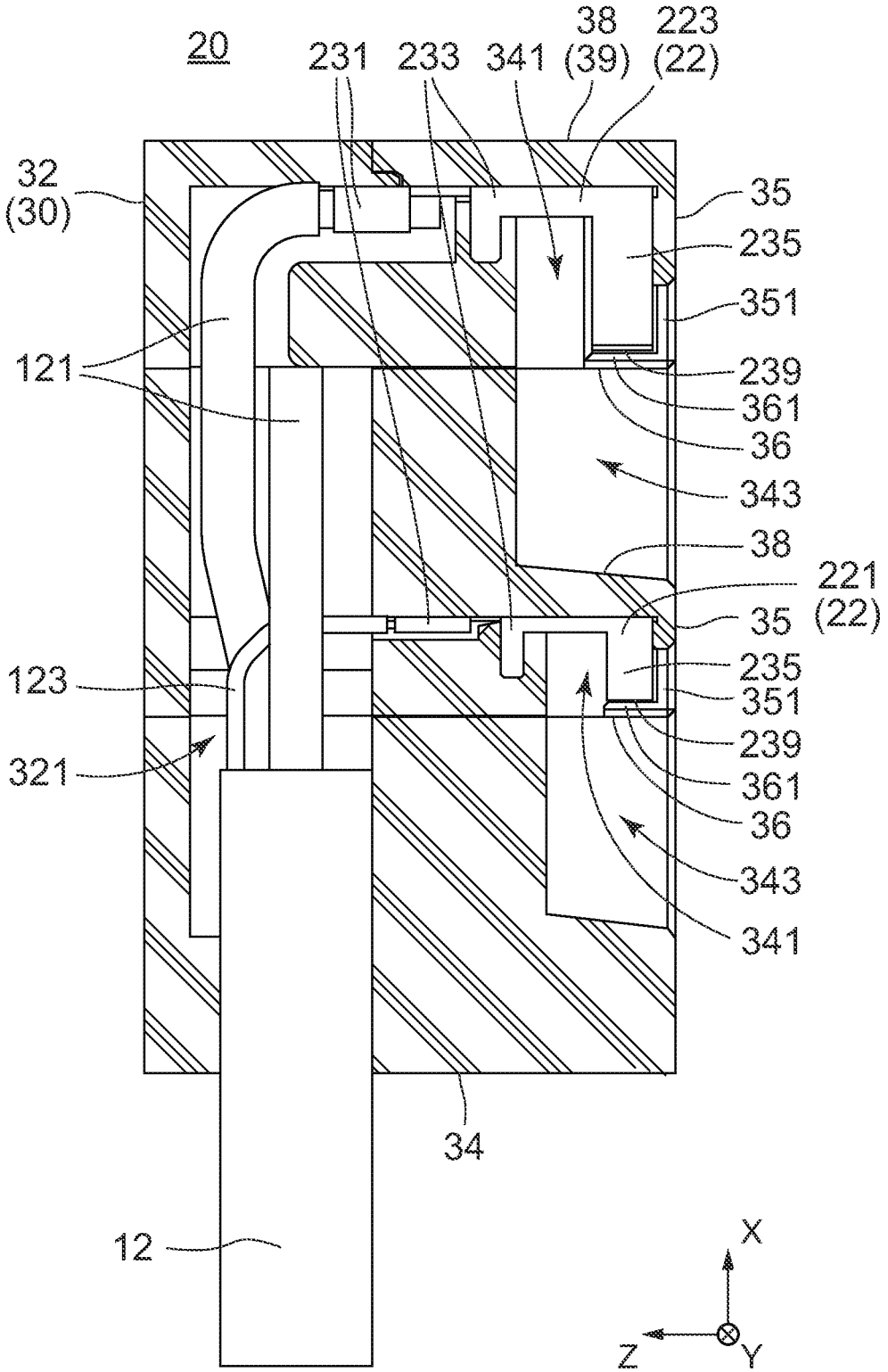
FIG. 15 is a cross-sectional view showing the first connector of FIG. 14, taken along line D-D.

As understood from FIGS. 14 and 15, the first housing 30 is formed with a plurality of first slits 351 piercing each of the first end walls 35 in the up-down direction. The first slits 351 correspond to the first contacts 22, respectively. Accordingly, the number of the first slits 351 coincide with that of the first contacts 22. In the present invention, at least one first slit 351 should be formed according to the number of the first contact(s) 22. Each of the first slits 351 extends in the front-rear direction and reaches either one of the first receiving portions 343. As shown in FIG. 14, when viewed from beneath along the up-down direction, the first contact points 237 of each of the first contacts 22 are visible through the first slit 351 corresponding thereto.

Figure 7:
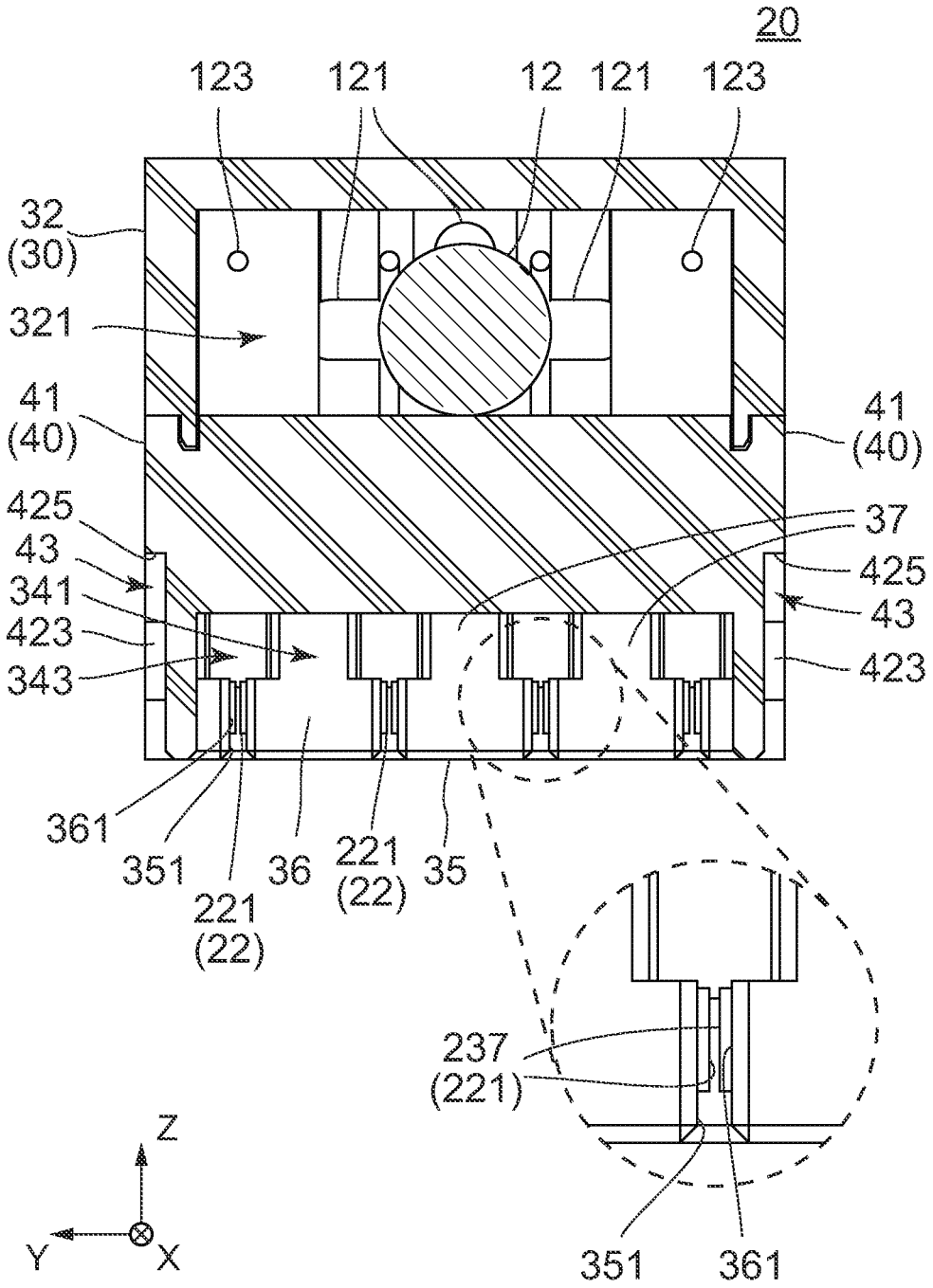
FIG. 7 is a cross-sectional view showing the first connector of FIG. 5, taken along line B-B. A pair of contact points of the first signal contact and the vicinity thereof are illustrated in enlarged fashion.
Figure 8:
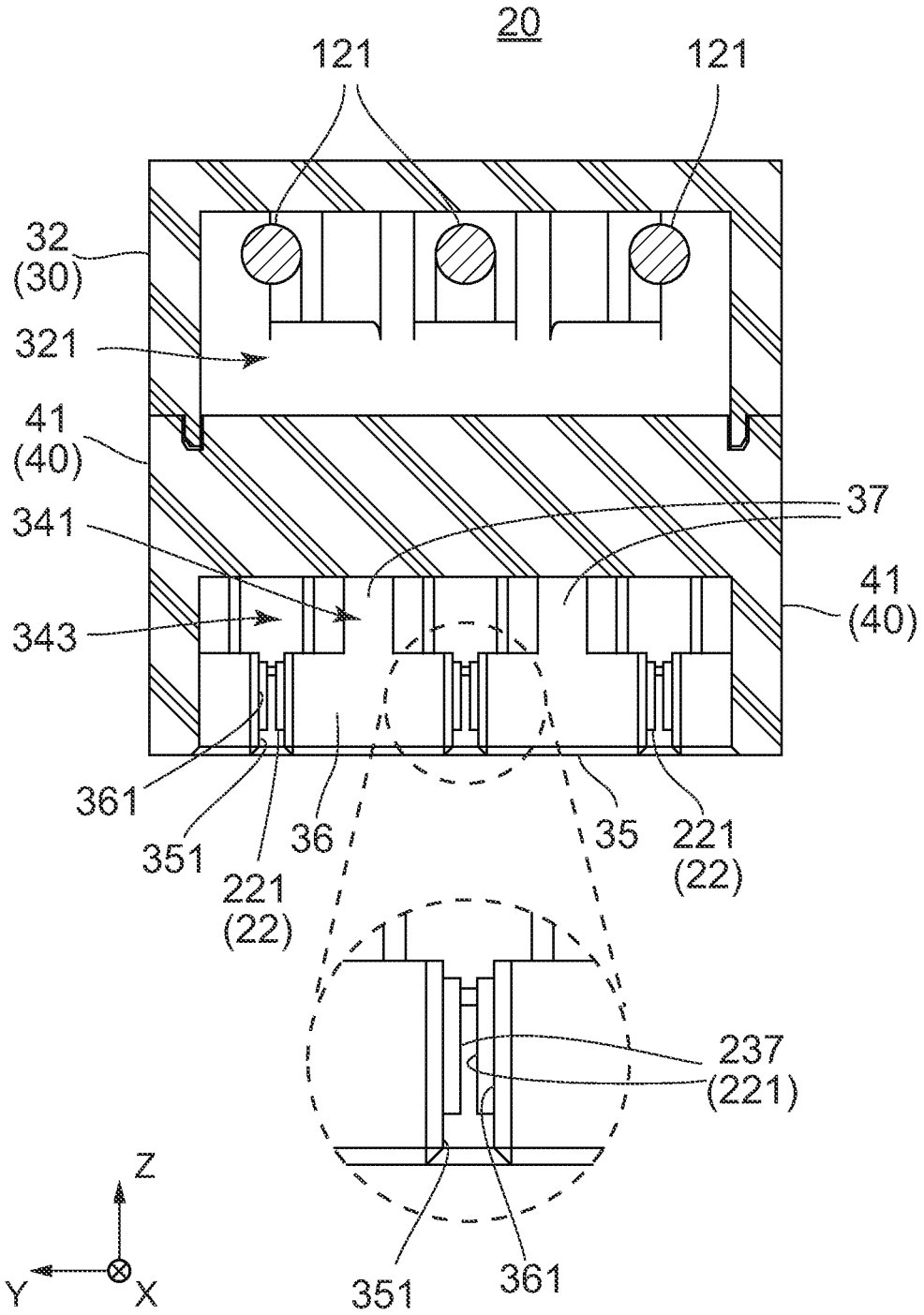
FIG. 8 is a cross-sectional view showing the first connector of FIG. 5, taken along line C-C. A pair of contact points of the first power contact and the vicinity thereof are illustrated in enlarged fashion.

Referring to FIGS. 7 and 8, the first housing 30 is provided with the two first additional walls 36. The first additional walls 36 correspond to the first end walls 35, respectively. Each of the first additional walls 36 is located between the first accommodation portion 341 and the first receiving portion 343 which correspond to each other, and it extends upward from an upper end of the first end wall 35 corresponding thereto. Each of the first additional walls 36 is formed with a plurality of second slits 361 piercing the first additional wall 36 along the front-rear direction. The second slits 361 correspond to the first slits 351, respectively. Accordingly, the number of the second slits 361 coincide with that of the first slits 351. In the present invention, at least one second slit 361 should be formed according to the number of the first slit(s) 351. Each of the second slits 361 makes the first accommodation portion 341 and the first receiving portion 343 which correspond to each other communicate with each other. In addition, each of the second slits 361 communicates with the first slit 351 corresponding thereto. As shown in FIGS. 7 and 8, when viewed from the front along the front-rear direction, the first contact points 237 of each of the first contacts 22 are visible through either one of the second slits 361. On the other hand, the front-ends 239 (see FIG. 6) of each of the first contacts 22 are hidden by either one of the first additional walls 36 when viewed from the front along the front-rear direction.

As shown in FIGS. 7, 8, 10 and 11, the first housing 30 is provided with a plurality of second additional walls 37. Each of the second additional walls 37 corresponds to either one of the first accommodation portions 341. Each of the second additional walls 37 is located between the first contacts 22 adjacent to each other in the lateral direction. Each of the second additional walls 37 is located in the first accommodation portion 341 corresponding thereto and extends in the front-rear direction. The second additional wall 37 ensures insulation between the first contacts 22 adjacent to each other. In the present embodiment, a front surface of each of the second additional walls 37 is flush with a front surface of the first additional wall 36 located forward of the first accommodation portion 341 corresponding thereto. However, the front surface of each of the second additional walls 37 may not be flush with the front surface of the first additional wall 36 located forward of the first accommodation portion 341 corresponding thereto.

As shown in FIGS. 12, 13 and 15, the first housing 30 is provided with two third additional walls 38. The third additional walls 38 correspond to the first accommodation portions 341, respectively. The third additional walls 38 enhance strength of the first housing 30. As understood from FIG. 15, each of the third additional walls 38 is located rearward of the first accommodation portion 341 corresponding thereto in the front-rear direction. As understood from FIGS. 6 and 15, when viewed from behind along the front-rear direction, the third additional wall 38 hides the first contacts 22 accommodated in the first accommodation portion 341 corresponding thereto. Each of the third additional walls 38 may be divided in two or more so as to respectively correspond to the first contacts 22 located in the first accommodation portion 341 corresponding thereto. One of the third additional walls 38 forms a part of a rear-end surface 39 of the first housing 30. The rear-end surface 39 functions as a regulated portion as described later. In other words, the first housing 30 is provided with the regulated portion.

As shown in FIGS. 6, 10, 11 and 14, the first housing 30 is provided with a pair of first sidewalls 40 extending in the front-rear direction. The first sidewalls 40 are located at both ends of the first housing 30 in the lateral direction and face each other. Each of the first end walls 35, the first additional walls 36, the second additional walls 37 and the third additional walls 38 is coupled with the first sidewalls 40 at both ends thereof in the lateral direction. Moreover, the first accommodation portions 341 and the first receiving portions 343 are located between the first sidewalls 40. However, the present invention is not limited thereto. The first housing 30 may not be provided with the first sidewalls 40.

As shown in FIGS. 10 to 13, each of the first sidewalls 40 has an outer surface 41 facing outward in the lateral direction. The outer surface 41 is formed with a first groove 42 and a second groove 43 which are recessed inward in the lateral direction. The first groove 42 and the second groove 43 communicate with each other. In detail, as shown in FIG. 5, the first groove 42 extends in the up-down direction. The first groove 42 is opened downward and closed upward. The first groove 42 has a front inner wall surface 421 and a rear inner wall surface 423 which are located both sides in the front-rear direction and an upper inner wall surface 425 facing downward in the up-down direction. The second groove 43 extends rearward in the front-rear direction from an upper portion of the first groove 42. The second groove 43 has a lower inner wall surface 431 facing upward and an upper inner wall surface 433 facing downward in the up-down direction. The upper inner wall surface 433 of the second groove 43 is flush with the upper inner wall surface 425 of the first groove 42. In other words, the upper inner wall surface 433 of the second groove 43 and the upper inner wall surface 425 of the first groove 42 are formed to be flush with each other. As described later, the front inner wall surface 421 and the rear inner wall surface 423 of the first groove 42 function as a first guided portion. Moreover, the lower inner wall surface 431 of the second groove 43 functions as a second guided portion. Thus, the first housing 30 is provided with the first guided portion and the second guided portion. However, the present invention is not limited thereto. The first guided portion and the second guided portion may be provided to a wall portion other than the first sidewalls 40. For example, a wall portion extending in the front-rear direction may be provided at a position apart from the both sides in the lateral direction, and grooves corresponding to the first groove 42 and the second groove 43, respectively, are formed in a side surface of the wall. This is notably effective in a case that the first connector 20 does not have the first sidewalls 40.

Figure 16:
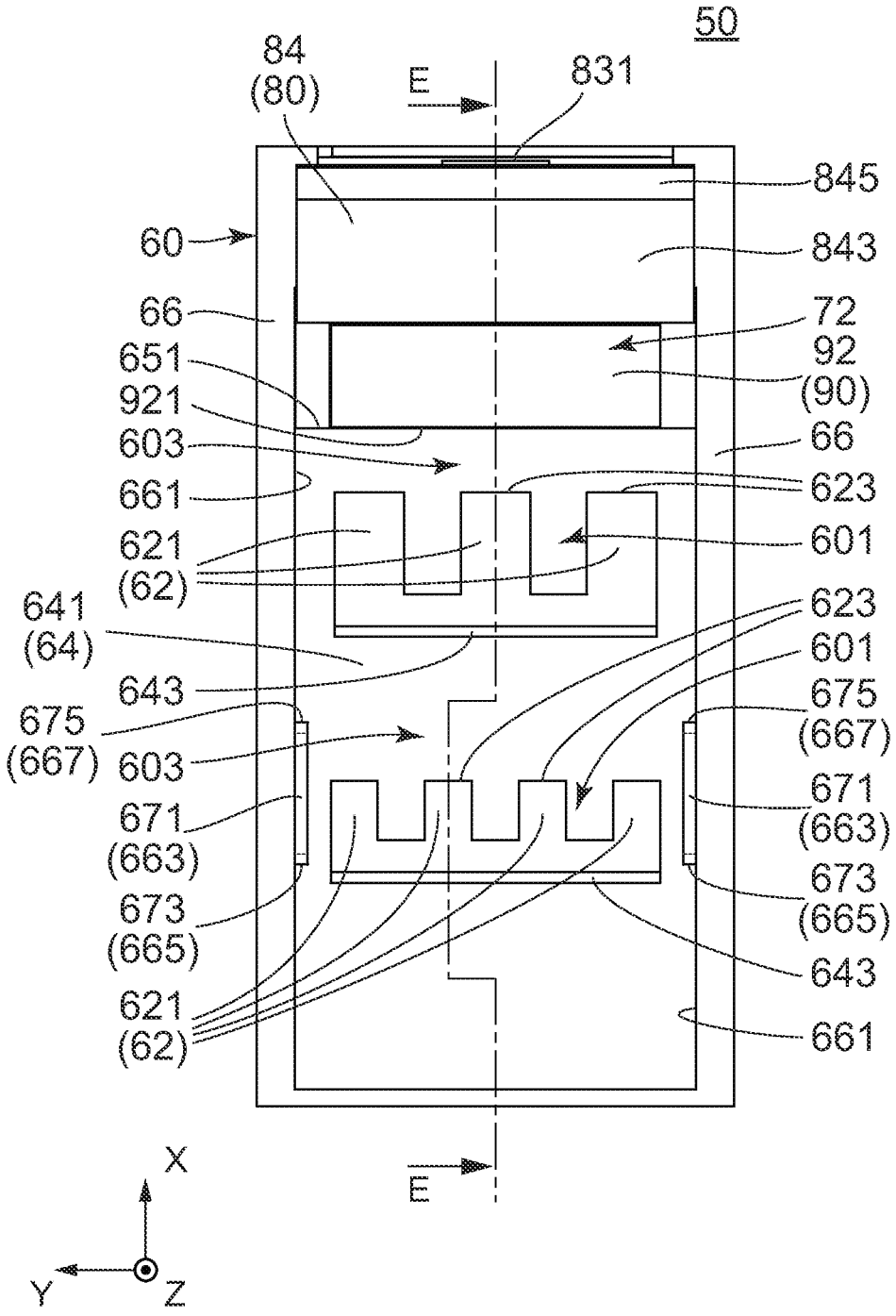
FIG. 16 is a plane view showing the second connector included in the connector assembly of FIG. 1. The operation member is positioned at the first position.
Figure 17:
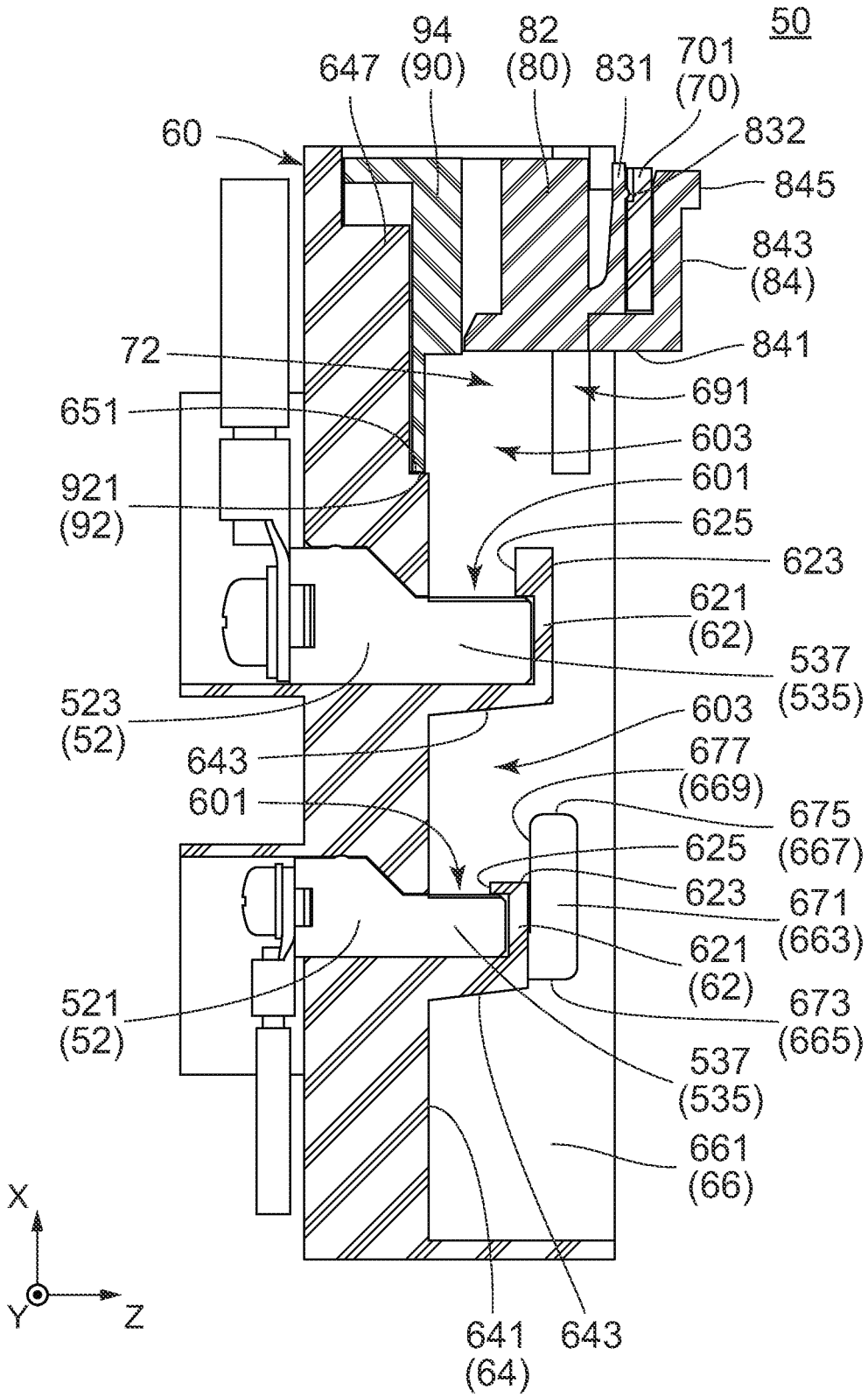
FIG. 17 is a cross-sectional view showing the second connector of FIG. 16, taken along line E-E.
Figure 18:
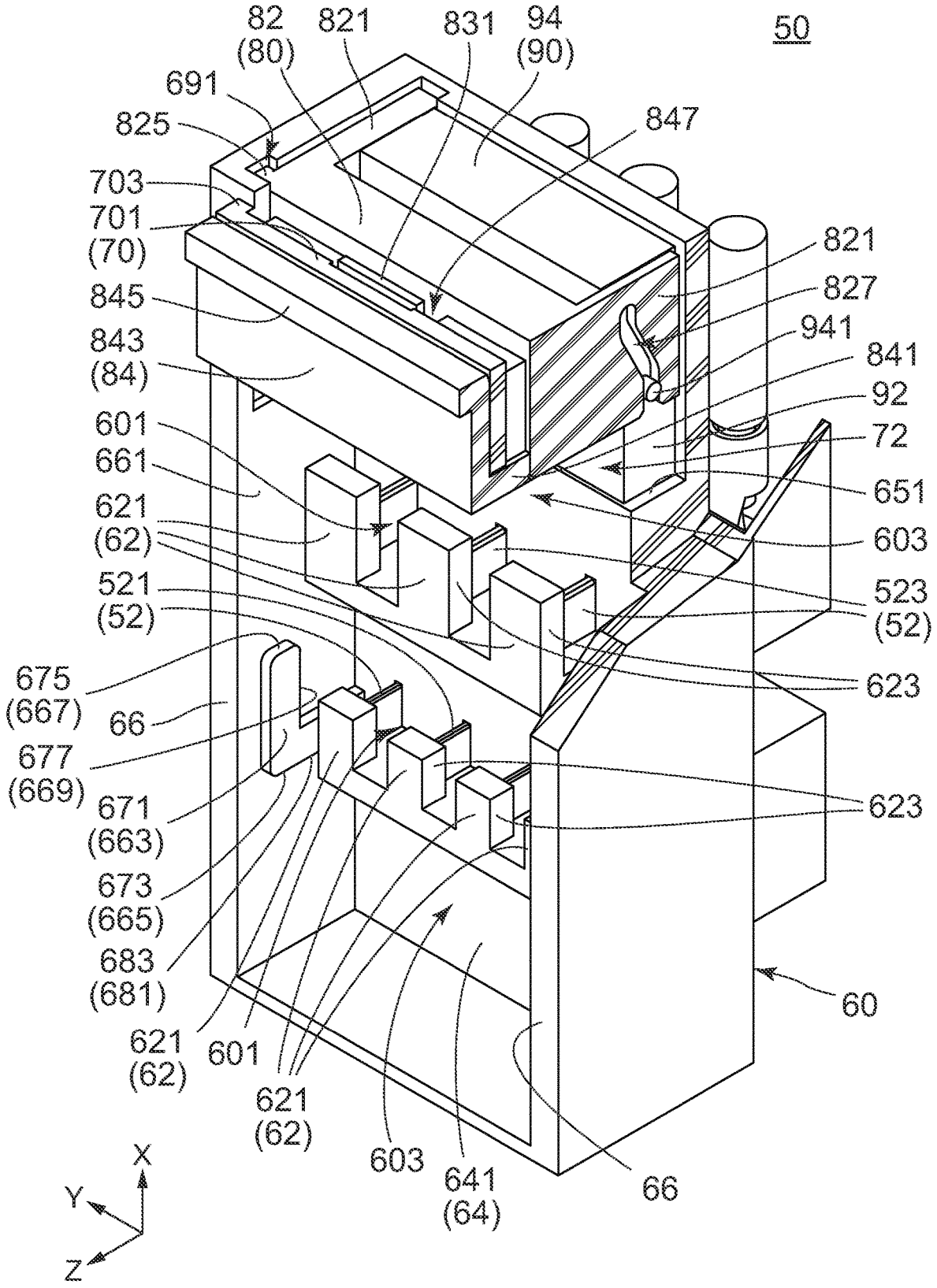
FIG. 18 is a rear, perspective view showing the second connector of FIG. 16. The second connector is cut away in part.

Referring to FIGS. 16 to 18, the second connector 50 is provided with a plurality of second contacts 52, a second housing 60 which holds the second contacts 52, the operation member 80 and a movable member 90. The second contacts 52 correspond to the first contacts 22, respectively. In other words, the number of and the kind of the second contacts 52 depend on the first contacts 22. In the present embodiment, the second contacts 52 include signal contacts (second signal contacts 521) and power contacts (the second power contacts 523). As understood from FIG. 18, the second signal contacts 521 are arranged in a row in the lateral direction to form one contact row. Similarly, the second power contacts 523 are also arranged in a row in the lateral direction to form another contact row. The contact row of the second signal contacts 521 and the contact row of the second power contacts 523 are arranged one behind the other.

Figure 29:
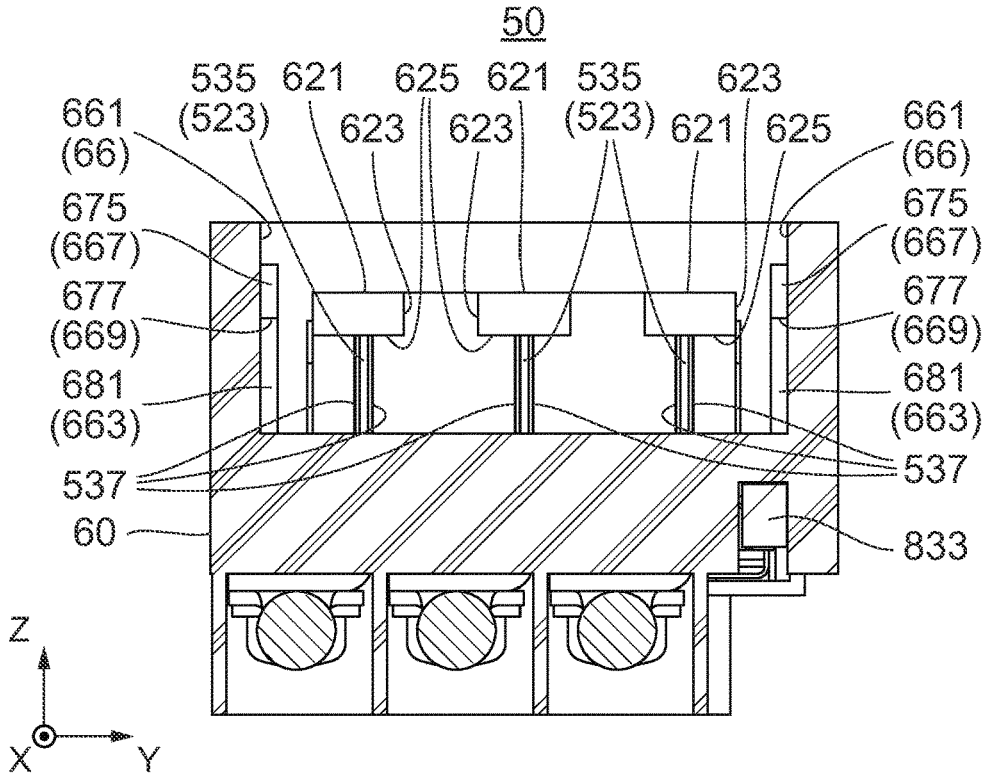
FIG. 29 is a cross-sectional view showing the second connector of FIG. 27, taken along line I-I.
Figure 30:
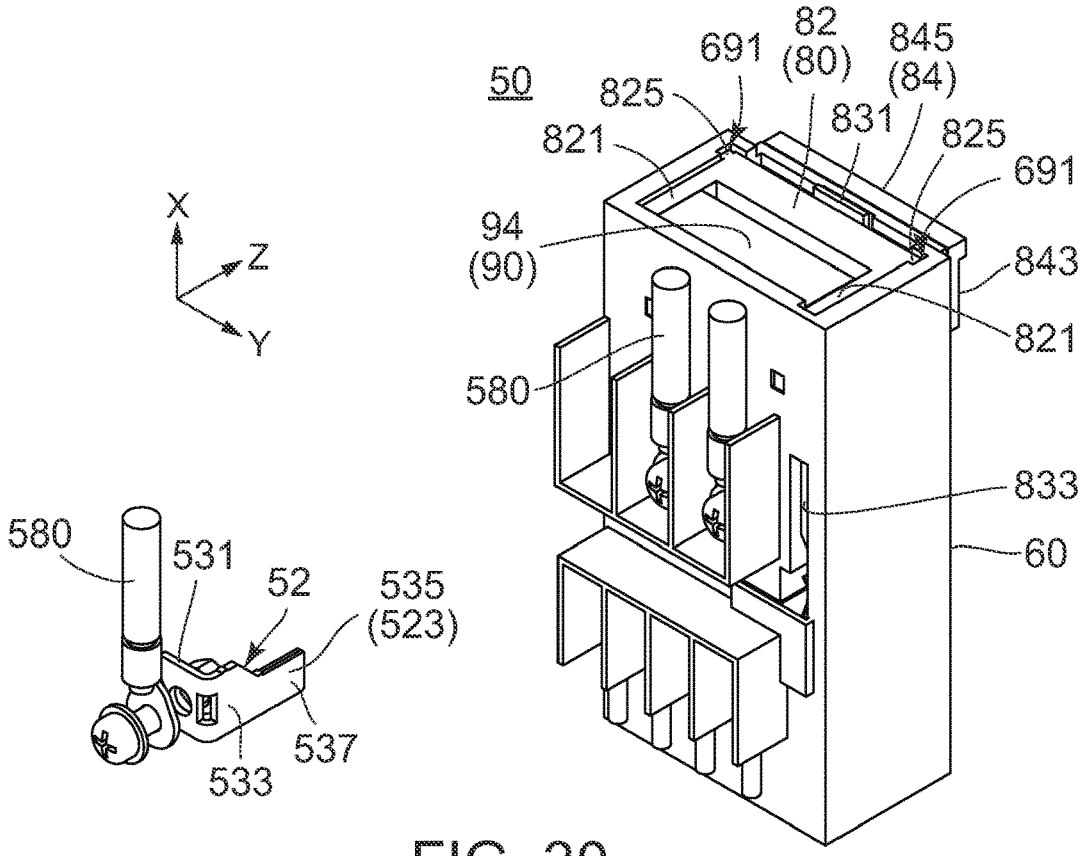
FIG. 30 is a lower, perspective view showing the second connector of FIG. 16. Second signal contacts are omitted in the figure. One of second power contacts is not held by a second housing yet.

As understood from FIG. 30, in the present embodiment, each of the second power contacts 523 is made of a metal sheet bent in a L-shape. The second power contact 523 has a connection portion 532, a fixing portion 533 and a contact portion 535. The connection portion 531 is provided with an aperture. The connection portion 531 is attached to a terminal fixed to an end of a power line 580 and fixed to the second housing 60. The fixing portion 533 is a part which is fixed to the second housing 60 by press fitting. The contact portion 535 has a blade shape and has a pair of the second contact points 537 (see FIG. 29) which come into contact with the contact portions 235 of the first contact 22 corresponding thereto. The second contact point 537 is not a point but a plane. As understood from the shape of the contact portion 535, the second power contact 523 is a male-type contact in the present embodiment. As understood from FIG. 33, the second signal contacts 521 are formed similarly to the second power contacts 523 except one of them. In detail, the second signal contacts 521 include a detecting contact 525 and normal second signal contacts 521 other than the detecting contact 525. The normal second signal contact 521 is formed similarly to the second power contact 523. The normal second signal contact 521 is smaller than the second power contact 523 in size. The detecting contact 525 is used to detect the final mated state of the first connector 20 and the second connector 50. The detecting contact 525 has a structure different from that of the normal second signal contact 521.

Figure 36:
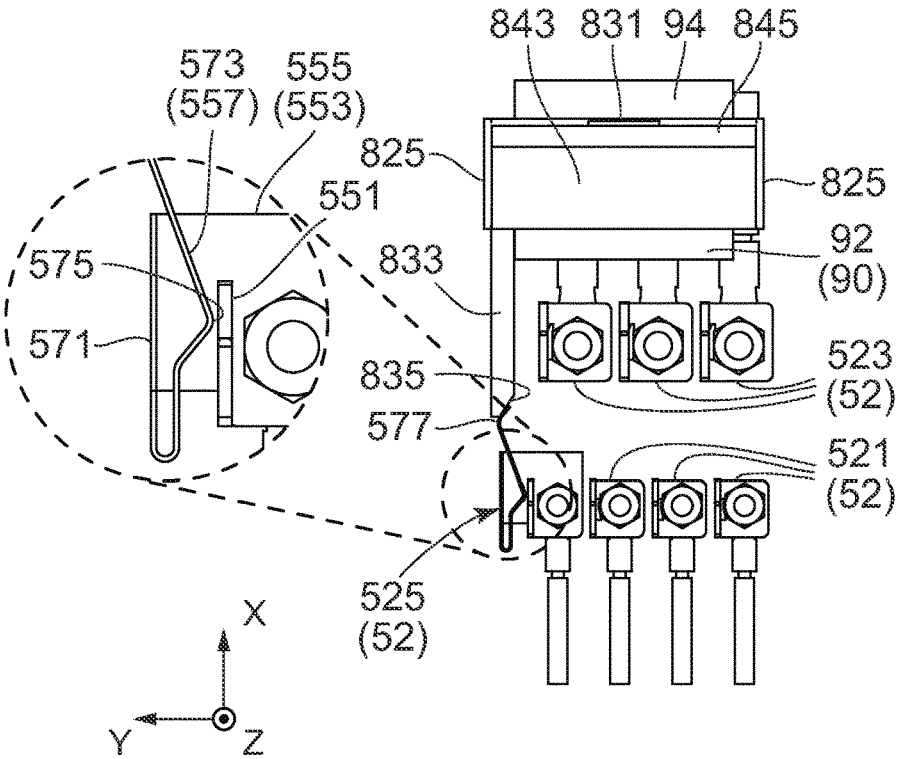
FIG. 36 is a plane view showing the second contacts, the operation member and the movable member of FIG. 35.
Figure 39:
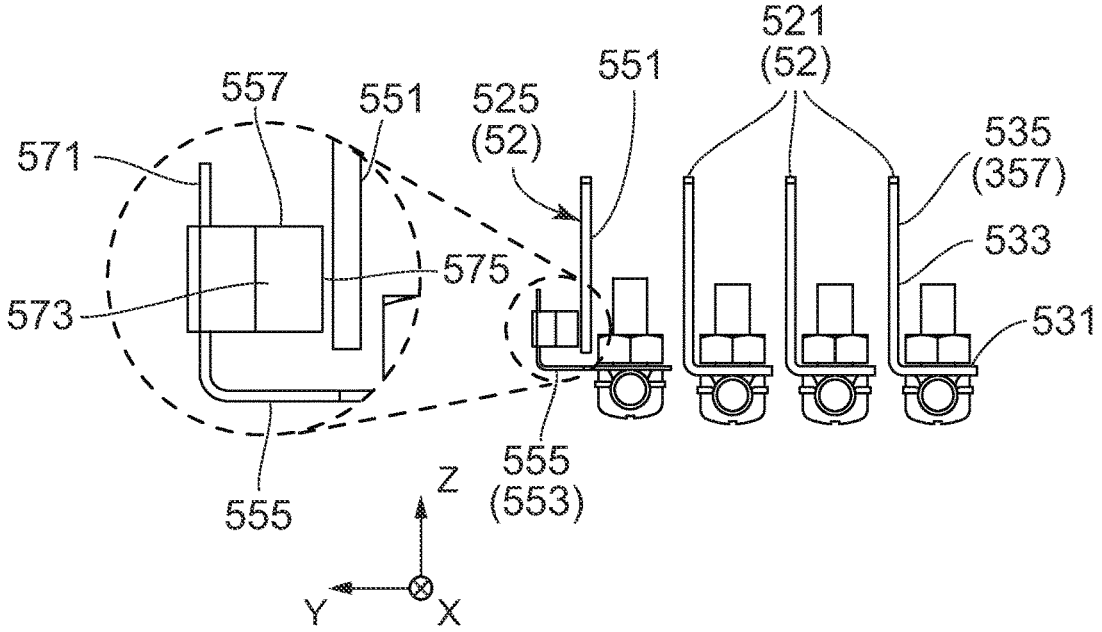
FIG. 39 is a front view showing signal contacts included in the second contacts of FIG. 33.

As shown in FIG. 39, the detecting contact 525 has a contact piece portion 551 and a body portion 553 separated from the contact piece portion 551. The contact piece portion 551 is a part corresponding to the contact portion 535 and the fixing portion 533 of the normal second contact 52. The contact piece portion 551 is fixed to the second housing 60 by press fitting. The contact piece portion 551 comes into contact with one of the first signal contacts 221 of the first contacts 22 in the final mated state. The body portion 553 is provided with a resilience piece portion 557 in addition to a base portion 555 corresponding to the connection portion 531 of the normal second contact 52. The base portion 555 is a part which is fixed to the second housing 60 using a screw or a bolt. The resilience piece portion 557 has a contact portion 575 contactable with the contact piece portion 551 and functions as a part of a connection state switching mechanism. In detail, as shown in FIGS. 36 and 39, the resilience piece portion 557 has a supporting portion 571, which extends upward from an edge of the base portion 555, and a resilience portion 573, which extends forward from the supporting portion 571, then bent rearward and further extends roughly rearward. The resilience portion 573 has a contact portion 575 protruding toward the contact piece portion 551 and an operation portion 577 protruding in a direction opposite to the contact portion 575. In the front-rear direction, the contact portion 575 is located near the middle of resilience portion 573, and the operation portion 577 is located near a rear end of the resilience portion 573. In the present embodiment, when the operation portion 577 is not operated, there is a space between the contact portion 575 and the contact piece portion 551. That is, the contact piece portion 551 and the body portion 553 are electrically separated from each other. Upon operating the operation portion 577, the resilience portion 573 is resiliently deformed so that the contact portion 575 comes into contact with the contact piece portion 551. In this way, the contact piece portion 551 and the body portion 553 are electrically connected to each other. However, the present invention is not limited thereto. The resilience portion 573 may be structured so that the contact portion 575 is in contact with the contact piece portion 551 when the operation portion 577 is not operated and that the contact portion 575 is moved away from the contact piece portion 551 when the operation portion 577 is operated. At any rate, the detecting contact 525 can switch the state to select one of a connected state that the contact piece portion 551 and the body portion 553 are electrically connected to each other and an unconnected state that the contact piece portion 551 and the body portion 553 are electrically separated from each other.

As understood from FIGS. 16 to 18, the second housing 60 is provided with two second accommodation portions 601 and two second receiving portions 603. The second accommodation portions 601 correspond to the contact rows of the second contacts 52, respectively. The second receiving portions 603 correspond to the second accommodation portions 601, respectively. Each of the second receiving portions 603 is located rearward of the second accommodation portion 601 corresponding thereto in the front-rear direction. As understood from FIGS. 17 and 18, the second accommodation portion 601 and the second receiving portion 603 which correspond to each other communicate with each other. In the second accommodation portions 601, the contact portions 535 of the second contacts 52 are accommodated at least in part. In detail, the second contact 52 is fixed to the second housing 60 so that the second contact points 537 are in the second accommodation portions 601.

As shown in FIGS. 16 to 18, the second housing 60 has two second end walls 62. The second end walls 62 correspond to the second accommodation portions 601, respectively. Each of the second end walls 62 is located upward of the second accommodation portion 601 corresponding thereto. In detail, each of the second end walls 62 consists of a plurality of end wall pieces 621 which correspond to the second contacts 52, respectively. The end wall pieces 621 forming each of the second end walls 62 are arranged to be spaced from each other in the lateral direction. The second end walls 62 are not above the second receiving portions 603. Each of the second receiving portions 603 is located, in the front-rear direction, rearward of the second accommodation portion 601 corresponding thereto and the second end wall 62 located above the second accommodation portion 601. As shown in FIG. 16, when viewed from above along the up-down direction, each of the second contacts 52 is hidden by either one of the second end walls 62. However, the present invention is not limited thereto. The second end walls 62 should hide the second contacts 52 at least in part.

Figure 27:
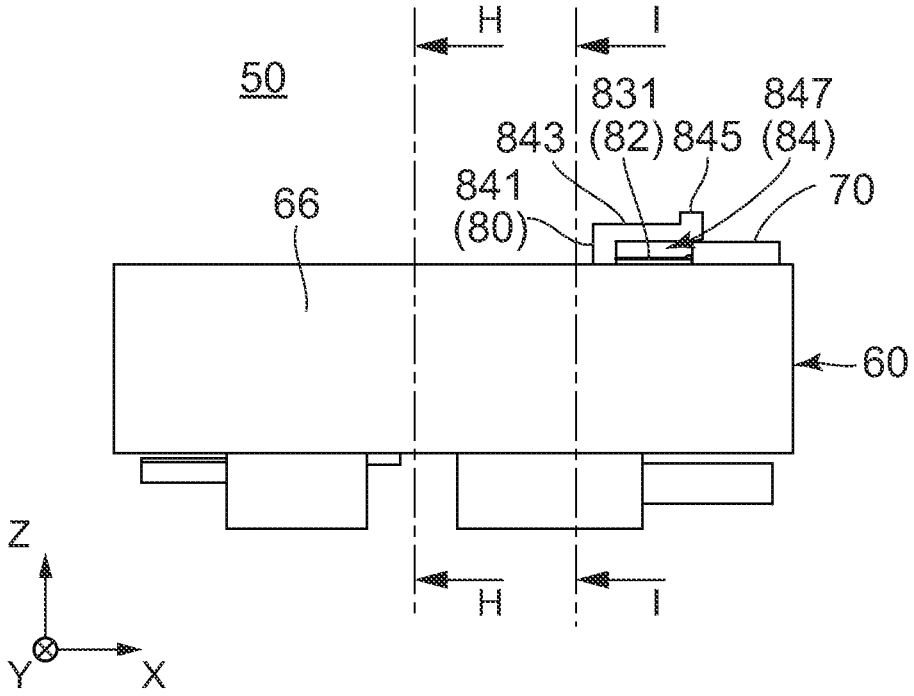
FIG. 27 is a side view showing the second connector of FIG. 26.
Figure 28:
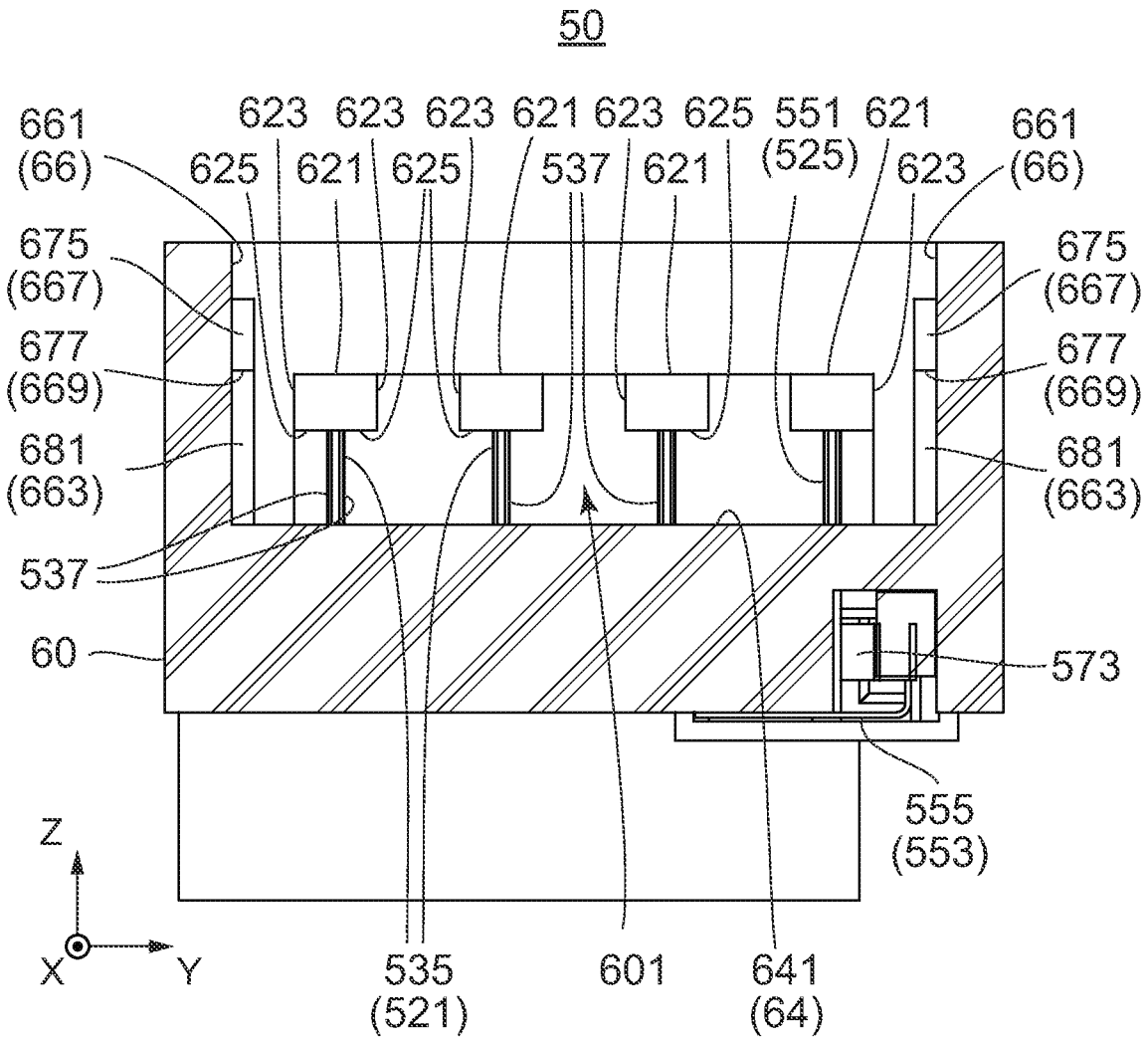
FIG. 28 is a cross-sectional view showing the second connector of FIG. 27, taken along line H-H.

As shown in FIGS. 17 and 18, each of the end wall pieces 621 protrudes rearward of the second contact 52 corresponding thereto in the front-rear direction. In addition, as understood from FIGS. 27 to 29, each of the end wall pieces 621 protrudes outward of the second contact 52 corresponding thereto in the lateral direction. Thus, each of the end wall pieces 621 has a protruding portion 623 which protrudes rearward of the second contact 52 corresponding to the end wall piece 621 in the front-rear direction and protrudes outward of the second contact 52 corresponding to the end wall piece 621 in the lateral direction. As understood from FIGS. 17, 28 and 29, the protruding portion 623 is provided with an extension portion 625 extending downward. The extension portion 625 surrounds an upper end portion of the second contact 52 at least in part.

Figure 19:
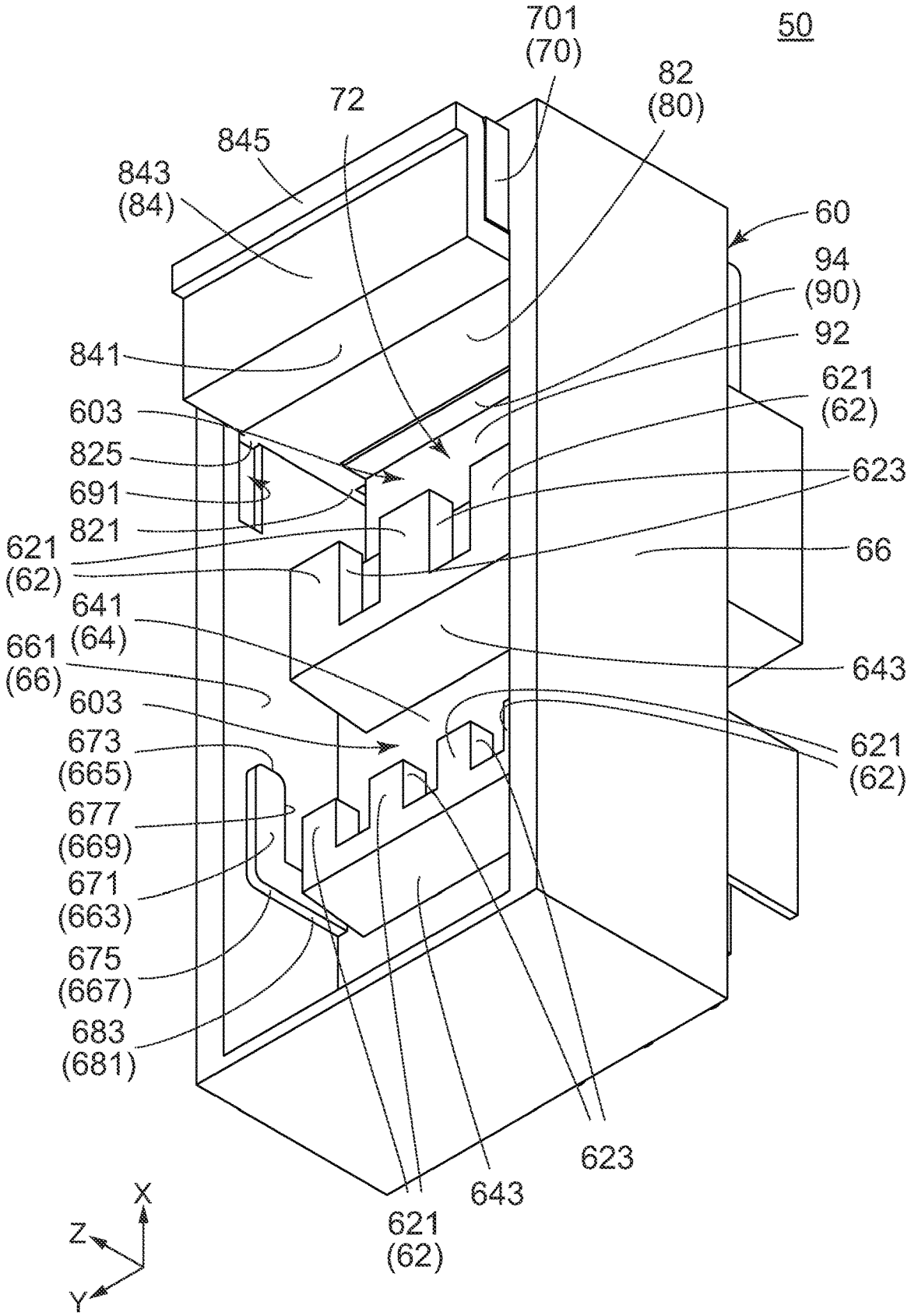
FIG. 19 is a front, perspective view showing the second connector of FIG. 16.
Figure 20:
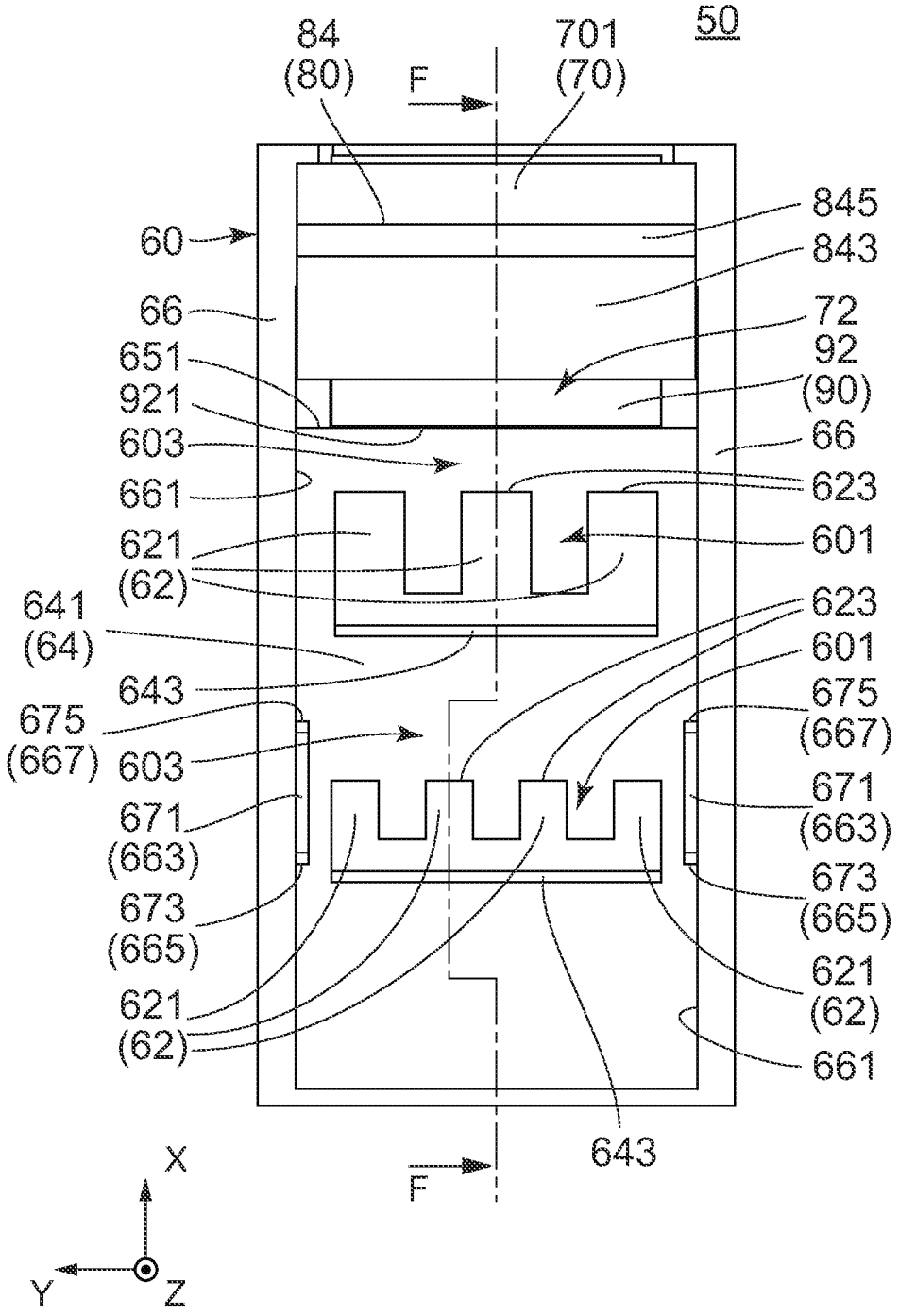
FIG. 20 is another plane view showing the second connector of FIG. 16. The operation member is positioned between the first position and the second position.

As shown in FIGS. 17 to 19, the second housing 60 is provided with a bottom wall 64 and two coupling walls 643. The coupling walls 643 correspond to the second accommodation portions 601, respectively. The coupling walls 643 enhance strength of the second housing 60. Each of the coupling walls 643 is located forward of the second accommodation portion 601 corresponding thereto. Each of the coupling walls 643 couples the bottom wall 64 with the second end wall 62 located above the second accommodation portion 601 corresponding thereto. As understood from FIG. 17, the second contacts 52 protrude upward from an upper surface 641 of the bottom wall 64 in part. As understood from FIG. 19, the coupling wall 643 hides protruding parts of the second contacts 52 located in the second accommodation portion 601 corresponding thereto when viewed from the front along the front-rear direction. Each of the coupling walls 643 may be divided into plural parts which correspond to the second contacts 52, respectively, located in the second accommodation portion 601 corresponding thereto.

As shown in FIGS. 16 to 19, the second housing 60 is provided with a pair of second sidewalls 66 extending in the front-rear direction. In the present embodiment, the second sidewalls 66 are arranged both ends of the second housing 60 in the lateral direction. Accordingly, the second accommodation portions 601 and the second receiving portions 603 are located between the second sidewalls 66. However, the present invention is not limited thereto. The second housing 60 may not have the second sidewalls 66.

Figure 42:
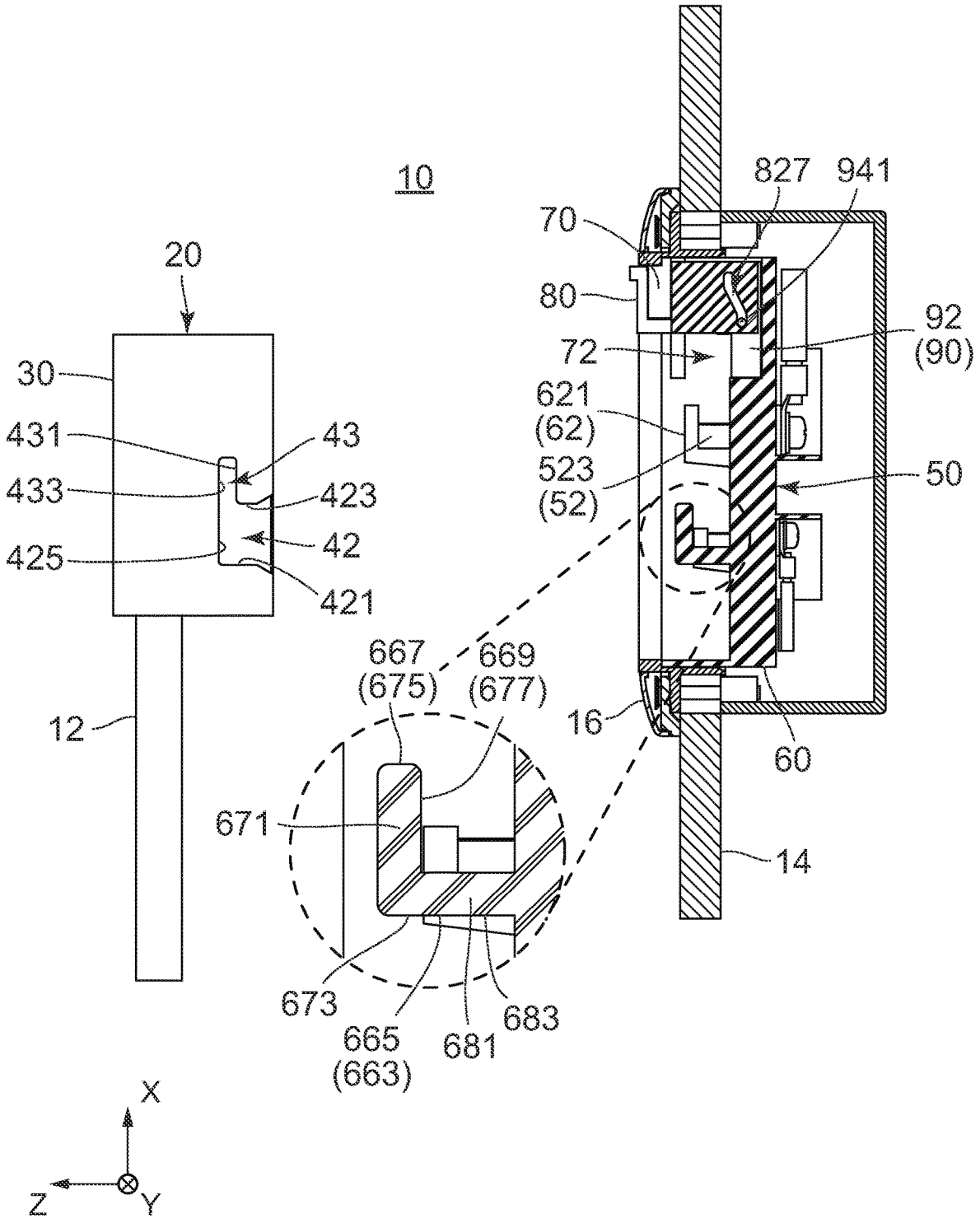
FIG. 42 is a cross-sectional view showing the connector assembly of FIG. 40, taken along line K-K. A guide projection portion and the vicinity thereof are illustrated in enlarged fashion.

As understood from FIGS. 16 and 19, each of the second sidewalls 66 has an inner surface 661 facing inward in the lateral direction. These inner surfaces 661 of the second sidewalls 66 face each other in the lateral direction. The inner surface 661 of each of the second sidewalls 66 is provided with a guide protruding portion (a protruding portion) 663. The guide protruding portion 663 corresponds to the first groove 42 and the second groove 43 of the first connector 20. The guide protruding portion 663 protrudes inward from the inner surface 661 in the lateral direction. As shown in FIG. 42, the guide protruding portion 663 has a front-end surface 665 and a rear-end surface 667 which are located at both sides thereof in the front-rear direction. The guide protruding portion 663 further has a lower end surface 669 facing downward in the up-down direction. The front-end surface 665 and the rear-end surface 667 of the guide protruding portion 663 serve as a first guiding portion, and the lower end surface 669 of the guide protruding portion 663 serves as a second guiding portion. The first guiding portion and the second guiding portion correspond to the first guided portion and the second guided portion of the first connector 20, respectively. Thus, the second housing 60 is provided with the first guiding portion and the second guiding portion. However, the present invention is not limited thereto. The first guiding portion and the second guiding portion may be provided on a wall portion other than the second sidewalls 66. For example, a wall extending in the front-rear direction may be provided at a position apart from the both sides in the lateral direction, and a protruding portion corresponding to the guide protruding portion 663 may be formed on a side surface of the wall portion. In that case, the second sidewalls 66 may be or may not be formed with the guide protruding portions 663. Alternatively, there may not be the second sidewalls 66.

Referring to FIG. 42, the guide protruding portion 663 includes a first protruding piece 671 and a second protruding piece 681 and has an L-shape when viewed along the lateral direction. The first protruding piece 671 has a shape long in the front-rear direction. The first protruding piece 671 has a front-end surface 673 and a rear-end surface 675 located at both ends thereof in the front-rear direction. Moreover, the first protruding piece 671 has a lower end surface 677 facing downward in the up-down direction. The second protruding piece 681 has a shape long in the up-down direction. Moreover, the second protruding piece 681 has a front-end surface 683 located at a front-end thereof in the front-rear direction. The first protruding piece 671 is located upward of the second protruding piece 681 in the up-down direction. The second protruding piece 681 is coupled with a front-end portion of the first protruding piece 671. The front-end surface 673 of the first protruding piece 671 and the front-end surface 683 of the second protruding piece 681 are coplanar with each other to form the front-end surface 665 of the guide protruding portion 663. The rear-end surface 675 of the first protruding piece 671 solely forms the rear-end surface 667 of the guide protruding portion 663. Accordingly, the first guiding portion is formed by the front-end surface 673 of the first protruding piece 671, the front-end surface 683 of the second protruding piece 681 and the rear-end surface 675 of the first protruding piece 671. Moreover, the second guiding portion is formed by the lower end surface 677 of the first protruding piece 671.

As understood form FIGS. 17 and 19, the inner surface 661 of each of the second sidewalls 66 is further formed with a guiding groove 691. The guiding groove 691 is recessed outward in the lateral direction and extends in the front-rear direction. The guiding grooves 691 function as a third guide portion which guides the operation member 80. Thus, the inner surfaces 661 of the second sidewalls 66 are provided with the third guide portion.

Figure 26:
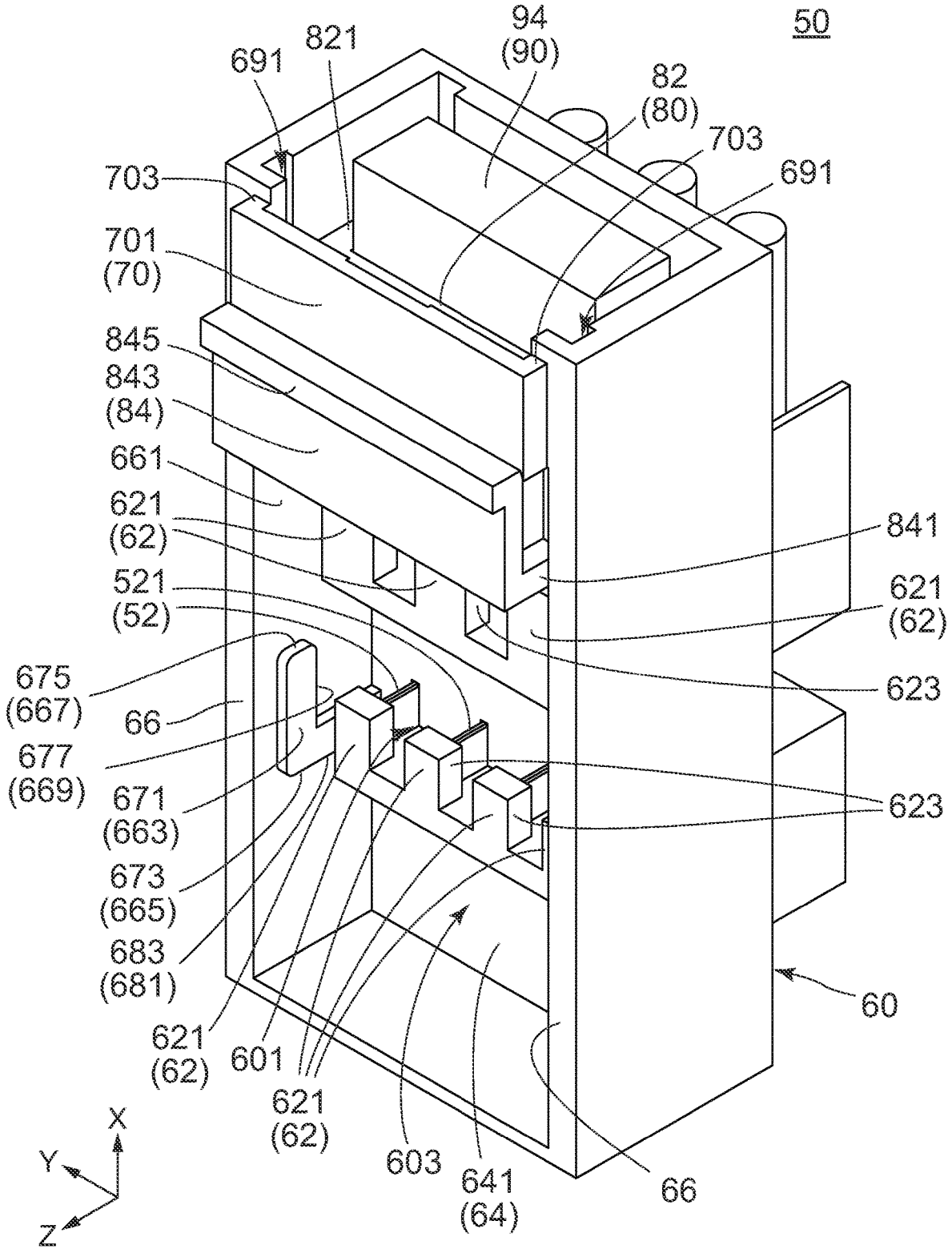
FIG. 26 is a rear, perspective view showing the second connector of FIG. 23.

As shown in FIG. 26, the second housing 60 further has a cover portion 70. The cover portion 70 has a plate portion 701 and a pair of leg portions 703. The cover portion 70 is located near a rear end of the second housing 60 and couples the second sidewalls 66 of the pair to each other.

Figure 31:
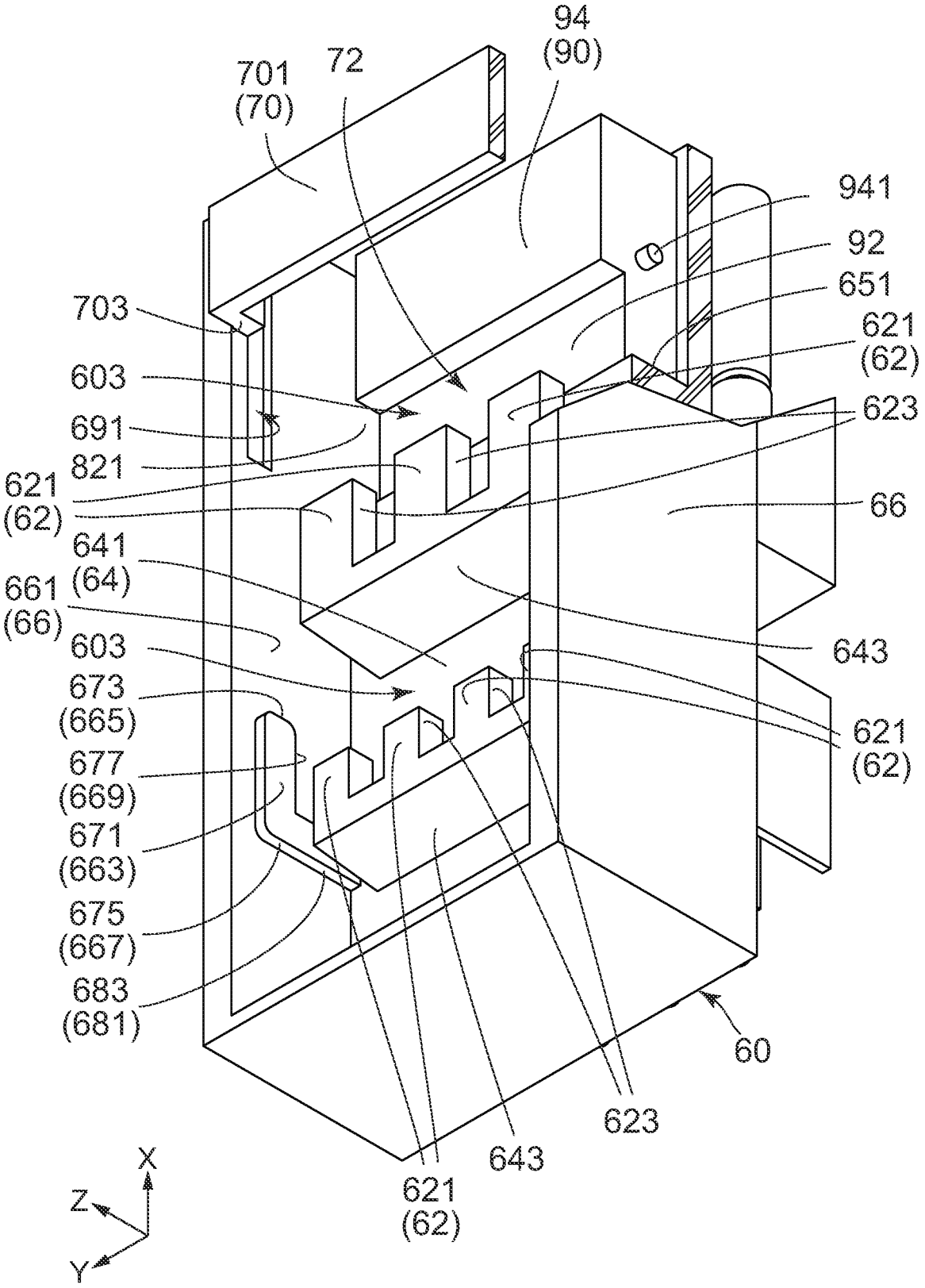
FIG. 31 is a perspective view showing the second housing and a movable member which are included in the second connector of FIG. 16. The second housing is cut away in part.
Figure 32:
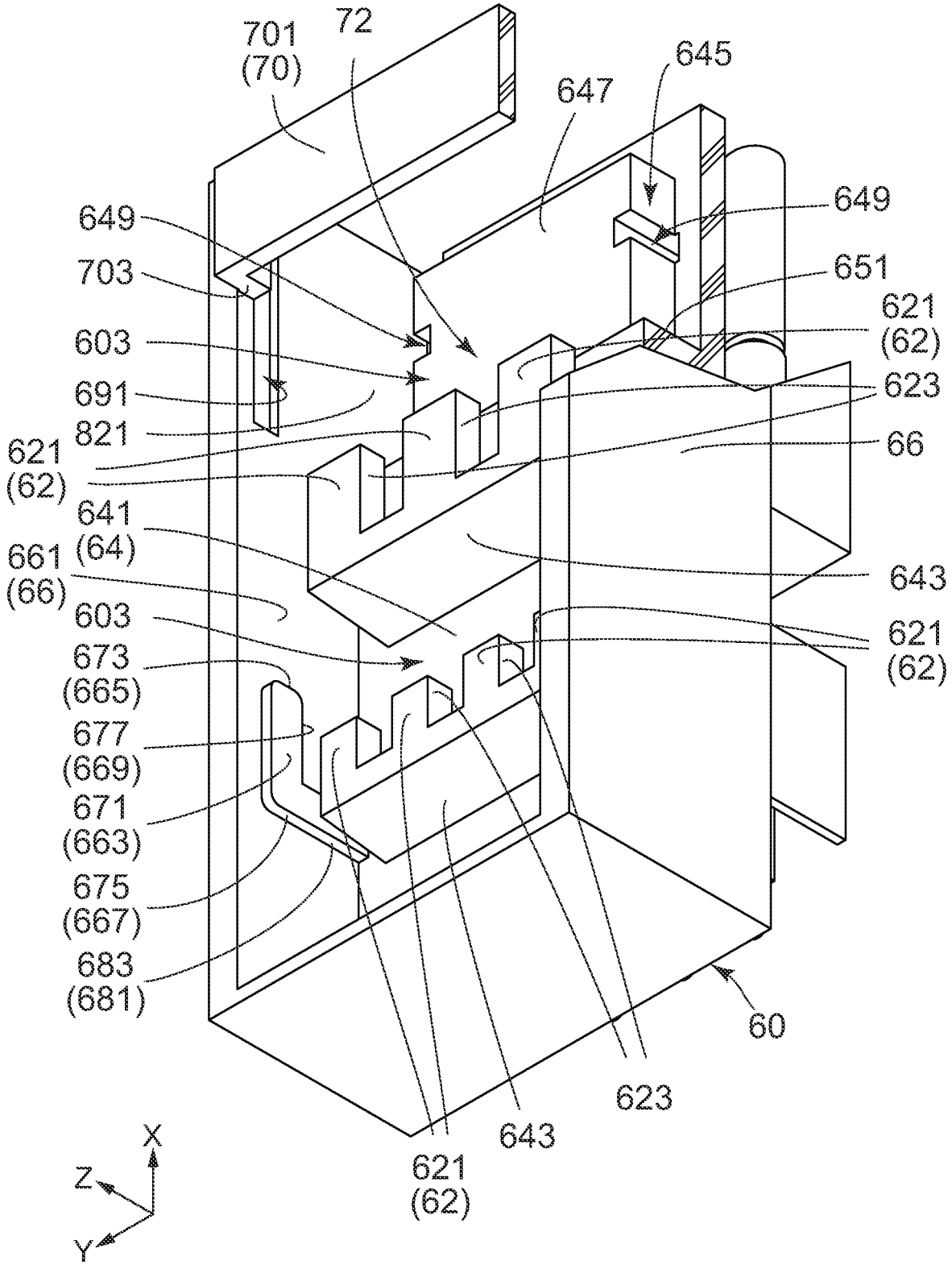
FIG. 32 is a perspective view showing the second housing of FIG. 31.

As understood from FIGS. 31 and 32, the bottom wall 64 of the second housing 60 is provided with a movable member accommodation portion 645 which accommodates the movable member 90 at least in part. The movable member accommodation portion 645 is located rearward of the second contacts 52 (see FIG. 18) in the front-rear direction and recessed downward of the upper surface 641 of the bottom wall 64. The second housing 60 is provided with a table portion 647 defining the movable member accommodation portion 645 in part and a regulating surface 651. As shown in FIG. 32, side surfaces of the table portion 647 are formed with a pair of grooves 649 recessed inward in the lateral direction and extending in the up-down direction. The regulating surface 651 faces rearward in the front-rear direction. A front-end of the table portion 647 is coupled with the regulating surface 651.

Figure 33:
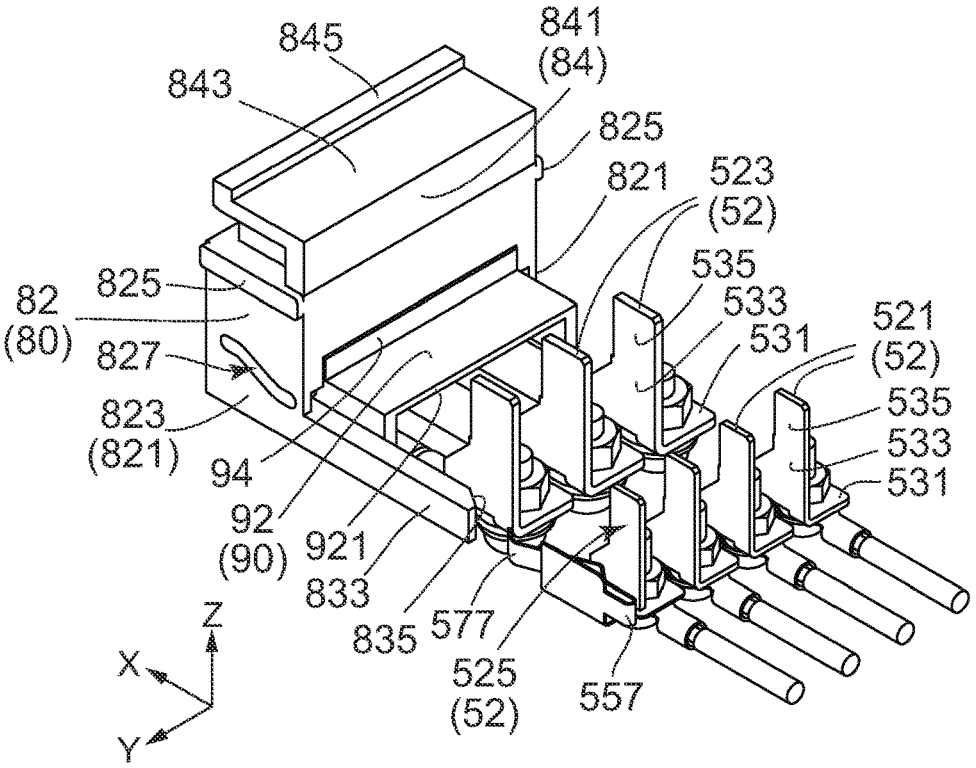
FIG. 33 is a perspective view showing second contacts, the operation member and the movable member which are included in the second connector of FIG. 16. The operation member is positioned at the first position.

Referring to FIG. 31, the movable member 90 has a front portion 92 and a rear portion 94. In the up-down direction, the rear portion 94 has a size larger than that of the front portion 92. The movable member 90 has an internal space (not show) and is opened downward. As shown in FIG. 33, the front portion 92 of the movable member 90 is further opened forward. In addition, the movable member 90 has a front-end surface 921. The front-end surface 921 functions as a regulating portion as described later. Thus, the movable member 90 is provided with the regulating portion.

As understood from FIG. 31, the movable member 90 is provided with a pair of cam protrusions 941 which protrude outward in the lateral direction. The cam protrusions 941 of the pair are apart from each other in the lateral direction and protrude in directions opposite to each other. The cam protrusions 941 function as a force receiving portion which receives a force from a force transmission portion described later. Thus, the movable member 90 is provided with the force receiving portion.

Figure 21:
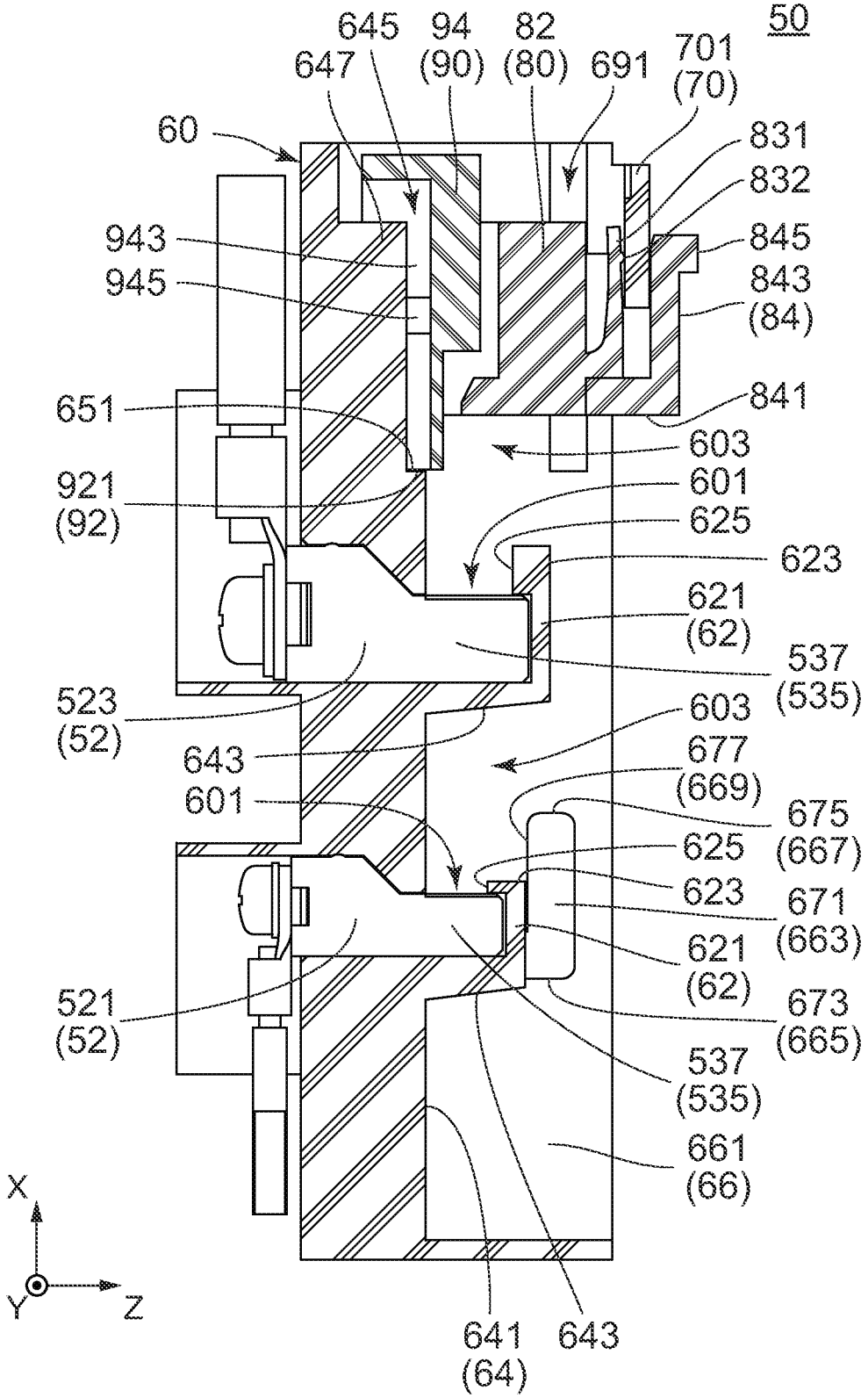
FIG. 21 is a cross-sectional view showing the second connector of FIG. 20, taken along line F-F.
Figure 22:
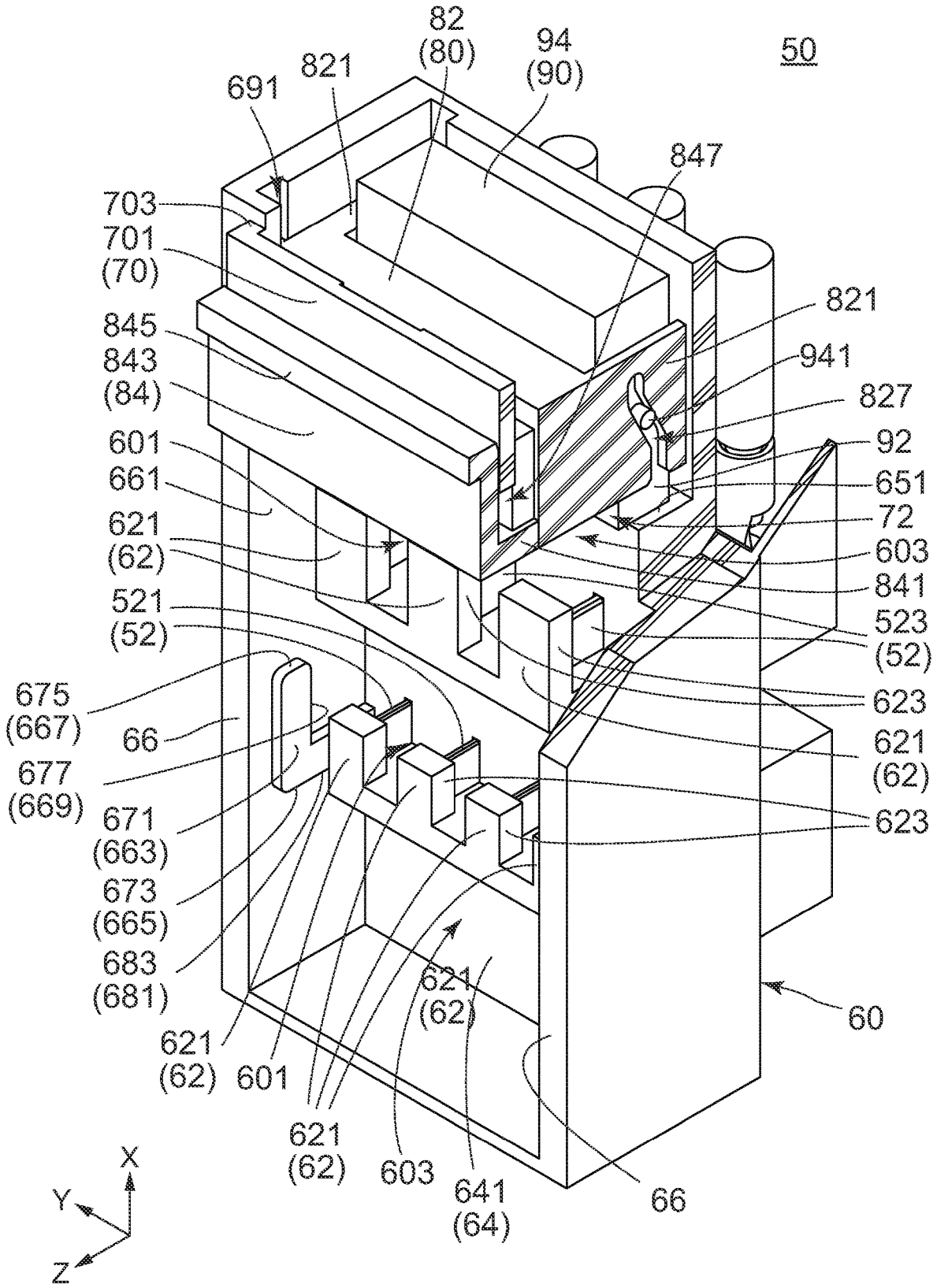
FIG. 22 is a rear, perspective view showing the second connector of FIG. 20. The second connector is cut away in part.
Figure 23:
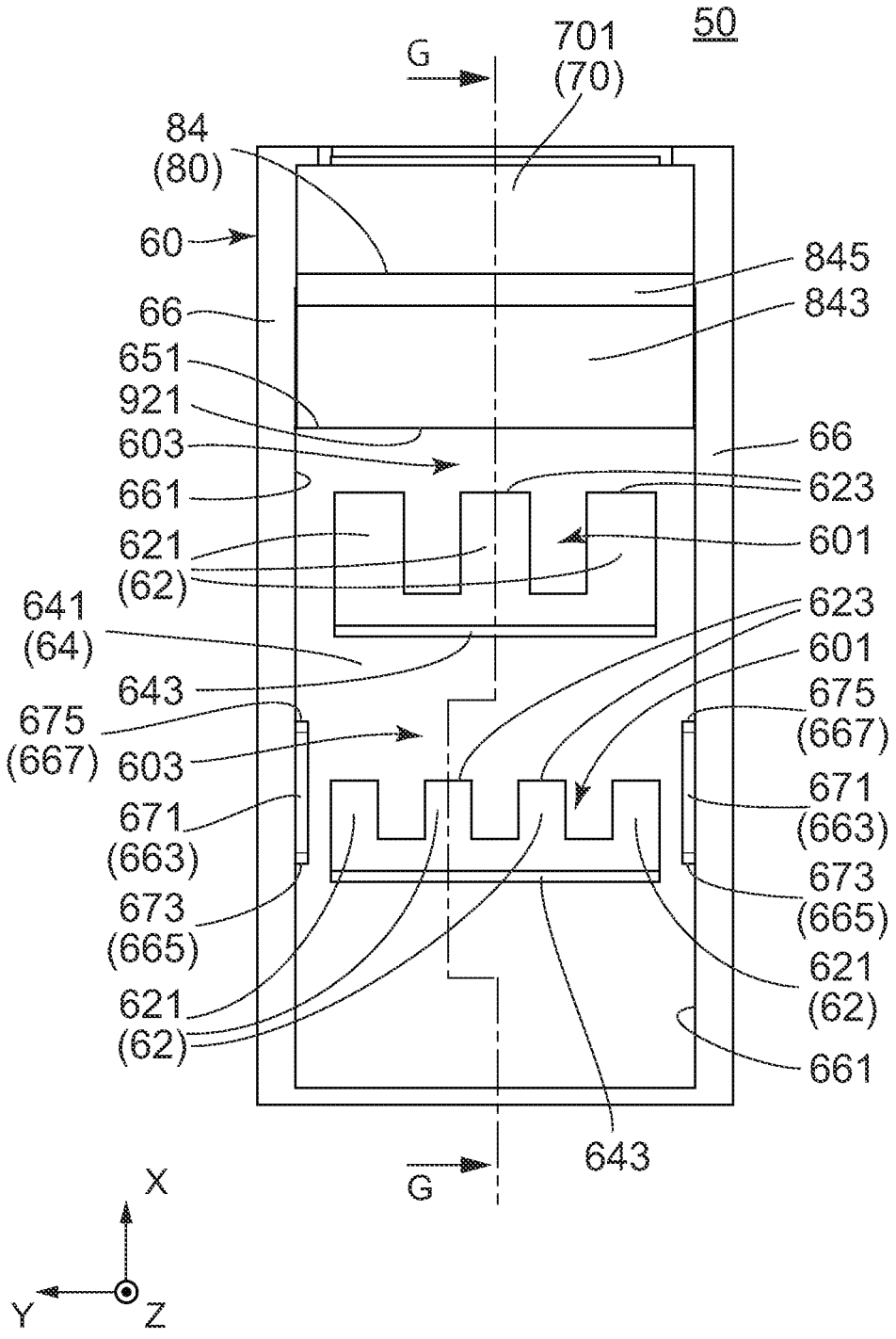
FIG. 23 is yet another plane view showing the second connector of FIG. 16. The operation member is positioned at the second position.
Figure 37:
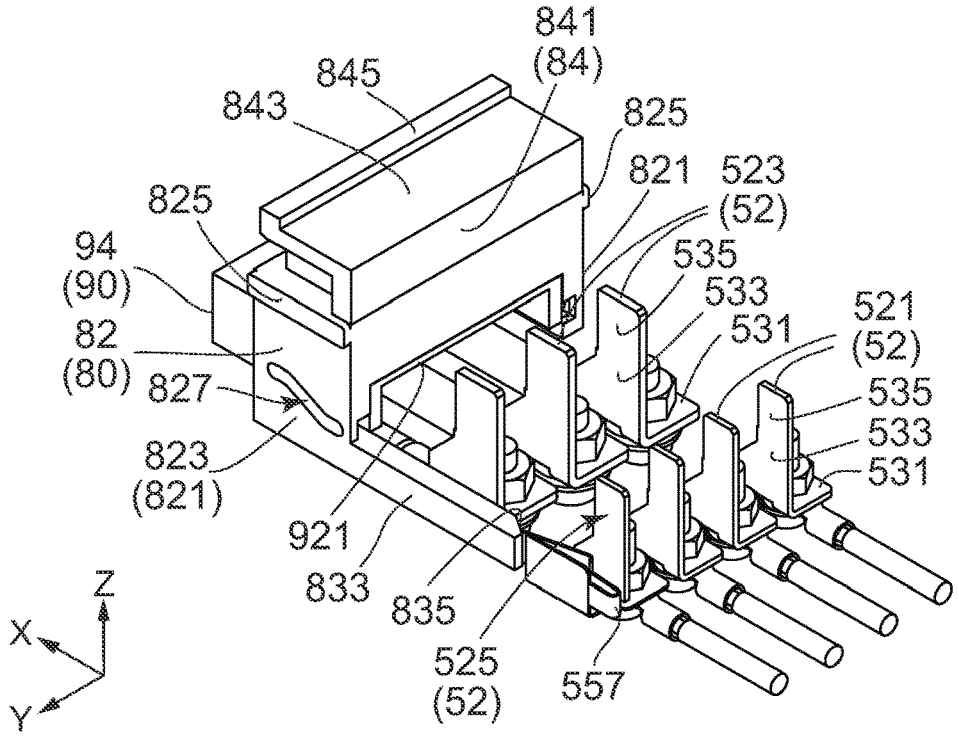
FIG. 37 is a perspective view showing the second contacts, the operation member and the movable member which are included in the second connector of FIG. 23.
Figure 38:
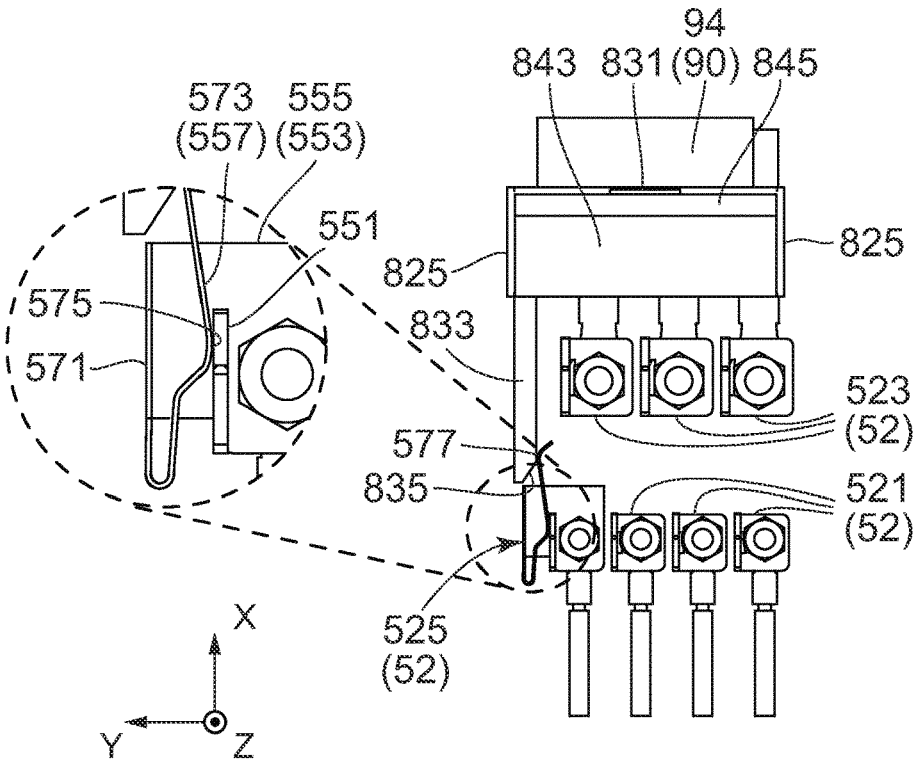
FIG. 38 is a plane view showing the second contacts, the operation member and the movable member of FIG. 37.

As understood from FIGS. 31 and 32, the movable member 90 is attached to the second housing 60 to accommodate the table portion 647 of the second housing 60 in the internal space (not show) thereof at least in part. In this state, when viewed along the up-down direction, the plate portion 701 of the cover portion 70 overlap with the movable member 90. Moreover, in a state that the movable member 90 is attached to the second housing 60, the movable member 90 is accommodated by the movable member accommodation portion 645 in part. Inner walls 943 (see FIG. 21) of the movable member 90 are formed with a pair of projection portions 945 (see FIG. 21) which protrude inward in the lateral direction. The projection portions 945 correspond to the grooves 649 of the table portion 647 of the second housing 60, respectively. In the state that the movable member 90 is attached to the second housing 60, the projection portions 945 of the movable member 90 are located in the grooves 649 of the table portion 647 in part. In the state that the movable member 90 is attached to the second housing 60, the movable member 90 is movable with respect to the second housing 60 in the up-down direction. In detail, the movable member 90 between an unlocked position (see FIG. 33) and a locked position (see FIG. 37) along the up-down direction. The unlocked position is located downward of the locked position in the up-down direction. The table portion 647 and the grooves 649 guide up-down movement of the movable member 90 with respect to the second housing 60 and regulate front-rear movement of the movable member 90. Thus, the front-rear movement of the movable member 90 is regulated by the second housing 60.

Figure 24:
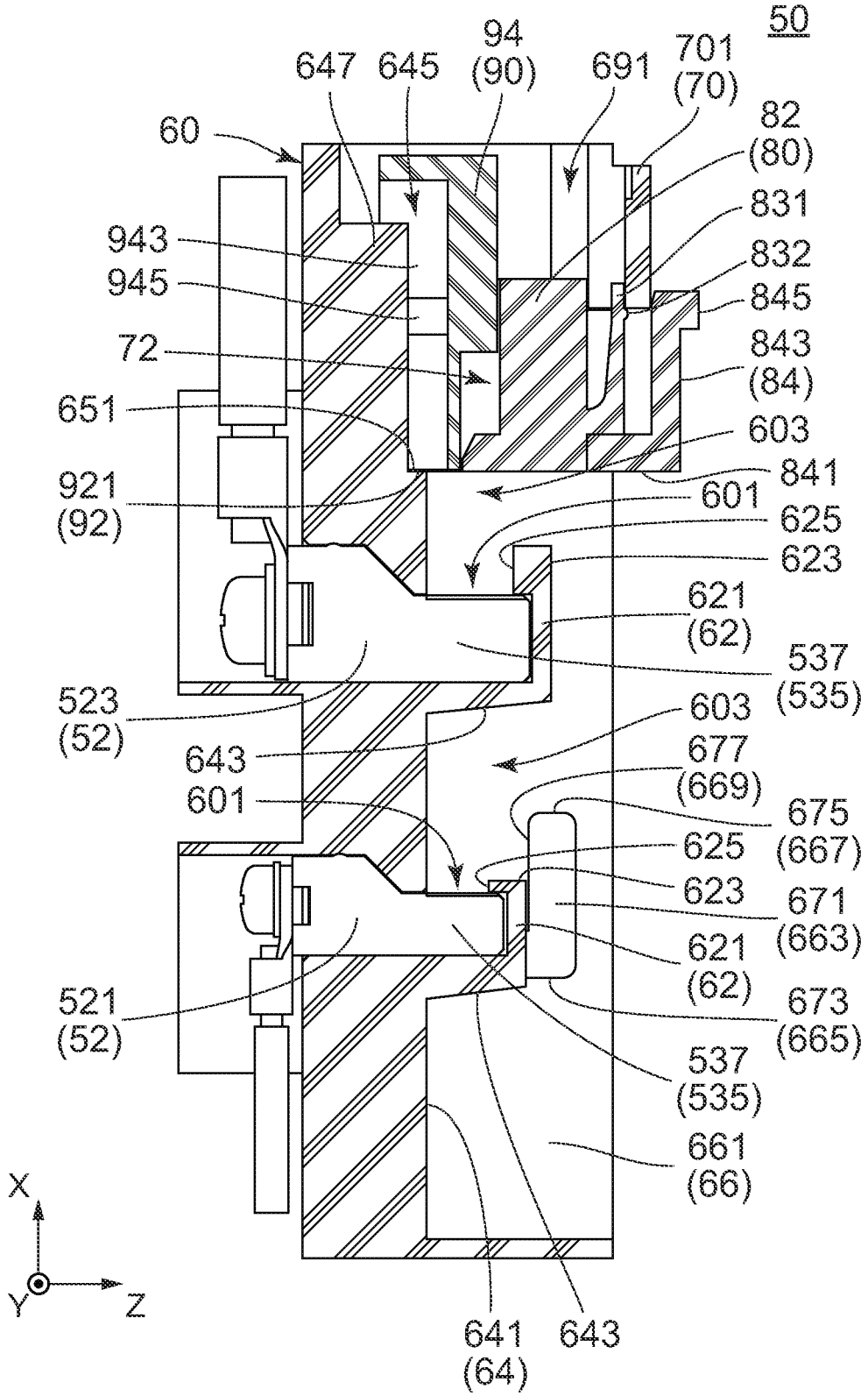
FIG. 24 is a cross-sectional view showing the second connector of FIG. 23, taken along line G-G.

As understood from FIGS. 17 and 18, the operation member 80 has a lower portion 82 and an upper portion 84. The lower portion 82 has a pair of sidewalls 821 and a maintaining piece 831. The sidewalls 821 are located at both sides of the lower portion 82 in the lateral direction. The maintaining piece 831 is located at an upper end portion of the lower portion 82. In a state that the operation member 80 is attached to the second housing 60, the sidewalls 821 are located at both sides of the movable member 90 in the lateral direction. In the state that the operation member 80 is attached to the second housing 60, the maintaining piece 831 is located downward of the plate portion 701 of the cover portion 70 in the up-down direction. The maintaining piece 831 has a projection portion 832 protruding upward in the up-down direction. Moreover, the maintaining piece 831 is resiliently deformable. Due to resilient deformation of the maintaining piece 831, the projection portion 832 is movable at least in the up-down direction. If the operation member 80 is attempted to be moved forward in the front-rear direction when the operation member 80 is positioned at the first position, the projection portion 832 is brought into abutment with the plate portion 701. Accordingly, the operation member 80 is maintained at the first position. Moreover, as understood from FIG. 24, if the operation member is attempted to be moved rearward in the front-rear direction when the operation member 80 is positioned at the second position, the projection portion 832 is brought into abutment with the plate portion 701. Accordingly, the operation member 80 is maintained at the second position. When a force enough to resiliently deform the maintaining piece 831 is given to the operation member 80, the maintaining piece 831 is resiliently deformed to allow the operation member 80 to be moved between the first position and the second position. Thus, the maintaining piece 831 has a function of maintaining the operation member 80 at the first position or the second position and a function of giving operation feeling of the operation member 80.

As shown in FIGS. 18 and 33, each of the sidewalls 821 is formed with a cam groove 827. The cam grooves 827 are apart from each other in the lateral direction. Moreover, each of the cam grooves 827 pierces the sidewall 821 in the lateral direction. However, the present invention is not limited thereto. The cam groove 827 may be a bottomed groove. As shown in FIG. 42, the cam groove 827 extends rearward from a front-end thereof and then extends rearward-diagonally upward, and further extends rearward. The cam grooves 827 are arranged to correspond to the cam protrusions 941 of the movable member 90, respectively. In the state that the operation member 80 is attached to the second housing 60, each of the cam grooves 827 receives the cam protrusion 941 corresponding thereto at least in part. The cam grooves 827 function as the force transmission portion which transmits a force of a predetermined direction to the force receiving portion (the cam protrusions 941) according to the movement of the operation member 80. In the present embodiment, the predetermined direction is the up-down direction. Thus, the operation member 80 is provided with the force transmission portion. In the present embodiment, each of the number of the cam protrusions 941 and the number of the cam grooves 827 is two. However, the present invention is not limited thereto. At least one cam protrusion 941 and at least one cam groove 827 are required.

As shown in FIGS. 33 to 38, the sidewalls 821 are provided with guide protrusions 825. In other words, the operation member 80 has a pair of side surfaces 823 facing outward in the lateral direction, and each of the side surfaces 823 is provided with the guide protrusion 825 as a third guide portion. The guide protrusions 825 protrude outward from the side surfaces 823 in the lateral direction and extend in the front-rear direction. The guide protrusion 825 corresponds to the guiding groove 691 (see FIG. 19) of the second housing 60. In the state that the operation member 80 is attached to the second housing 60, each of the guide protrusions 825 is received, at least in part, by the guiding groove 691 corresponding thereto. However, the present invention is not limited thereto. The inner surface 661 of the second sidewall 66 of the second housing 60 may be provided with a guide protrusion, and the sidewall 821 of the operation member 80 may be provided with a guiding groove corresponding to the guide protrusion.

As shown in FIGS. 33 to 38, the operation member 80 is provided with a connection state switching portion 833. The connection state switching portion 833 has a prismatic shape long in the front-rear direction and protrudes forward from a lower end portion of one of the sidewalls 821. The connection state switching portion 833 comes into contact with or is moved apart from the operation portion 577 of the detecting contact 525 according to the position of the operation member 80. In this way, the connection state switching portion 833 functions as a part of the connection state switching mechanism. Thus, the connection state switching portion 833 forms the connection state switching mechanism together with the resilience piece portion 557 of the detecting contact 525. In other words, the second connector 50 is provided with the connection state switching mechanism having the connection state switching portion 833 and the resilience piece portion 557.

Figure 25:
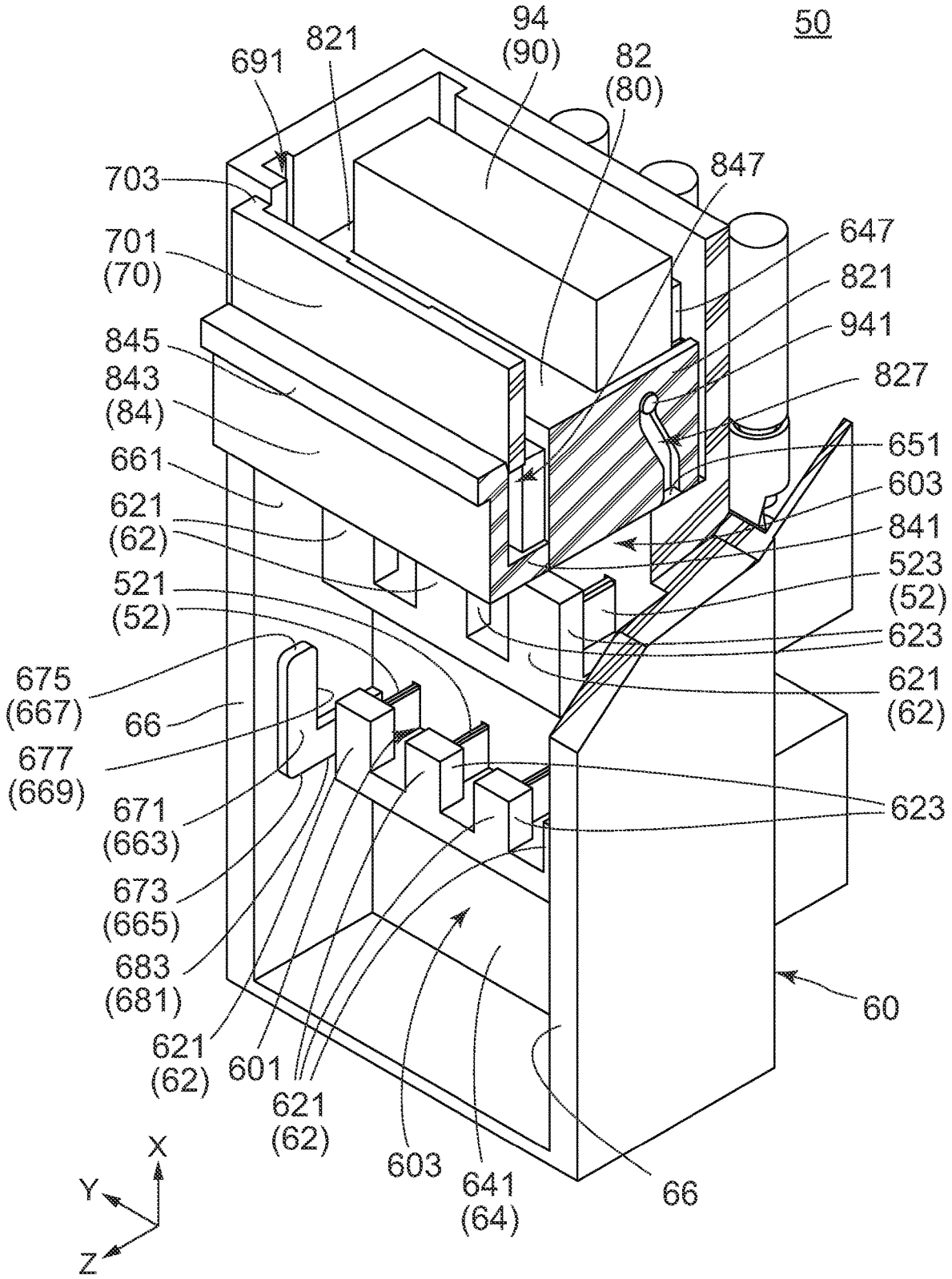
FIG. 25 is a rear, perspective view showing the second connector of FIG. 23. The second connector is cut away in part.

As shown in FIG. 19, the upper portion 84 of the operation member 80 has a front wall 841, an upper wall 843 and an operation ridge 845. The front wall 841 extends upward from a front upper end portion of the lower portion 82 of the operation member 80. The upper wall 843 extends rearward from an upper end portion of the front wall 841. The operation ridge 845 protrudes upward form a rear end portion of the upper wall 843. As understood from FIGS. 18 and 25, between the upper portion 84 and the lower portion 82 of the operation member 80, a cover portion accommodation portion 847 is formed. In other words, the operation member 80 is provided with the cover portion accommodation portion 847. In the state that the operation member 80 is attached to the second housing 60, the front wall 841 is located forward of the cover portion 70. Moreover, the upper wall 843 is located upward of the cover portion 70 in the up-down direction.

As understood form FIGS. 16 to 26, the operation member 80 is attached to the second housing 60 to be movable in the front-rear direction. In the state that the operation member 80 is attached to the second housing 60, the guiding grooves 691 of the second housing 60 (the third guide portion) and the guide protrusions 825 of the operation member 80 (the third guide portion) guide the operation member 80 between the first position and the second position. In the present embodiment, the first position is located rearward of the second position in the front-rear direction. Thus, the operation member 80 is attached to the second housing 60 to be movable between the first position and the second position.

As shown in FIGS. 16 and 17, when the operation member 80 is positioned at the first position, there is an admitting portion 72 in front of the operation member 80. In other words, the second connector 50 is provided with the admitting portion 72 which allows the operation member 80 to be moved from the first position to the second position. In the present embodiment, the admitting portion 72 is a part of one of the second receiving portions 603. The admitting portion 72 overlaps with the movable member accommodation portion 645 (see FIG. 32). In other words, the movable member accommodation portion 645 overlaps with the admitting portion 72. Moreover, the movable member accommodation portion 645 is located downward of the admitting portion 72 in the up-down direction and communicates with the admitting portion 72.

Figure 40:
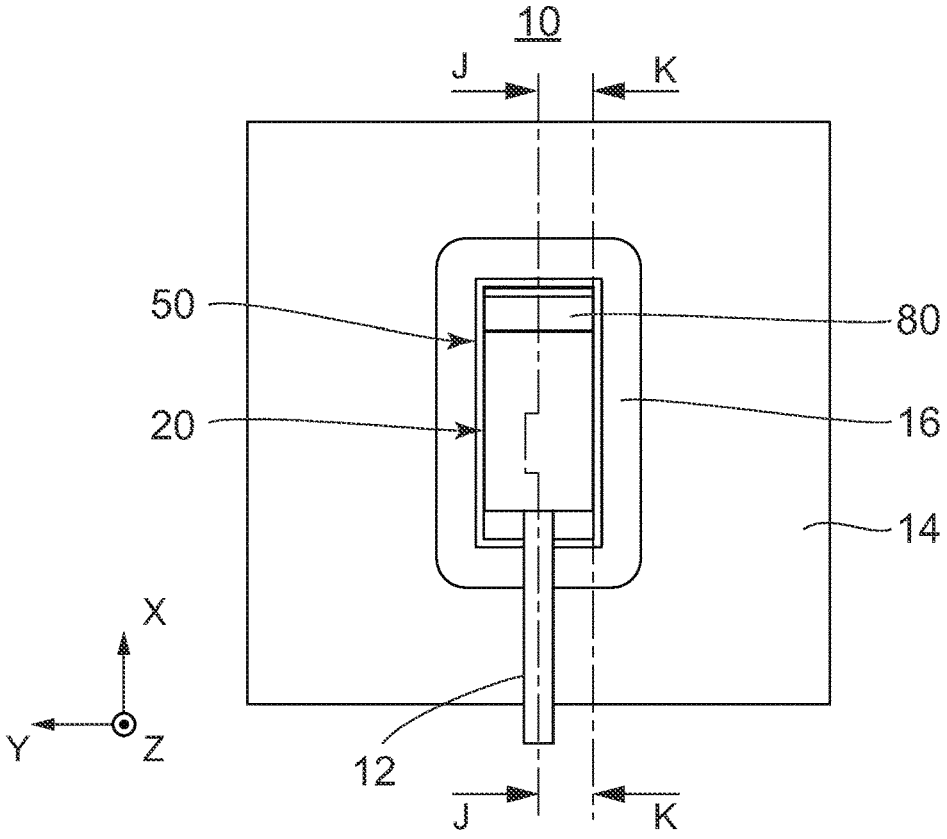
FIG. 40 is a plane view showing the connector assembly of FIG. 1.
Figure 41:
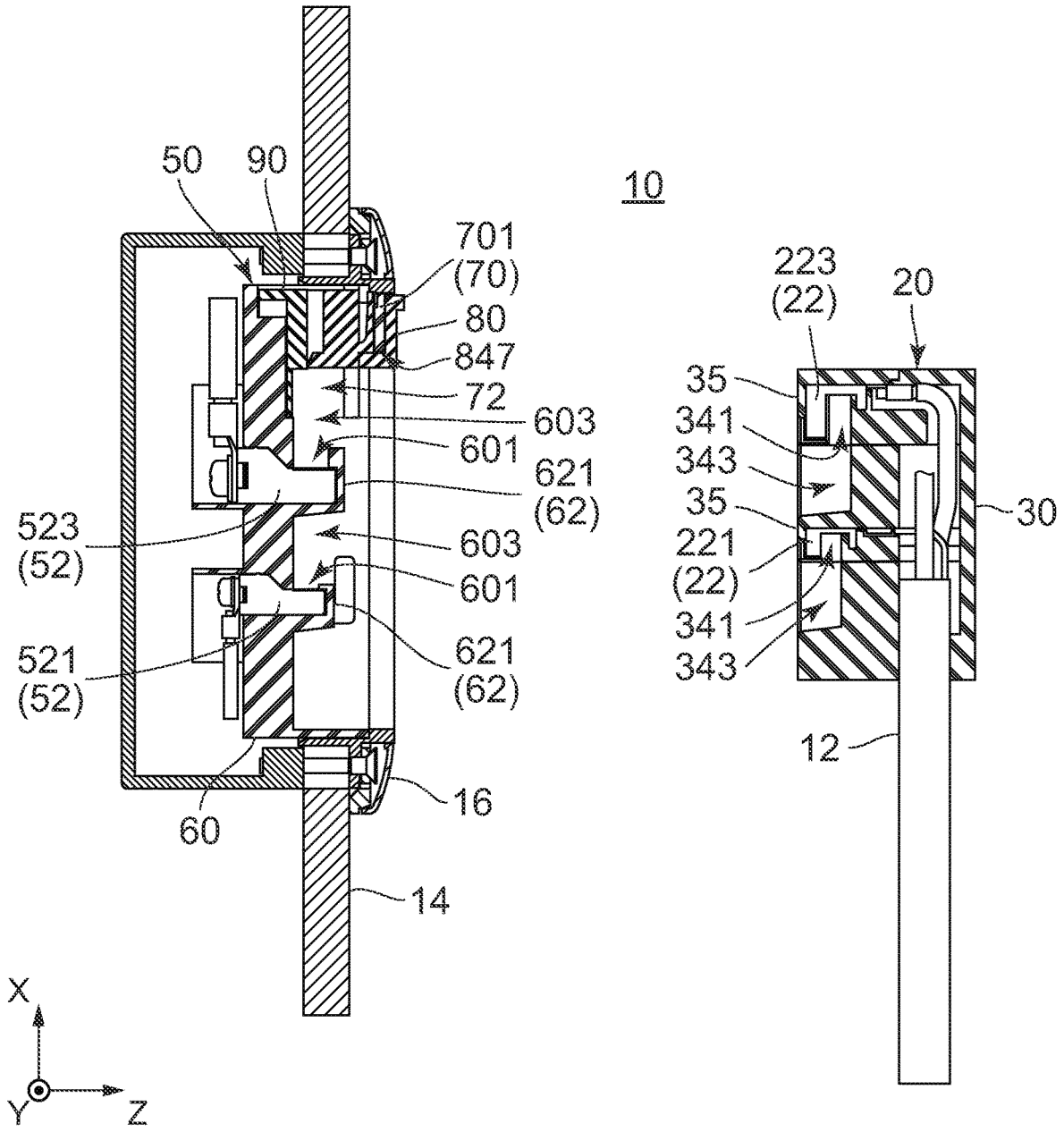
FIG. 41 is a cross-sectional view showing the connector assembly of FIG. 40, taken along line J-J.

As understood from FIGS. 40 and 42, when the operation member 80 is positioned at the first position, neither the operation member 80 nor the movable member 90 is located in the admitting portion 72 of the second housing 60. Accordingly, the admitting portion 72 can receive the first connector 20 in part, and the first connector 20 and the second connector 50 can shift from the separation state to the preliminary mated state. Additionally, at that time, the cover portion accommodation portion 847 accommodates the cover portion 70 in part as shown in FIG. 41. In the present embodiment, the cover portion accommodation portion 847 accommodates almost all the plate portion 701 of the cover portion 70. However, the cover portion accommodation portion 847 may accommodate all the cover portion 70.

Figure 43:
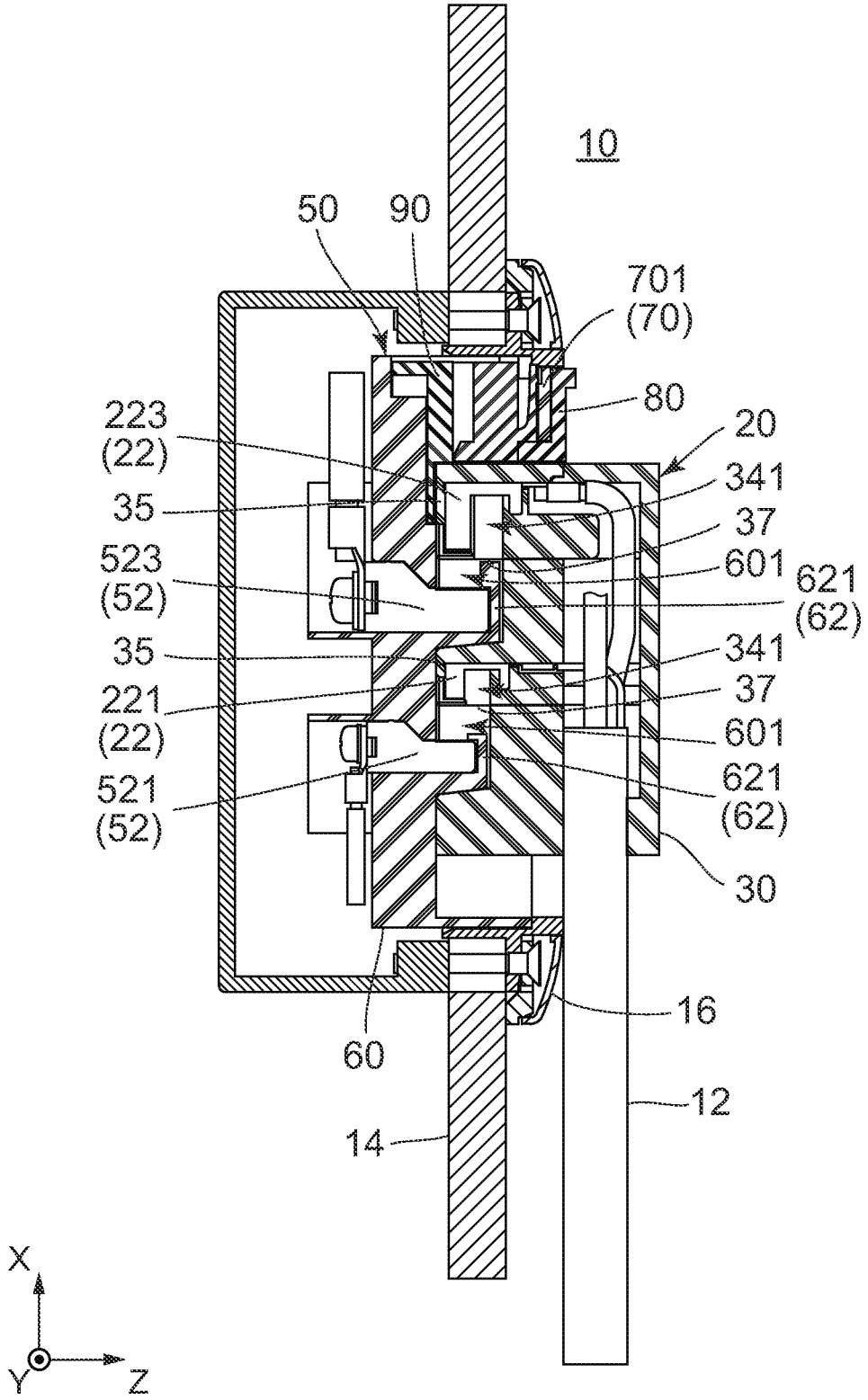
FIG. 43 is a cross-sectional view showing the connector assembly of FIG. 41. The first connector and the second connector are in the preliminary mated state. The operation member is positioned at the first position.

As understood from FIGS. 41 and 43, when they are shifted from the separation state to the preliminary mated state, the first receiving portions 343 receive the second end walls 62 while the second receiving portions 603 receive the first end walls 35. Moreover, as understood from FIGS. 42 and 44, when they are shifted from the separation state to the preliminary mated state, the guide protruding portion 663 is received by the first groove 42 at least in part. The front-end surface 665 of the guide protruding portion 663 and the front inner wall surface 421 of the first groove 42 regulate rearward movement of the first connector 20 with respect to the second connector 50. The rear-end surface 667 of the guide protruding portion 663 and the rear inner wall surface 423 of the first groove 42 regulate forward movement of the first connector 20 with respect to the second connector 50. In this way, the first guiding portion (the front-end surface 665 and the rear-end surface 667 of the guide protruding portion 663) and the first guided portion (the front inner wall surface 421 and the rear inner wall surface 423 of the first groove 42) regulate movement of the first connector 20 with respect to the second connector 50 in the front-rear direction between the separation state and the preliminary mated state.

As shown in FIG. 43, in the preliminary mated state, the first end walls 35 are received by the second receiving portions 603 while the second end walls 62 are received by the first receiving portions 343. At that time, the first connector 20 is located in the admitting portion 72 (see FIG. 42) in part. Accordingly, the operation member 80 cannot be moved from the first position to the second position.

As shown in FIG. 43, when the preliminary mated state, each of the second additional walls 37 is located rearward of the end wall piece 621 which forms the second end wall 62 in the front-rear direction. As understood from FIGS. 7 and 28 or FIGS. 8 and 29, at that time, the end wall pieces 621 and the second additional walls 37 are alternately arranged in the lateral direction. With this arrangement, forward movement of the first contacts 22 with respect to the second contacts 52 is allowed.

Figure 45:
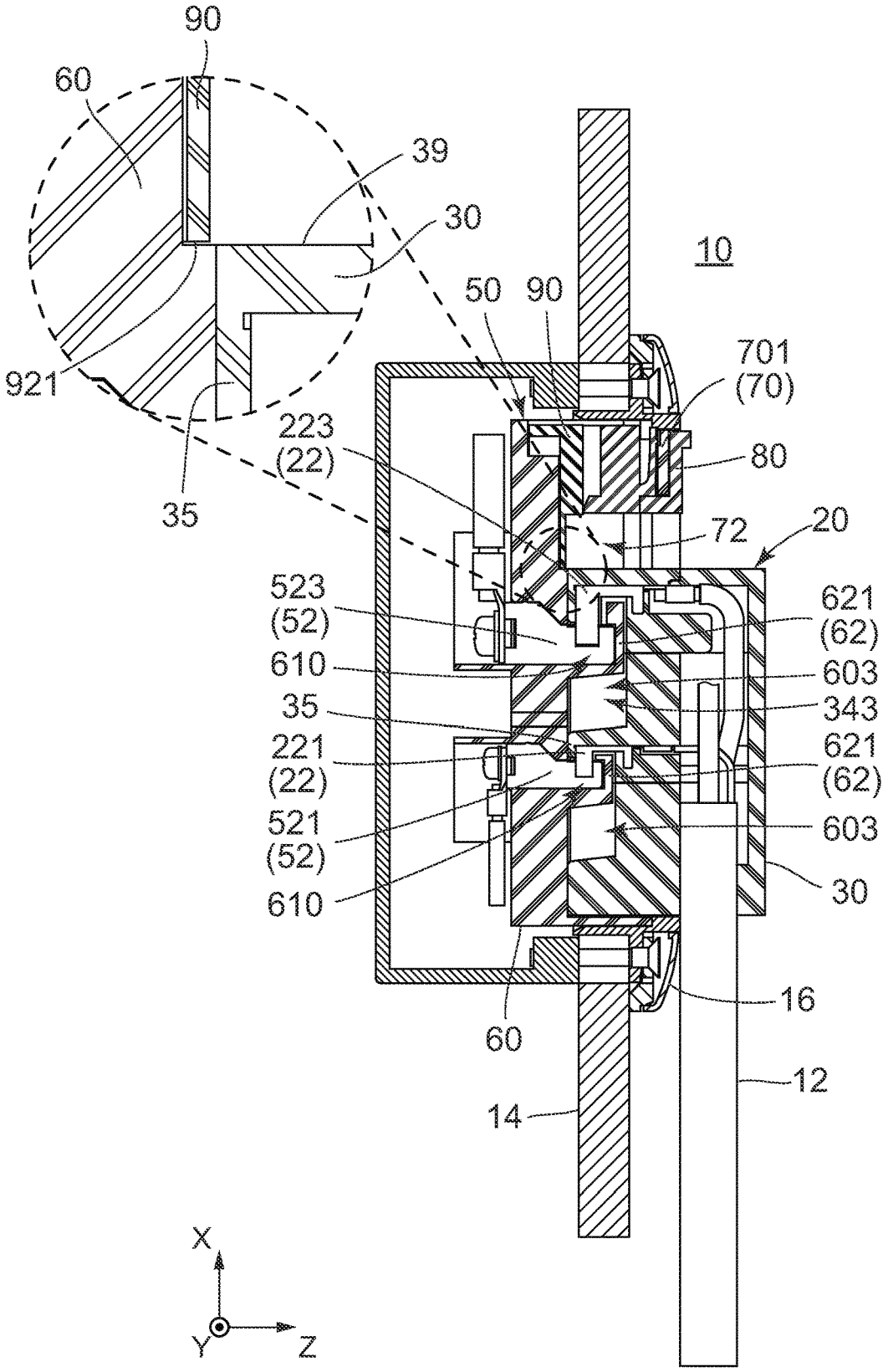
FIG. 45 is another cross-sectional view showing the connector assembly of FIG. 41. The first connector and the second connector are in the final mated state. The operation member is positioned at the first position. A front-end surface of the movable member and the vicinity thereof are illustrated in enlarged fashion.

As understood from FIGS. 43 and 45, when they are shifted from the preliminary mated state to the final mated state, the first end walls 35 are accommodated in the second accommodation portions 601 in part. Simultaneously, the second end walls 62 are accommodated in the first accommodation portions 341 in part. In the final mated state, the end wall pieces 621 forming the second end wall 62 and the second additional walls 37 are alternately arranged in the lateral direction. When viewed along the lateral direction, the end wall pieces 621 and the second additional walls 37 overlap with each other. However, the present invention is not limited thereto. The whole of the first end wall 35 may be accommodated in the second accommodation portion 601. Similarly, the whole of the second end wall 62 may be accommodated in the first accommodation portion 341. At any rate, in the final mated state, the first end walls 35 should be accommodated in the second accommodation portions 601 at least in part while the second end walls 62 should be accommodated in the first accommodation portions 341 at least in part.

As understood from FIG. 45, in the final mated state, each of the first contacts 22 and the second contact 52 corresponding thereto are connected to each other. At that time, the first contact points 237 of each of the first contacts 22 (see FIG. 7 or 8) and the second contact points 537 of the second contact 52 corresponding to the first contact 237 (see FIG. 28 or 29) are in contact with each other. As understood from FIGS. 43 and 45, in the final mated state, the first accommodation portion 341 and the second accommodation portion 601 overlap with each other to form an overlapping accommodation portion 610. The first contact points 237 and the second contact points 537 are in contact with each other in the overlapping accommodation portion 610.

Figure 44:
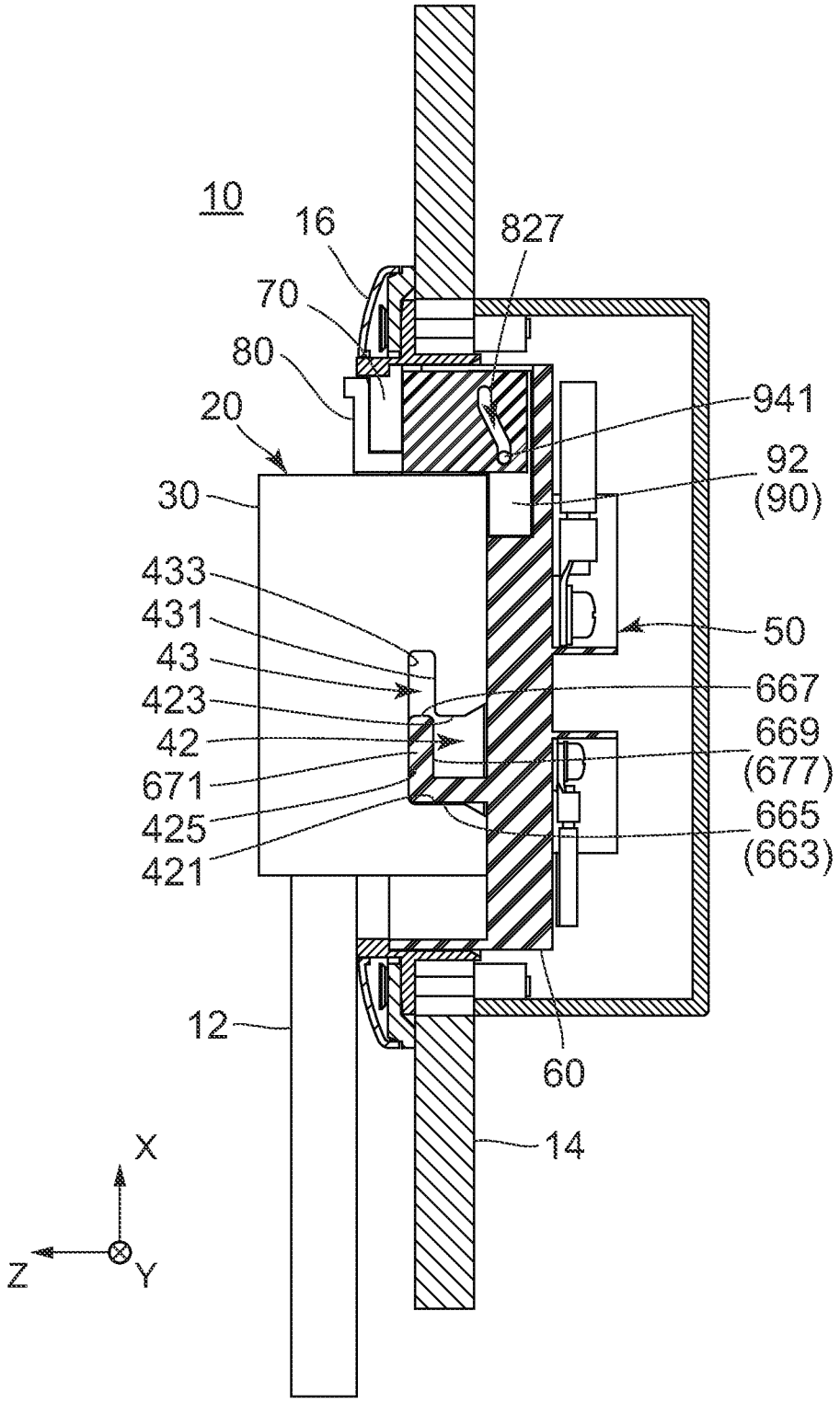
FIG. 44 is a cross-sectional view showing the connector assembly of FIG. 42. The first connector and the second connector are in the preliminary mated state. The operation member is positioned at the first position.
Figure 46:
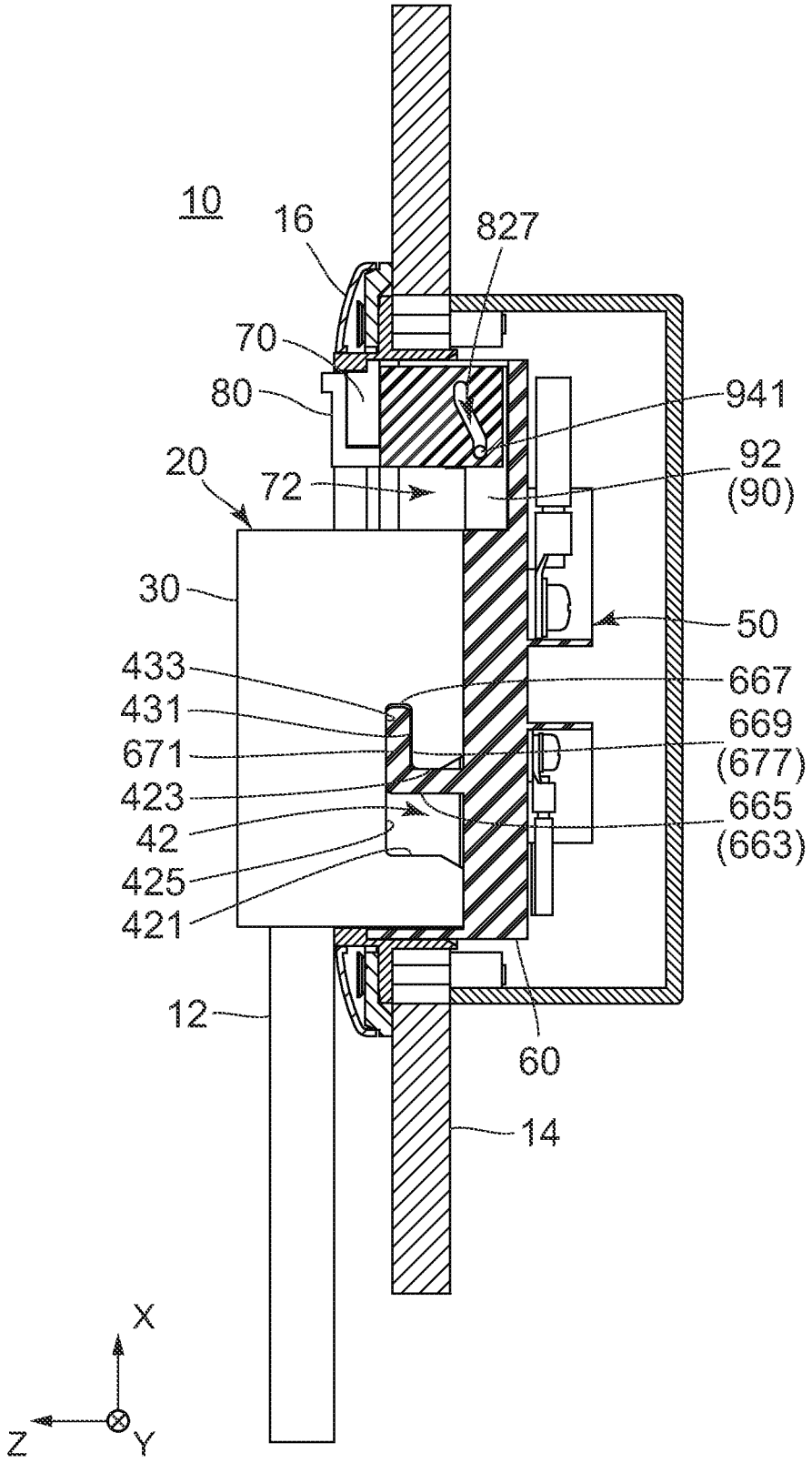
FIG. 46 is another cross-sectional view showing the connector assembly of FIG. 42. The first connector and the second connector are in the final mated state. The operation member is positioned at the first position.

As understood from FIGS. 44 and 46, when they are shifted the preliminary mated state to the final mated state, the first protruding piece 671 of the guide protruding portion 663 is received by the second groove 43 at least in part. The lower end surface 677 of the first protruding piece 671 and the lower inner wall surface 431 of the second groove 43 regulate upward movement of the first connector 20 with respect to the second connector 50. Accordingly, shifting of the first connector 20 and the second connector 50 to the separation state is regulated. In this way, the second guiding portion (the lower end surface 669 of the guide protruding portion 663) and the second guided portion (the lower inner wall surface 431 of the second groove 43) regulate the upward movement of the first connector 20 with respect to the second connector 50 in the up-down direction and regulate the shifting to the separation state between the preliminary mated state and the final mated state and in the final mated state.

As shown in FIGS. 45 and 46, in the final mated state, the first connector 20 is not located in the admitting portion 72. In other words, in the final mated state, the first connector 20 is located forward of the admitting portion 72. At that time, the operation member 80 can be moved from the first position to the second position.

Figure 48:
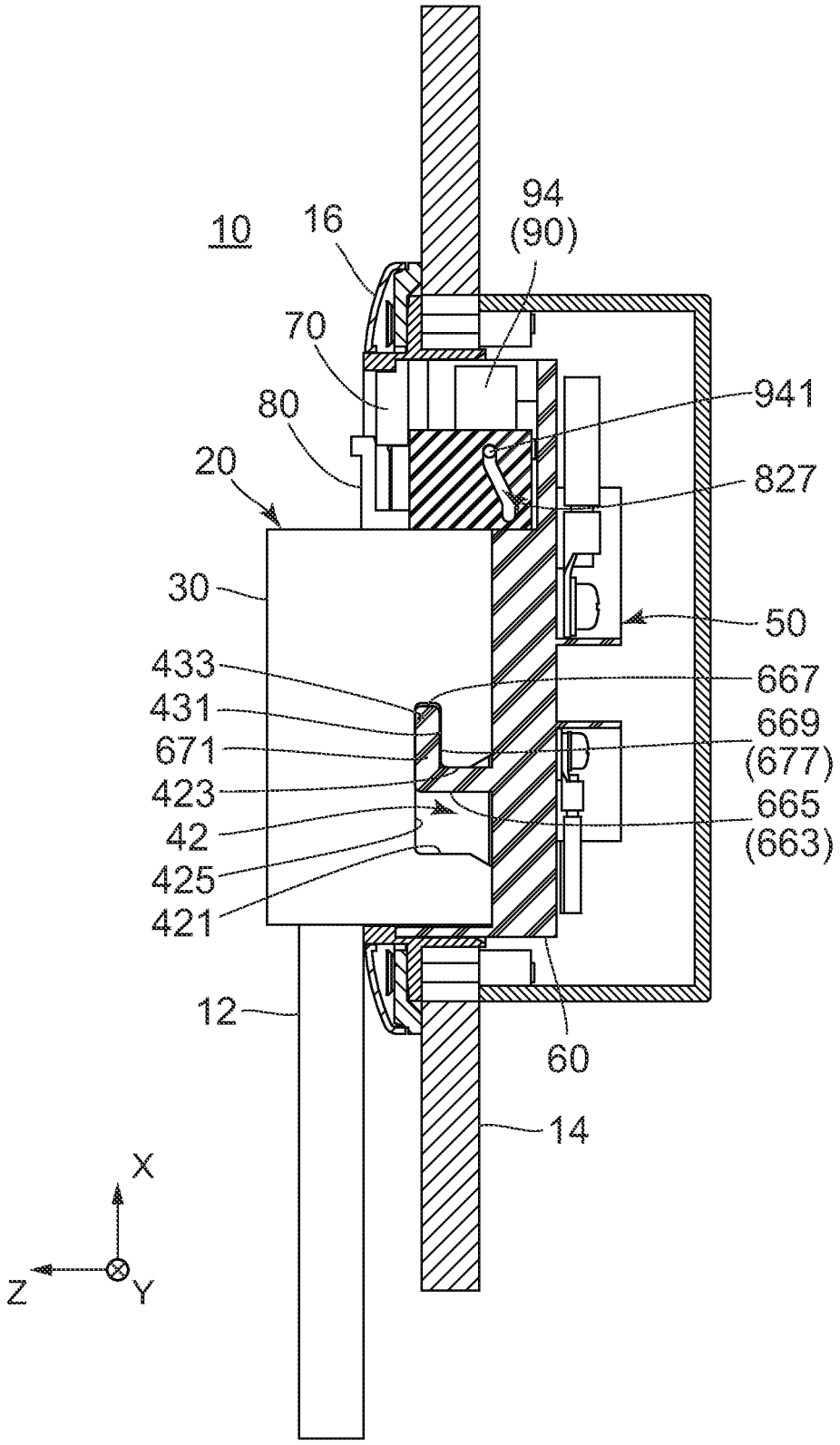
FIG. 48 is yet another cross-sectional view showing the connector assembly of FIG. 42. The first connector and the second connector are in the final mated state. The operation member is positioned at the second position.
Figure 49:
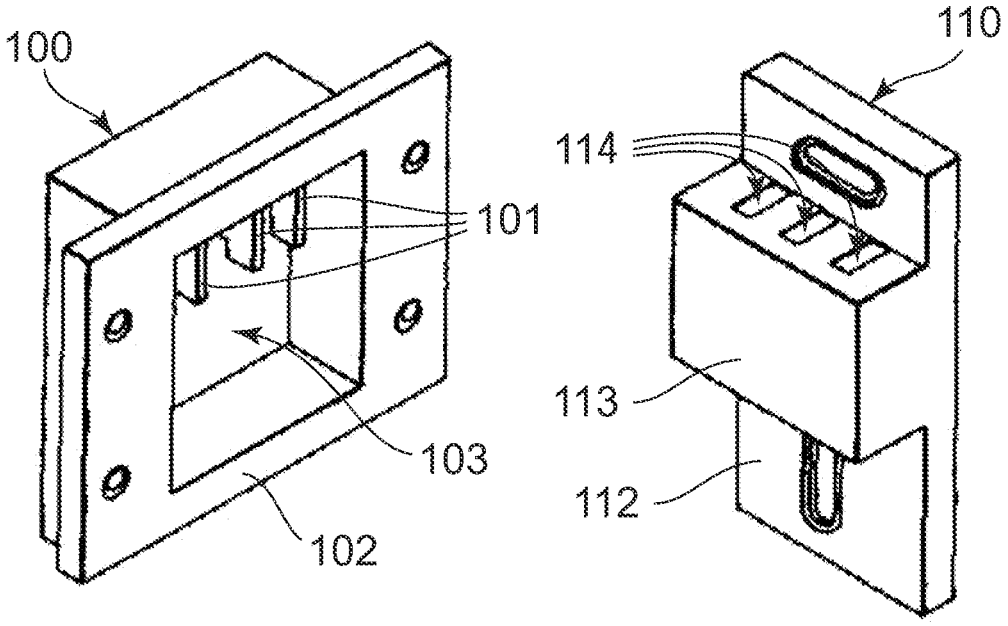
PRIOR ART FIG. 49
FIG. 49 is a diagram showing a connector and a socket which are included in a connector assembly disclosed in Patent Document 1.

As understood from FIGS. 46 and 48, upon moving the operation member 80 from the first position to the second position, upward force acts on the cam protrusions 941 from the cam grooves 827. Accordingly, the movable member 90 is moved upward and enters the admitting portion 72 in part. In other words, the movable member 90 is moved toward the locked position from the unlocked position according to the movement of the operation member 80. Thus, the operation member 80 and the movable member 90 work together with each other through the force transmission portion and the force receiving portion. In detail, when the operation member 80 is positioned at the first position, the movable member 90 is positioned at the unlocked position. When the operation member 80 is positioned at the second position, the movable member 90 is positioned at the locked position. Moreover, when the operation member 80 is positioned at the second position, the movable member 90 is in the admitting portion 72 in part. By using combination of the pairs of the cam grooves 827 and the cam protrusions 941, which are located apart from each other, smooth and statable movement of the movable member 90 can be realized.

Figure 47:
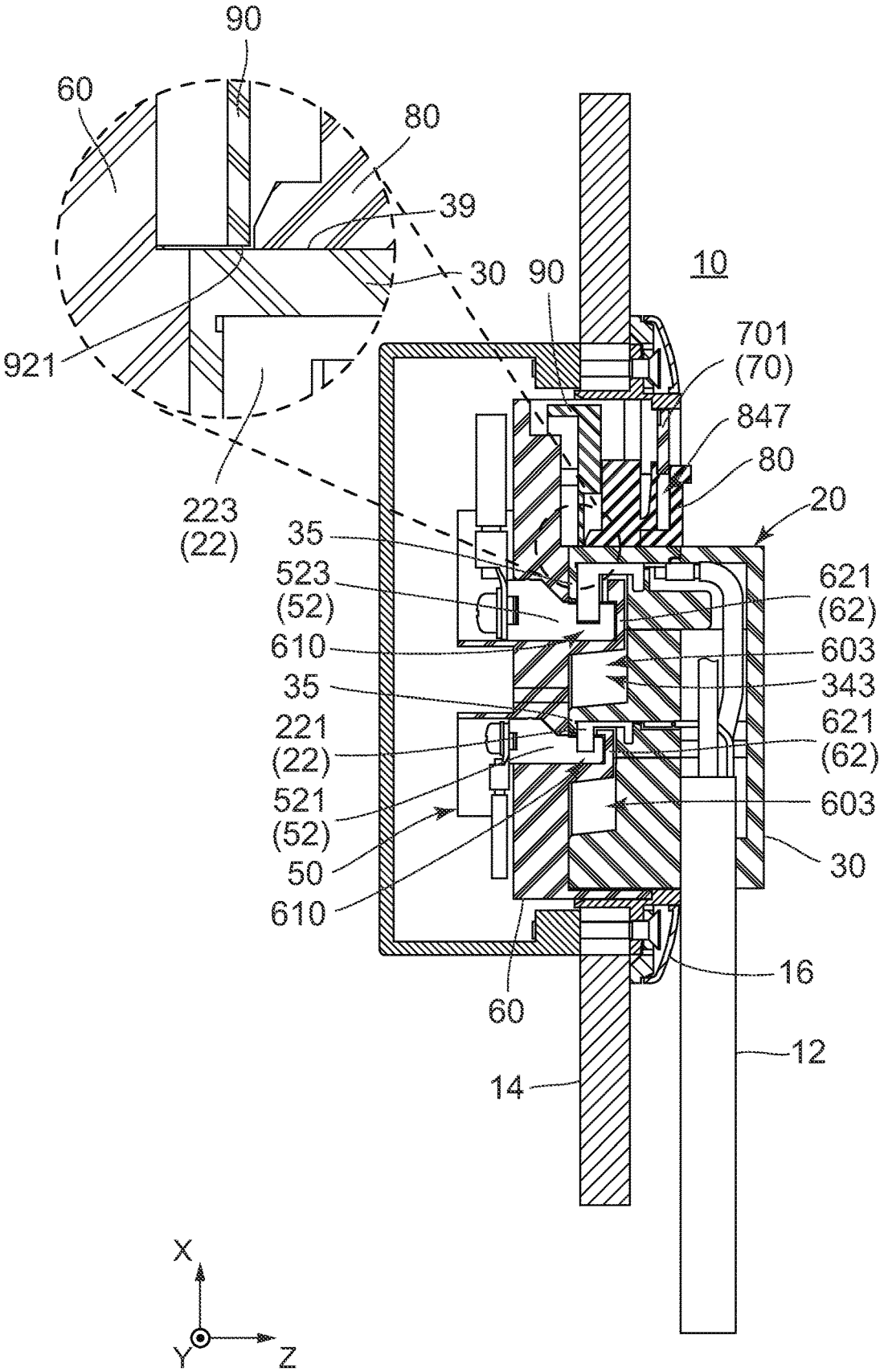
FIG. 47 is yet another cross-sectional view showing the connector assembly of FIG. 41. The first connector and the second connector are in the final mated state. The operation member is positioned at the second position. The front-end surface of the movable member and the vicinity thereof are illustrated in enlarged fashion.

As shown in FIG. 47, in the final mated state, when the movable member 90 is positioned at the locked position, the front-end surface 921 of the movable member 90 is positioned rearward of the rear-end surface 39 of the first housing 30. At that time, when viewed along the front-rear direction, the front-end surface 921 of the movable member 90 overlaps with the rear-end surface 39 of the first housing 30. In this state, when trying to move the first connector 20 rearward, the rear-end surface 39 of the first housing 30 is brought into abutment with the front-end surface 921 of the movable member 90. In this way, the front-end surface 921 of the movable member 90 functions as the regulating portion which regulates rearward movement of the first housing 30 with respect to the second housing 60. At that time, the rear-end surface 39 of the first housing 30 functions as the regulated portion. Thus, when the movable member 90 is positioned at the locked position, the regulating portion regulates the rearward movement of the first housing 30 with respect to the second housing 60 to regulate shifting from the final mated state to the preliminary mated state.

As understood from FIGS. 43, 45 and 47, if the first connector 20 is located even slightly in the admitting portion 72, upward movement of the movable member 90 is regulated by the first connector 20. Accordingly, if the first connector 20 is located even slightly in the admitting portion 72, the operation member 80 working together with the movable member 90 cannot be moved toward the second position from the first position. In other words, regulation made by the regulating portion cannot be performed until the first connector 20 and the second connector 50 shift to the final mated state after the first connector 20 goes outside the admitting portion 72 completely.

As understood from FIGS. 45 and 47, as the operation member 80 is moved from the first position to the second position, the plate portion 701 of the cover portion 70 comes out of the cover portion accommodation portion 847. When the operation member 80 is positioned at the second position, the cover portion 70 prevents foreign bodies from entering a space formed rearward of the operation member 80. Accordingly, direct operation of the movable member 90 can be prevented.

Figure 34:
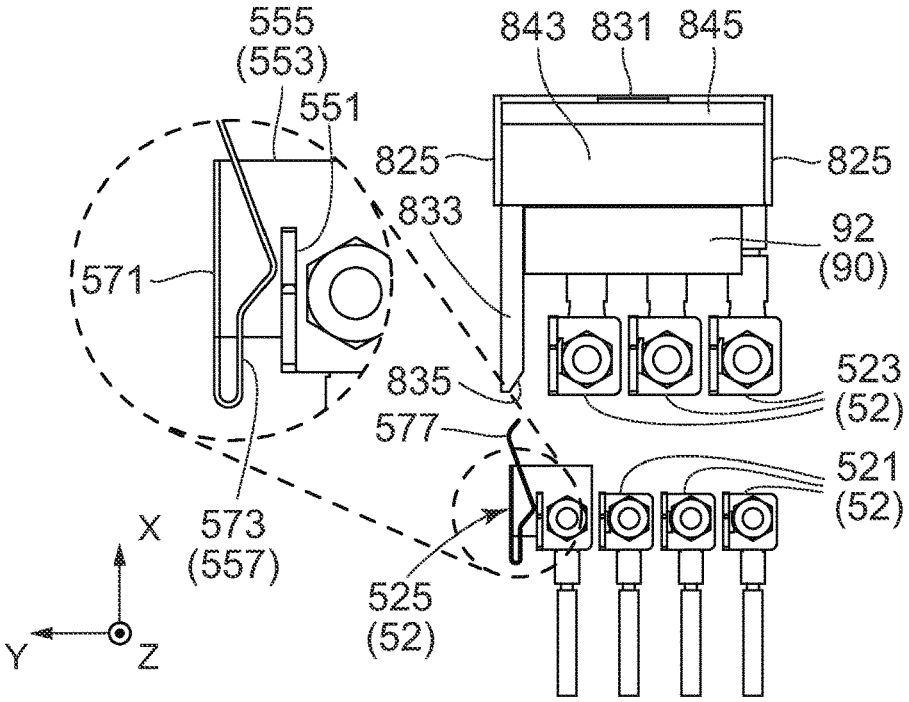
FIG. 34 is a plane view showing the second contacts, the operation member and the movable member of FIG. 33.
Figure 35:
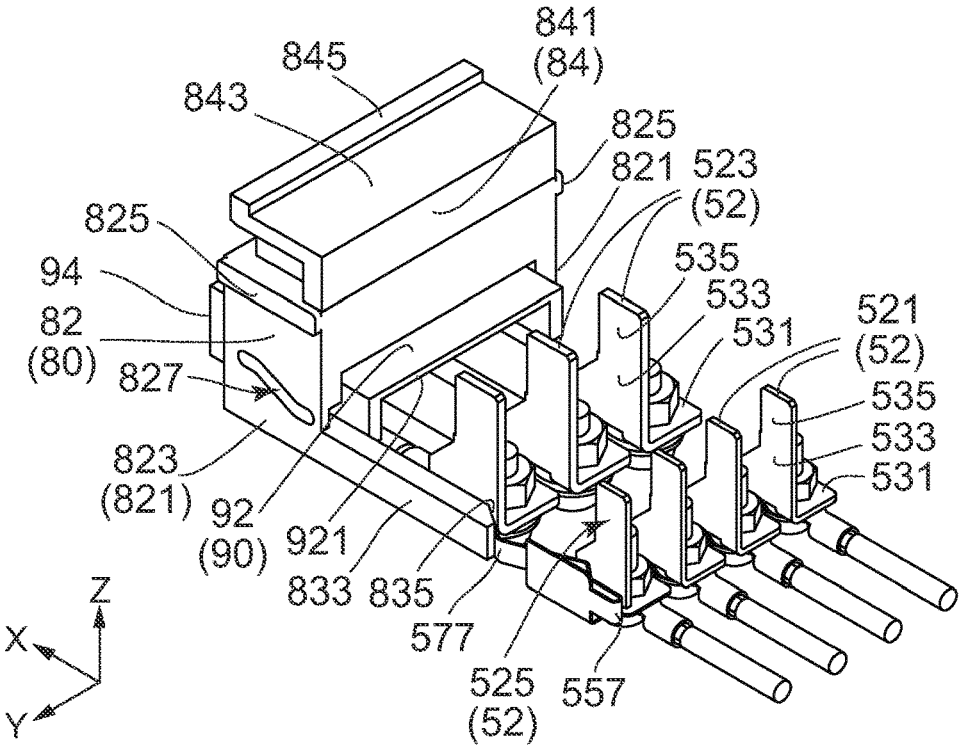
FIG. 35 is a perspective view showing the second contacts, the operation member and the movable member which are included in the second connector of FIG. 20.

As shown in FIGS. 33 to 35, when the operation member 80 is moved from the first position to the second position, the connection state switching portion 833 comes into contact with the operation portion 577 of the detecting contact 525. A front-end portion of the connection state switching portion 833 is provided with a taper portion 835. The taper portion 835 pushes the operation portion 577 inward in the lateral direction. Accordingly, the operation portion 577 is moved inward in the lateral direction, and the resilience portion 573 is resiliently deformed. As a result, the contact portion 575 is moved at least in the lateral direction, and the contact portion 575 comes into contact with the contact piece portion 551. In this way, the contact piece portion 551 of the detecting contact 525 and the body portion 553 are electrically connected to each other. To the contrary, when the operation member 80 is moved from the second position to the first position, the connection state switching portion 833 is moved away from the operation portion 577 of the detecting contact 525 so that the resilience portion 573 returns to an original state. In this way, the contact portion 575 is moved apart from the contact piece portion 551, and the contact piece portion 551 and the body portion 553 of the detecting contact 525 are electrically separated from each other. Thus, the connection state switching mechanism switches between the connected state that the contact piece portion 551 and the body portion 553 are electrically connected to each other and the unconnected state that the contact piece portion 551 and the body portion 553 are electrically separated from each other. Accordingly, the detecting contact 525 can be used for detecting the final mated state. However, in a case where the detecting contact 525 is formed to be changed from the connected state to the unconnected state upon operating the operation portion 577, the detecting contact 525 becomes the unconnected state upon moving the operation member 80 from the first position to the second position while the detecting contact 525 becomes the connected state upon moving the operation member 80 from the second position to the first position. At any rate, the connection state switching mechanism realizes one of the connected state and the unconnected state when the operation member 80 is positioned at the first position, and it realizes the other of the connected state and the unconnected state when the operation member 80 is positioned at the second position.

As understood from FIGS. 45 to 48, upon moving the operation member 80 from the second position to the first position, the movable member 90 is moved downward in the up-down direction. In other words, the movable member 90 is moved toward the unlocked position from the locked position. Until the operation member 80 reaches the first position, the movable member 90 does not completely come out of the admitting portion 72. In other words, the movable member 90 is positioned between the locked position and the unlocked position and does not reach the unlocked position. If the movable member 90 is located even slightly in the admitting portion 72, the regulating portion (the front-end surface 921) regulates rearward movement of the regulated portion (the rear-end surface 39). In other words, provided that the movable member 90 does not reach the unlocked position, the regulating portion regulates the rearward movement of the regulated portion. In this way, when the operation member 80 is moved from the second position to the first position, the rearward movement of the regulated portion is regulated by the regulating portion until the operation member 80 reaches the first position. Thus, until the operation member 80 reaches the first position, the first connector 20 and the second connector 50 cannot be shifted from the final mated state to the preliminary mated state.

As understood from FIGS. 45 and 46, when the operation member 80 reaches the first position, the movable member 90 is positioned at the unlocked position. At that time, the regulating portion (the front-end surface 921) is not positioned rearward of the regulated portion of the first housing 30 (the rear-end surface 39) and allows the rearward movement of the first housing 30 with respect to the second housing 60. Thus, the first connector 20 can enter the admitting portion 72, and the first connector 20 and the second connector 50 can be shifted from the final mated state to the preliminary mated state. Moreover, as understood from FIGS. 33 and 34, electrical connection between the contact piece portion 551 and the body portion 553 of the detecting contact 525 is disconnected.

As described above, in the connector assembly 10 according to the present embodiment, the second guiding portion provided to the second housing 60 and the second guided portion provided to the first housing 30 regulate the upward movement of the first connector 20 with respect to the second connector 50 in the up-down direction between the preliminary mated state and the final mated state and in the final mated state. Thus, the first contacts 22 and the second contacts 52 are prevented from being deformed and broken by an external force. Moreover, when the movable member 90 is positioned at the locked position, the regulating portion of the movable member 90 regulates the rearward movement of the first connector 20 with respect to the second connector 50. Accordingly, the first connector 20 in the final mated state is prevented from being separated from the second connector 50. As a result, the connector assembly 10 according to the present embodiment has high resistance to the external force.

Although the specific explanation about the present invention is made above referring to the embodiments, the present invention is not limited thereto but susceptible of various modifications and alternative forms without departing from the spirit of the invention. For example, in the aforementioned embodiment, the first housing 30 is provided with the first groove 42 and the second groove 43 while the second housing 60 is provided with the guide protruding portion 663. However, the first housing 30 may be provided with the guide protruding portion 663, and the second housing 60 may be provided with the first groove 42 and the second groove 43. Moreover, an L-shape hook portion protruding upward from the bottom wall 64 of the second connector 50 may be provided as the first guiding portion and the second guiding portion, and a hook receiving portion corresponding to the L-shape hook portion may be provided to the first connector 20 as the first guided portion and the second guided portion. Alternately, a hook portion may be provided to the first connector 20, and a hook receiving portion may be provided to the second connector 50. Moreover, in the aforementioned embodiment, the movable member 90 is provided with the cam protrusions 941 while the operation member 80 is provided with the cam grooves 827. However, the movable member 90 may be provided with the cam groove 827, and the operation member 80 may be provided with the cam protrusion 941. Furthermore, although the operation member 80 is movable in the front-rear direction in the aforementioned embodiment, it may be movable in a direction other than the front-rear direction. For example, the operation member 80 may be formed to be pivotable on an axis along the up-down direction. In that case, the movable member 90 should be formed to be movable in the up-down direction by working together with the operation member 80.

The present invention is based on Japanese Patent Application No. JP2018-186752 filed Oct. 1, 2018, the contents of which are incorporated herein in their entirety by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 connector assembly
12 cable
121 power line
123 signal line
14 wall
16 front panel
20 first connector
22 first contact
221 first signal contact
223 first power contact
231 connection portion
233 holding portion
235 contact portion
237 first contact point
239 front-end
30 first housing
32 upper housing
321 cable accommodation portion
34 lower housing
341 first accommodation portion
343 first receiving portion
35 first end wall
351 first slit
36 first additional wall
361 second slit
37 second additional wall
38 third additional wall
39 rear-end surface
40 first sidewall
41 outer surface
42 first groove
421 front inner wall surface (first guided portion)
423 rear inner wall surface (first guided portion)
425 upper inner wall surface
43 second groove
431 lower inner wall surface (second guided portion)
433 upper inner wall surface
50 second connector
52 second contact
521 second signal contact

523 second power contact
531 connection portion
533 fixing portion
535 contact portion
537 second contact point
525 detecting contact
551 contact piece portion
553 body portion
555 base portion
557 resilience piece portion (connection state switching mechanism)
571 supporting portion
573 resilience portion
575 contact portion
577 operation portion
580 power line
60 second housing
601 second accommodation portion
603 second receiving portion
610 overlapping accommodation portion
62 second end wall
621 end wall piece
623 protruding portion
625 extension portion
64 bottom wall
641 upper surface
643 coupling wall
645 movable member accommodation portion
647 table portion
649 groove
651 regulating surface
66 second sidewall
661 inner surface
663 guide protruding portion (protruding portion)
665 front-end surface (first guiding portion)
667 rear-end surface (first guiding portion)
669 lower end surface (second guiding portion)
671 first protruding piece
673 front-end surface (first guiding portion)
675 rear-end surface (first guiding portion)
677 lower end surface (second guiding portion)
681 second protruding piece
683 front-end surface (first guiding portion)
691 guiding groove (third guide portion)
70 cover portion
701 plate portion
703 leg portion
72 admitting portion
80 operation member
82 lower portion
821 sidewall
823 side surface
825 guide protrusion (third guide portion)
827 cam groove (force transmission portion)
831 maintaining piece
832 projection portion
833 connection state switching portion (connection state switching mechanism)
835 taper portion
84 upper portion
841 front wall
843 upper wall
845 operation ridge
847 cover portion accommodation portion
90 movable member
92 front portion
921 front-end surface (regulating portion)
94 rear portion
941 cam protrusion (force receiving portion)
943 inner wall
945 projection portion

The invention claimed is:

1. A connector assembly comprising a first connector and a second connector, wherein:

the first connector and the second connector are shiftable from a separated state to a preliminary mated state by moving the first connector downward with respect to the second connector in an up-down direction;

the first connector and the second connector are shiftable from the preliminary mated state to the separated state by moving the first connector upward with respect to the second connector in the up-down direction;

the first connector and the second connector are shiftable from the preliminary mated state to a final mated state by moving the first connector forward with respect to the second connector in a front-rear direction perpendicular to the up-down direction;

the first connector and the second connector are shiftable from the final mated state to the preliminary mated state by moving the first connector rearward with respect to the second connector in the front-rear direction;

the first connector comprises at least one first contact and a first housing which holds the first contact;

the second connector comprises at least one second contact, a second housing which holds the second contact, an operation member and a movable member;

the first housing is provided with a first guided portion, a second guided portion and a regulated portion;

the second housing is provided with a first guiding portion and a second guiding portion;

the first guided portion and the first guiding portion regulate movement of the first connector with respect to the second connector in the front-rear direction between the separated state and the preliminary mated state;

the second guided portion and the second guiding portion regulate upward movement of the first connector with respect to the second connector in the up-down direction between the preliminary mated state and the final mated state and in the final mated state;

the operation member is provided with a force transmission portion;

the movable member is provided with a force receiving portion and a regulating portion;

the operation member is attached to the second housing to be movable between a first position and a second position;

the movable member is attached to the second housing to be movable between an unlocked position and a locked position;

movement of the movable member is regulated by the second housing in the front-rear direction;

the force transmission portion transmits a force in a predetermined direction to the force receiving portion according to movement of the operation member so that the movable member works together with the operation member;

when the operation member is positioned at the first position, the movable member is positioned at the unlocked position;

when the operation member is positioned at the second position, the movable member is positioned at the locked position;

when the movable member is positioned at the locked position in the final mated state, the regulating portion is positioned rearward of the regulated portion of the first housing to regulate rearward movement of the first housing with respect to the second housing; and when the movable member is positioned at the unlocked state in the final mated state, the regulating portion is not positioned rearward of the regulated portion of the first housing but allows rearward movement of the first housing with respect to the second housing.

2. The connector assembly as recited in claim 1, wherein:

the first position is located rearward of the second position in the front-rear direction;

the second connector comprises an admitting portion which allows forward movement of the operation member from the first position to the second position;

in the preliminary mated state, the first connector is positioned in the admitting portion in part;

in the final mated state, the first connector is positioned forward of the admitting portion; and when the operation member is moved to the second position in the final mated state, the movable member enters the admitting portion in part so that the regulating portion regulates rearward movement of the first housing with respect to the second housing.

3. The connector assembly as recited in claim 2, wherein:

the predetermined direction is the up-down direction;

the unlocked position is located downward of the locked position in the up-down direction;

the operation member is moveable between the first position and the second position along the front-rear direction; and the movable member is moveable between the unlocked position and the locked position along the up-down direction.

4. The connector assembly as recited in claim 1, wherein:

one of the force transmission portion and the force receiving portion comprises at least one cam groove; and a remaining one of the force transmission portion and the force receiving portion comprises at least one cam protrusion.

5. The connector assembly as recited in claim 4, wherein:

the at least one cam groove is a pair of cam grooves;

the at least one cam protrusion is a pair of cam protrusions;

the cam protrusions protrude in opposite directions along a lateral direction perpendicular to both of the up-down direction and the front-rear direction;

the cam protrusions are arranged apart from each other in the lateral direction; and the cam grooves are arranged to correspond to the cam protrusions, respectively.

6. The connector assembly as recited in claim 1, wherein:

the regulating portion is a front-end surface of the movable member; and the regulated portion is a rear-end surface of the first housing.

7. The connector assembly as recited in claim 2, wherein:

the second housing has a bottom wall;

the second contact protrudes upward from an upper surface of the bottom wall in part;

the bottom wall is provided with a movable member accommodation portion which accommodates the movable member at least in part;

the movable member accommodation portion is recessed downward from the upper surface of the bottom wall;

the movable member accommodation portion is located rearward of the second contact and overlaps with the admitting portion in the front-rear direction;

the movable member accommodation portion is located downward of the admitting portion in the up-down direction and communicates with the admitting portion;

when the operation member is positioned at the first position, the movable member is not positioned in the admitting portion; and when the operation member is positioned at the second position, the movable member is positioned in the admitting portion in part.

8. The connector assembly as recited in claim 1, wherein:

the first housing comprises a pair of first sidewalls extending in the front-rear direction;

the first sidewalls face each other in a lateral direction perpendicular to both of the up-down direction and the front-rear direction;

the second housing comprises a pair of second sidewalls extending in the front-rear direction;

the second sidewalls face each other in the lateral direction;

the first guided portion and the second guided portion are provided to the first sidewalls; and the first guiding portion and the second guiding portion are provided to the second sidewalls.

9. The connector assembly as recited in claim 8, wherein:

each of the second sidewalls has an inner surface facing inward in the lateral direction;

the inner surfaces are provided with a third guided portion;

the operation member has side surfaces facing outward in the lateral direction;

the side surfaces are provided with a third guiding portion;

the third guiding portion and the third guided portion guide the operation member between the first position and the second position;

one of the third guiding portion and the third guided portion comprises a pair of guiding grooves; and a remaining one of the third guiding portion and the third guided portion comprises a pair of guide protrusions.

10. The connector assembly as recited in claim 1, wherein:

the second housing has a cover portion;

the cover portion overlaps with the movable member when viewed along in the up-down direction;

the operation member is provided with a cover portion accommodation portion;

the cover portion accommodation portion accommodates the cover portion at least in part when the operation member is positioned at the first position; and the cover portion comes out of the cover portion accommodation portion according to movement of the operation member from the first position to the second position.

11. The connector assembly as recited in claim 1, wherein:

one of the second contacts is a detecting contact which detects the final mated state;

the detecting contact has a contact piece portion and a body portion separated from the contact piece portion;

the contact piece portion is in contact with one of the first contact in the final mated state;

the second connector comprises a connection state switching mechanism;

the connection state switching mechanism performs switching between a connected state that the contact piece portion and the body portion are electrically connected to each other and an unconnected state that the contact piece portion and the body portion are electrically separated from each other;

when the operation member is positioned at the first position, the connection state switching mechanism realizes one of the connected state and the unconnected state; and when the operation member is positioned at the second position, the connection state switching mechanism realizes a remaining one of the connected state and the unconnected state.

12. The connector assembly as recited in claim 11, wherein:

the connection state switching mechanism comprises a connection state switching portion provided to the operation member and a resilience piece portion provided to the body portion;

the resilience piece portion has a contact portion contactable to the contact piece portion;

when the operation member is moved from the first position to the second position, the connection state switching portion comes into contact with the resilience piece portion and moves the contact portion to perform switching from the connected state to the unconnected state or from unconnected state to the connected state.

13. The connector assembly as recited in claim 8, wherein:

each of the second sidewalls has an inner surface facing inward in the lateral direction;

the inner surface is formed with a protruding portion protruding inward from the inner surface in the lateral direction;

the protruding portion has a front-end surface and a rear-end surface at both ends thereof in the front-rear direction;

the front-end surfaces and the rear-end surfaces function as the first guiding portion;

the first sidewall has an outer surface facing outward in the lateral direction;

the outer surface is formed with a first groove recessed inward in the lateral direction;

the first groove has a front inner wall surface and a rear inner wall surface located at both sides thereof in the front-rear direction;

the front inner wall surfaces and the rear inner wall surfaces function as the first guided portion;

the protruding portion has a lower end surface facing downward in the up-down direction;

the lower end surfaces function as the second guiding portion;

the outer surface is formed with a second groove recessed inward in the lateral direction and extending rearward from the first groove;

the second groove has a lower inner wall surface facing upward in the up-down direction; and the lower inner wall surfaces function as the second guided portion.

14. The connector assembly as recited in claim 13, wherein:

the protruding portion has a first protruding piece being long in the front-rear direction and a second protruding piece being long in up-down direction;

the first protruding piece is located upward of the second protruding piece in the up-down direction;

the second protruding piece is coupled with a front-end portion of the first protruding piece;

the first guiding portion consists of front-end surfaces of the first protruding pieces, front-end surfaces of the second protruding pieces and rear-end surfaces of the first protruding pieces;

the second guiding portion consists of lower end surfaces of the first protruding pieces; and upper inner wall surfaces of the first grooves and upper inner wall surfaces of the second grooves are on a same plane.

15. The connector assembly as recited in claim 2, wherein, when the first connector and the second connector are shifted from the preliminary mated state to the final mated state, the first connector regulates movement of the movable member until the first connector goes outside the admitting portion completely and the first connector and the second connector are shifted to the final mated state, so that the regulating portion cannot perform regulation.

16. The connector assembly as recited in claim 2, wherein, when the operation member is moved from the second position to the first position, regulation made by the regulating portion is maintained until the operation member reaches the first position, so that the first connector and the second connector cannot be shifted from the final mated state to the preliminary mated state.

17. The first connector used in the connector assembly as recited in claim 1.

18. The second connector used in the connector assembly as recited in claim 1.

* * * * *